US007492243B2

(12) United States Patent
Hidaka et al.

(10) Patent No.: US 7,492,243 B2
(45) Date of Patent: Feb. 17, 2009

(54) PLANAR CIRCUIT, HIGH-FREQUENCY CIRCUIT DEVICE, AND TRANSMISSION AND RECEPTION APPARATUS

(75) Inventors: Seiji Hidaka, Yokohama (JP); Shigeyuki Mikami, Sagamihara (JP)

(73) Assignee: Murata Manufacturing Co., Ltd (JP)

( * ) Notice: Subject to any disclaimer, the term of this patent is extended or adjusted under 35 U.S.C. 154(b) by 0 days.

(21) Appl. No.: 11/868,074

(22) Filed: Oct. 5, 2007

(65) Prior Publication Data

US 2008/0088391 A1 Apr. 17, 2008

Related U.S. Application Data

(63) Continuation of application No. PCT/JP2006/305794, filed on Mar. 23, 2006.

(30) Foreign Application Priority Data

Apr. 11, 2005 (JP) ..... 2005-113951
Apr. 11, 2005 (JP) ..... 2005-113952

(51) Int. Cl.
*H01P 1/20* (2006.01)
*H01P 3/08* (2006.01)

(52) U.S. Cl. ..... 333/204; 333/175; 333/185; 333/202; 333/219

(58) Field of Classification Search ..... None
See application file for complete search history.

(56) References Cited

U.S. PATENT DOCUMENTS 6,323,740 B1 11/2001 Ishikawa et al.
6,895,262 B2 * 5/2005 Cortes et al. ..... 505/210
2004/0041668 A1 3/2004 Mikami et al.

FOREIGN PATENT DOCUMENTS

JP 2000-101301 4/2000
JP 2001-168610 6/2001
JP 2001-308608 11/2001

(Continued)

OTHER PUBLICATIONS

PCT/JP2006/305794 Copy of Written Opinion dated May 16, 2006.

(Continued)

*Primary Examiner*—Benny Lee
*Assistant Examiner*—Kimberly E Glenn
(74) *Attorney, Agent, or Firm*—Dickstein, Shapiro, LLP.

(57) ABSTRACT

A planar circuit having a conductive film on either main surface of a substrate. The conductive film on one of the main surfaces is patterned with two-dimensionally and repeatedly arranged unit cells, which are basic conductor patterns. Each of the unit cells has a capacitive region at the center thereof. Capacitance is induced between the center area and the conductor film formed on the main surface of the substrate opposite the center area. An area located near the middle of each of sides in the peripheral portion serves as an inductive region. In any two adjacent unit cells, the inductive regions have a multiple spiral-shaped conductor pattern, in which the center ends thereof are connected to each other at a halfway position between the two unit cells, and the outer peripheral ends thereof are connected to the capacitive regions.

11 Claims, 54 Drawing Sheets

FOREIGN PATENT DOCUMENTS

| | | |
|---|---|---|
| JP | 2002-335106 | 11/2002 |
| JP | 2003-92502 | 3/2003 |
| JP | 2003-258504 | 9/2003 |
| JP | 2004-15778 | 1/2004 |

OTHER PUBLICATIONS

PCT/JP2006/305794 Copy of International Search Report dated May 16, 2006.

Coccioli et al. "Aperture-Coupled Patch Antenna on UC-PBG Substrate" IEEE Transactions on Microwave Theory and Techniques, vol. 47, No. 11, Nov. 1999, pp. 2123-2130.

Yang et al. "A Novel TEM Waveguide Using Uniplanar Compact Photonic-Bandgap (UC-PBG) Structure" IEEE Transactions on Microwave Theory and Techniques, vol. 47, No. 11, Nov. 1999, pp. 2092-2098.

Qian et al. "Characteristics of Microstrip Lines on A Uniplanar Compact PBG Ground Plane", 1988 Asia-Pacific Microwave Conference, pp. 589-592.

* cited by examiner (A)

(B)

(A)

(B)

(C)

(A)

(B)

(C)

| No | A (mm) | W (mm) | H1 (mm) | H2 (mm) | L (mm) | S (mm) | f1 (GHz) | f2 (GHz) | f3 (GHz) | f4 (GHz) | f5 (GHz) |
|---|---|---|---|---|---|---|---|---|---|---|---|
| 1 | 0.052 | 0.026 | 0.300 | 0.300 | 0.002 | 0.002 | 207.0 | 259.2 | 262.0 | 370.7 | 571.0 |
| 2 | 0.078 | 0.039 | 0.300 | 0.300 | 0.003 | 0.003 | 138.8 | 174.9 | 175.4 | 256.8 | 409.8 |
| 3 | 0.104 | 0.052 | 0.300 | 0.300 | 0.004 | 0.004 | 107.1 | 135.4 | 135.6 | 205.9 | 319.0 |
| 4 | 0.130 | 0.065 | 0.300 | 0.300 | 0.005 | 0.005 | 86.5 | 109.1 | 109.1 | 167.6 | 257.3 |
| 5 | 0.156 | 0.078 | 0.300 | 0.300 | 0.006 | 0.006 | 72.1 | 91.2 | 91.2 | 140.8 | 214.0 |
| 6 | 0.182 | 0.091 | 0.300 | 0.300 | 0.007 | 0.007 | 62.0 | 78.5 | 78.5 | 121.8 | 183.2 |
| 7 | 0.208 | 0.104 | 0.300 | 0.300 | 0.008 | 0.008 | 54.2 | 68.5 | 68.5 | 105.9 | 160.2 |
| 8 | 0.234 | 0.117 | 0.300 | 0.300 | 0.009 | 0.009 | 48.2 | 60.8 | 60.9 | 94.0 | 143.2 |

(A)

(B)

(C)

| No | A (mm) | W (mm) | H1 (mm) | H2 (mm) | L (mm) | S (mm) | f1 (GHz) | f2 (GHz) | f3 (GHz) | f4 (GHz) | f5 (GHz) |
|---|---|---|---|---|---|---|---|---|---|---|---|
| 1 | 0.068 | 0.034 | 0.300 | 0.300 | 0.002 | 0.002 | 122.0 | 158.7 | 158.9 | 217.5 | 378.1 |
| 2 | 0.102 | 0.051 | 0.300 | 0.300 | 0.003 | 0.003 | 82.4 | 107.7 | 108.2 | 152.6 | 251.5 |
| 3 | 0.136 | 0.068 | 0.300 | 0.300 | 0.004 | 0.004 | 63.4 | 82.2 | 82.5 | 119.8 | 193.3 |
| 4 | 0.170 | 0.085 | 0.300 | 0.300 | 0.005 | 0.005 | 51.4 | 66.6 | 66.6 | 98.7 | 155.9 |
| 5 | 0.204 | 0.102 | 0.300 | 0.300 | 0.006 | 0.006 | 42.8 | 55.5 | 55.5 | 82.3 | 129.2 |

(A)

(B)

(C)

| No | A (mm) | W (mm) | H1 (mm) | H2 (mm) | L (mm) | S (mm) | f1 (GHz) | f2 (GHz) | f3 (GHz) | f4 (GHz) | f5 (GHz) |
|---|---|---|---|---|---|---|---|---|---|---|---|
| 1 | 0.084 | 0.042 | 0.300 | 0.300 | 0.002 | 0.002 | 80.3 | 107.2 | 107.5 | 145.2 | 244.5 |
| 2 | 0.126 | 0.063 | 0.300 | 0.300 | 0.003 | 0.003 | 55.4 | 73.5 | 73.6 | 103.7 | 168.6 |
| 3 | 0.168 | 0.084 | 0.300 | 0.300 | 0.004 | 0.004 | 42.4 | 55.7 | 55.7 | 80.5 | 128.1 |
| 4 | 0.210 | 0.105 | 0.300 | 0.300 | 0.005 | 0.005 | 34.0 | 44.8 | 44.8 | 64.9 | 102.3 |
| 5 | 0.252 | 0.126 | 0.300 | 0.300 | 0.006 | 0.006 | 28.4 | 37.4 | 37.4 | 54.7 | 85.6 |

(A)

(UNIT:deg)

| SYMBOL | Γ | | | X | | | M | | | Γ |
|---|---|---|---|---|---|---|---|---|---|---|
| θx | 0 | 15 | ... | 180 | 180 | ... | 180 | 165 | ... | 0 |
| θy | 0 | 0 | ... | 0 | 15 | ... | 180 | 165 | ... | 0 |
| *Ka* | 0 | 15 | ... | 180 | 195 | ... | 360 | 375 | ... | 540 |

(B)

(C)

(A)

(B)

(A)

(B)

(C)

| No | A (mm) | W (mm) | H1 (mm) | H2 (mm) | L (mm) | S (mm) | f1 (GHz) | f2 (GHz) | f3 (GHz) | f4 (GHz) | f5 (GHz) |
|---|---|---|---|---|---|---|---|---|---|---|---|
| 1 | 0.130 | 0.065 | 0.300 | 0.300 | 0.005 | 0.005 | 106.3 | 106.7 | 154.9 | 223.2 | 299.7 |
| 2 | 0.156 | 0.078 | 0.300 | 0.300 | 0.006 | 0.006 | 89.7 | 90.0 | 131.2 | 188.2 | 260.7 |
| 3 | 0.182 | 0.091 | 0.300 | 0.300 | 0.007 | 0.007 | 77.3 | 77.4 | 113.6 | 160.5 | 225.5 |
| 4 | 0.208 | 0.104 | 0.300 | 0.300 | 0.008 | 0.008 | 67.7 | 68.1 | 99.6 | 142.8 | 198.2 |
| 5 | 0.234 | 0.117 | 0.300 | 0.300 | 0.009 | 0.009 | 60.5 | 60.7 | 88.8 | 127.0 | 179.3 |
| 6 | 0.260 | 0.130 | 0.300 | 0.300 | 0.010 | 0.010 | 54.7 | 54.8 | 80.4 | 117.0 | 155.5 |
| 7 | 0.286 | 0.143 | 0.300 | 0.300 | 0.011 | 0.011 | 49.7 | 49.8 | 73.3 | 106.5 | 145.4 |

(A)

(B)

(C)

| No | A (mm) | W (mm) | H1 (mm) | H2 (mm) | L (mm) | S (mm) | f1 (GHz) | f2 (GHz) | f3 (GHz) | f4 (GHz) | f5 (GHz) |
|---|---|---|---|---|---|---|---|---|---|---|---|
| 1 | 0.136 | 0.068 | 0.300 | 0.300 | 0.004 | 0.004 | 86.5 | 86.7 | 129.2 | 180.8 | 260.2 |
| 2 | 0.170 | 0.085 | 0.300 | 0.300 | 0.005 | 0.005 | 68.8 | 68.9 | 103.6 | 145.9 | 215.0 |
| 3 | 0.204 | 0.102 | 0.300 | 0.300 | 0.006 | 0.006 | 57.7 | 57.8 | 86.8 | 122.5 | 177.1 |
| 4 | 0.238 | 0.119 | 0.300 | 0.300 | 0.007 | 0.007 | 49.7 | 49.7 | 74.9 | 106.9 | 153.1 |

(A)

(B)

(C)

| No | A (mm) | W (mm) | H1 (mm) | H2 (mm) | L (mm) | S (mm) | f1 (GHz) | f2 (GHz) | f3 (GHz) | f4 (GHz) | f5 (GHz) |
|---|---|---|---|---|---|---|---|---|---|---|---|
| 1 | 0.084 | 0.042 | 0.300 | 0.300 | 0.002 | 0.002 | 119.2 | 119.2 | 181.7 | 253.6 | 374.1 |
| 2 | 0.126 | 0.063 | 0.300 | 0.300 | 0.003 | 0.003 | 80.3 | 80.4 | 122.4 | 172.2 | 249.0 |
| 3 | 0.168 | 0.084 | 0.300 | 0.300 | 0.004 | 0.004 | 60.0 | 60.2 | 91.6 | 129.2 | 168.7 |
| 4 | 0.210 | 0.105 | 0.300 | 0.300 | 0.005 | 0.005 | 48.3 | 48.4 | 73.5 | 103.3 | 151.9 |
| 5 | 0.252 | 0.126 | 0.300 | 0.300 | 0.006 | 0.006 | 40.5 | 40.5 | 61.6 | 87.6 | 125.4 |

(A)

(B)

PLANAR CIRCUIT, HIGH-FREQUENCY CIRCUIT DEVICE, AND TRANSMISSION AND RECEPTION APPARATUS

CROSS REFERENCE TO RELATED APPLICATIONS

The present application is a continuation of International Application No. PCT/JP2006/305794, filed Mar. 23, 2006, which claims priority to Japanese Patent Application No. JP2005-113951, filed Apr. 11, 2005, and Japanese Patent Application No. JP2005-113952, filed Apr. 11, 2005, the entire contents of each of these applications being incorporated herein by reference in their entirety.

FIELD OF THE INVENTION

The present invention relates to a planar circuit including a substrate having conductive films formed on either main surface thereof, and a high-frequency circuit device and a transmission and reception apparatus including the planar circuit.

BACKGROUND OF THE INVENTION

A variety of transmission lines are used for transmission lines in microwave bands and millimeter-wave bands. Examples of the transmission lines include a grounded coplanar transmission line including a dielectric plate having a ground electrode on the substantially entire first surface thereof and a coplanar on the second surface thereof, a grounded slot transmission line including a dielectric plate having a ground electrode on the first surface thereof and a slot on the second surface thereof, and a planar dielectric transmission line (PDTL) including a dielectric plate having opposing slots on either surface thereof.

These transmission lines have a structure including two parallel planar conductors. Accordingly, for example, if an electromagnetic field is disturbed at input and output portions or a bent portion of the transmission line, a spurious mode wave, such as a so-called parallel plate mode wave, is induced between the two parallel planar conductors. The spurious mode wave (hereinafter simply referred to as an "unwanted wave") disadvantageously propagate between the two parallel planar conductors. If unwanted waves propagate (leak), the unwanted waves interfere with each other between neighboring transmission lines, and therefore, a problem of signal leakage occurs. In addition, since partial energy of the propagation waves leaks in the form of unwanted waves, the partial energy is not reconstructed as transmitted waves. Consequently, transmission loss occurs.

Non-patent document 1 and Patent document 1 describe transmission lines in which a unit cell pattern including a capacitive region and an inductive region is repeatedly arranged in two-dimensional directions (longitudinal and transverse directions) to prevent such propagation of unwanted waves.

FIG. 1(A) illustrates the pattern of a unit cell formed on a substrate described in Non-Patent Document 1. FIG. 1(B) illustrates an example of a band gap caused by a planar circuit described in Non-Patent Document 1. In the planar circuit according to Non-Patent Document 1, the unit cell illustrated in FIG. 1(A) is arranged on an upper surface of the substrate in two-dimensional directions. A ground electrode is formed on the entire lower surface. Let Γ be the center of the unit cell, X be an end of the unit cell extending from Γ in an X-axis direction, and M be an end of the unit cell extending from X in a Y direction. Then, FIG. 1(B) illustrates the frequencies in each of the modes of the wave number space in a path Γ-X-M-Γ. In this example, a unit cell having sides of about 3 mm is arranged on a surface of a dielectric substrate having a relative permittivity of 10.2 and a thickness of about 0.6 mm. A band gap (a forbidden band or stopband) between about 11 GHz and about 14 GHz appears between a first mode f1 and a second mode f2. A band gap between about 18 GHz and about 22 GHz appears between the second mode f2 and a third mode f3.

A reduced-width crisscross strip portion of the unit cell serves as an inductive region (an inductance component). The combined pattern of rectangular patterns formed at the center and four corners of the unit cell serves as a capacitive region (a capacitance component).

However, to design a planar circuit having such a unit cell in order to obtain a band gap frequency of 10 GHz, the planar circuit needs to have a unit cell having sides as long as about 3 mm. Thus, to lay out the planar circuit together with an interconnection pattern of the circuit, the design flexibility (layout flexibility) is decreased.

In contrast, the layout flexibility of the planar circuit described in Patent Document 1 is increased by decreasing the size of the unit cell. In addition, the loss characteristic does not deteriorate. FIG. 2 illustrates an example of a unit cell described in Patent Document 1. In the planar circuit, a capacitive region C is disposed at the center of the unit cell. An inductive region L having a meandering line shape is disposed around the capacitive region C. In this way, by forming a unit cell having a large capacitance component of the capacitance region C and a large inductance component of the inductive region L, the size of the unit cell can be decreased.

Patent document 2 describes a planar circuit that prevents the propagation of a spurious mode using a conductor transmission line and a plurality of filters connected to the conductor transmission line. FIG. 3 illustrates an example of the planar circuit described in Patent Document 2. The planar circuit includes two parallel conductor transmission lines 7A and 7B. Two spiral transmission lines 8A and 8B extend parallel to each other from the base portion of a resonator disposed in each of the stages. The top ends 8C of the two spiral transmission lines 8A and 8B are connected. The base portions of the resonators are connected to a plurality of portions of the transmission line 7A, which is one of the two parallel conductor transmission lines 7A and 7B.

Non-patent Document 1: T. Itoh, et. al. "Aperture-Coupled Patch Antenna on UC-PBGSubstrate," IEEE Trans. Vol. 47, no. 11, pp. 2123-2130, November 1999.

Patent Document 1: Japanese Unexamined Patent Application Publication No. 2000-101301

Patent Document 2: Japanese Unexamined Patent Application Publication No. 2003-258504

However, in the planar circuit including the conductive region of the unit cell having a meandering line shape disclosed in Patent Document 1, the band gap is disadvantageously decreased in a bottleneck shape in accordance with the direction of waves propagating in the substrate as described later.

As shown in FIG. 3, in the planar circuit described in Patent Document 2, filters, each including the conductor transmission lines 7A and 7B and a resonator 8, are basically one-dimensionally disposed. In the structure in which the filters, each including the conductor transmission lines 7A and 7B and the resonator 8, are one-dimensionally disposed, the geometric asymmetry (anisotropic nature) results in differences in the electrical characteristics in accordance with the propagation direction. In addition, since an interconnection line is connected at an angle of 45° for a direct current when a direct current bias voltage is applied, it is difficult to design the planar circuit.

SUMMARY OF THE INVENTION

Accordingly, the present invention provides a planar circuit that produces a wide band gap regardless of a direction in which the waves propagates in the substrate, a high-frequency circuit device, and a reception/transmission unit including the planar circuit.

To solve the above-described problem, the present invention provides the following structure:

(1) A planar circuit includes a substrate and conductor films formed on either main surface of the substrate. At least one conductor film includes a pattern formed region in a predetermined area thereof. The pattern formed region is patterned with two-dimensionally and repeatedly arranged unit cells, each serving as a basic conductor pattern. Each of the unit cells has rotational symmetry, for example, substantially three-fold rotational symmetry, substantially four-fold rotational symmetry, substantially six-fold rotational symmetry, the center area therein serving as a capacitive region. Capacitance is induced between the center area and the conductor film formed on the main surface of the substrate opposite the center area. An area located near the middle of each of sides in the peripheral portion serves as an inductive region. In any two adjacent unit cells, the inductive regions have a multiple spiral-shaped conductor pattern having two-fold rotational symmetry in which the center ends thereof are connected to each other at a halfway portion between the two unit cells, and the outer peripheral ends thereof are connected to the capacitive regions.

(2) A planar circuit includes a substrate and conductor films formed on either main surface of the substrate. At least one conductor film includes a pattern formed region in a predetermined area thereof. The pattern formed region is patterned with two-dimensionally and repeatedly arranged unit cells, each serving as a basic conductor pattern. Each of the unit cells has rotational symmetry, the center area in the unit cell serving as an inductive region. An area located at least near the middle of each of sides in the peripheral portion in the unit cell serves as a capacitive region. Capacitance is induced between the area and the conductor film formed on the main surface of the substrate opposite the area. The inductive region has a multiple spiral-shaped conductor pattern in which inner ends are connected to each other at the center thereof and outer peripheral ends thereof are connected to the capacitive regions, and, in any two adjacent unit cells, the capacitive region of one unit cell is connected to the capacitive region of the other unit cell at a halfway portion between the two unit cells.

(3) A high-frequency circuit device includes the above-described planar circuit. A transmission line conductor pattern is formed by the conductor film disposed on one of the main surfaces of the substrate of the planar circuit, and a ground conductor is formed by the conductor film disposed on the other main surface so as to form a grounded waveguide. An area of the conductor film remote from an electromagnetic wave guiding area of the grounded waveguide by a predetermined distance is determined to be the pattern formed region.

(4) A high-frequency circuit device includes the above-described planar circuit. The conductor films disposed on either main surface of the substrate of the planar circuit form transmission line conductor patterns having plane symmetry with respect to each other across the substrate so as to form a waveguide. An area of the conductor film remote from an electromagnetic wave guiding area of the waveguide by a predetermined distance is determined to be the pattern formed region.

(5) A high-frequency circuit device includes the above-described planar circuit. A high-frequency circuit is disposed on the substrate of the planar circuit.

(6) A transmission and reception apparatus includes a high-frequency signal processing unit including one of the above-described planar circuit and the above-described high-frequency circuit device.

Advantages (1) In any two adjacent unit cells, the inductive regions have a multiple spiral-shaped conductor pattern having two-fold rotational symmetry in which the center ends thereof are connected to each other at a halfway portion between the two unit cells, and the outer peripheral ends thereof are connected to the capacitive regions. Consequently, the loss in the inductive region can be reduced. Since an occupied area of the inductive region with respect to an obtained inductance component is small, the size of the unit cell can be reduced. Accordingly, the planar circuit is used together with a circuit interconnection pattern, the design flexibility (layout flexibility) can be increased without degrading the loss characteristics.

(2) The center area of the unit cell serves as an inductive region, while an area located at least near the middle of each of sides in the peripheral portion in the unit cell serves as a capacitive region, where capacitance is induced between the area and the conductor film formed on the main surface of the substrate opposite the area. The inductive region has a multiple spiral-shaped conductor pattern in which inner ends are connected to each other at the center thereof and outer peripheral ends thereof are connected to the capacitive regions, and, in any two adjacent unit cells, the capacitive region of one unit cell is connected to the capacitive region of the other unit cell at a halfway portion between the two unit cells. Consequently, the impedance ratio between the inductive region and the capacitive region can be increased, and therefore, the relative bandwidth can be increased. That is, a band gap is increased, thereby providing an excellent single transmission characteristic.

(3) A transmission line conductor pattern is formed on one of the main surfaces of the substrate, and a ground conductor is formed on the other main surface so as to form a grounded waveguide. An area of the conductor film remote from an electromagnetic wave guiding area of the grounded waveguide by a predetermined distance is determined to be the pattern formed region. Accordingly, coupling between a spurious mode, such as a parallel plate mode, propagating in the substrate and a waveguide can be prevented. In addition, conversely, the propagation of the parallel plate mode caused by the grounded waveguide can be prevented. Therefore, for example, even when two grounded waveguides are closely disposed, the pattern formed region provided between the two grounded waveguides can prevent the coupling between the two grounded waveguides due to the parallel plate mode. Thus, an occupied area of a plurality of the grounded waveguides on the substrate can be reduced, and therefore, the size of the high-frequency circuit device can be reduced. Furthermore, since unwanted coupling between the grounded waveguide and other high-frequency circuits, such as resonators, mounted on the substrate can be prevented, the distance between the high-frequency circuits can be reduced, thereby reducing the size of the high-frequency circuit device.

(4) The conductor films disposed on either main surface of the substrate of the planar circuit form transmission line conductor patterns having plane symmetry with respect to each other across the substrate so as to form a waveguide. An area of the conductor film remote from an electromagnetic wave guiding area of the waveguide by a predetermined distance is determined to be the pattern formed region. Accordingly, like the above-described structure (2), coupling between a spurious mode, such as a parallel plate mode, propagating in the substrate and a waveguide can be prevented. In addition, the propagation of the parallel plate mode caused by the waveguide can be prevented. As a result, an occupied area of a plurality of the waveguides on the substrate can be reduced, and therefore, the size of the high-frequency circuit device can be reduced. Furthermore, since unwanted coupling between the waveguide and other high-frequency circuits mounted on the substrate can be prevented, the distance between the high-frequency circuits can be reduced, thereby reducing the size of the high-frequency circuit device.

(5) A high-frequency circuit device includes the above-described planar circuit, and a high-frequency circuit is provided on the substrate of the planar circuit. Accordingly, a spurious mode, such as a parallel plate mode, that attempts to propagate in the substrate is blocked. Thus, the high-frequency circuit can be highly integrated in a limited area.

(6) Since the planar circuit that prevents propagation of a spurious mode is provided, power loss caused by a spurious wave is decreased, and therefore, the efficiency can be increased. In addition, noise caused by the spurious wave can be decreased. Furthermore, since a transmission and reception apparatus includes a high-frequency signal processing unit incorporating the high-frequency circuit device that is highly integrated and is compact, the size of the transmission and reception apparatus can be reduced.

REFERENCE NUMERALS

Figure 1:
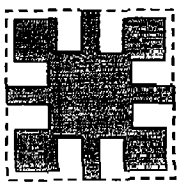
FIG. 1 PRIOR ART
FIG. 1 illustrates a unit cell and an analysis result of the unit cell described in Non-Patent Document 1.
Figure 1:
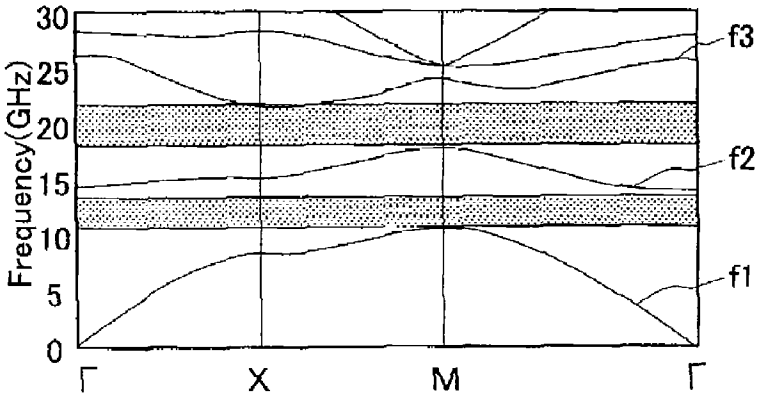
FIG. 1 PRIOR ART
Figure 2:
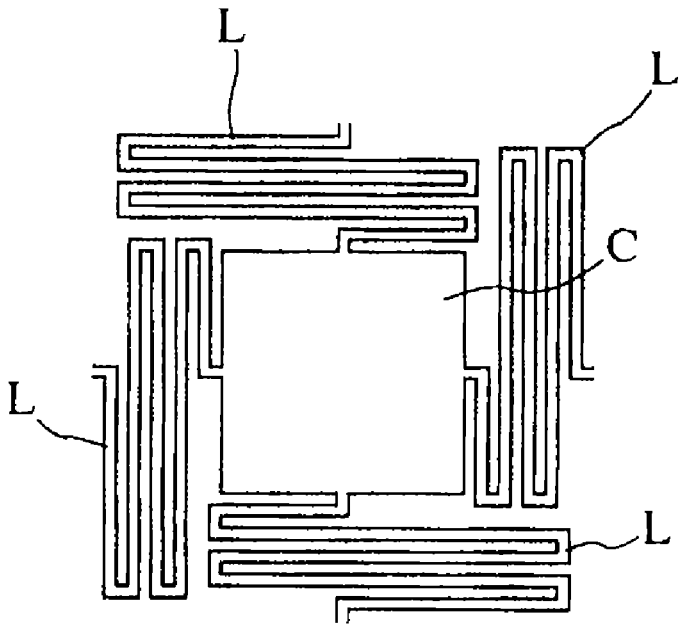
FIG. 2 PRIOR ART
FIG. 2 illustrates an example of a unit cell described in Patent Document 1.
Figure 3:
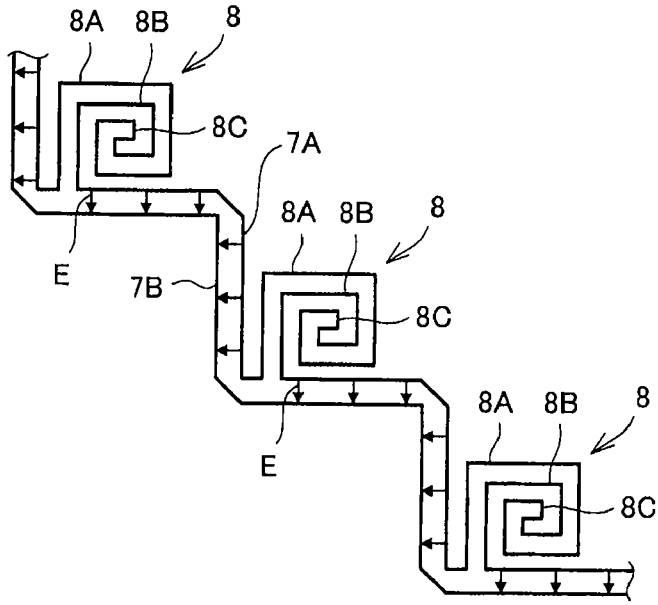
FIG. 3 PRIOR ART
FIG. 3 illustrates an example structure of a band rejection filter using one-dimensional arrangement described in Patent Document 2.

1 substrate
2 ground conductor film
3, 5 patterned conductor film
4 transmission line conductor
100 planar circuit
101 high-frequency circuit device
102 communication apparatus
N pattern unformed region
P pattern formed region
CA capacitive region
LA inductive region
CL unit cell
OA peripheral region
JA relay region
Pc center end
Po outer peripheral end
SL slot
SA defined region

DETAILED DESCRIPTION OF THE INVENTION

First Embodiment

Structures of a planar circuit and a high-frequency circuit device according to a first embodiment are described below with reference to FIGS. 4 to 15 and FIG. 35.

Figure 4:
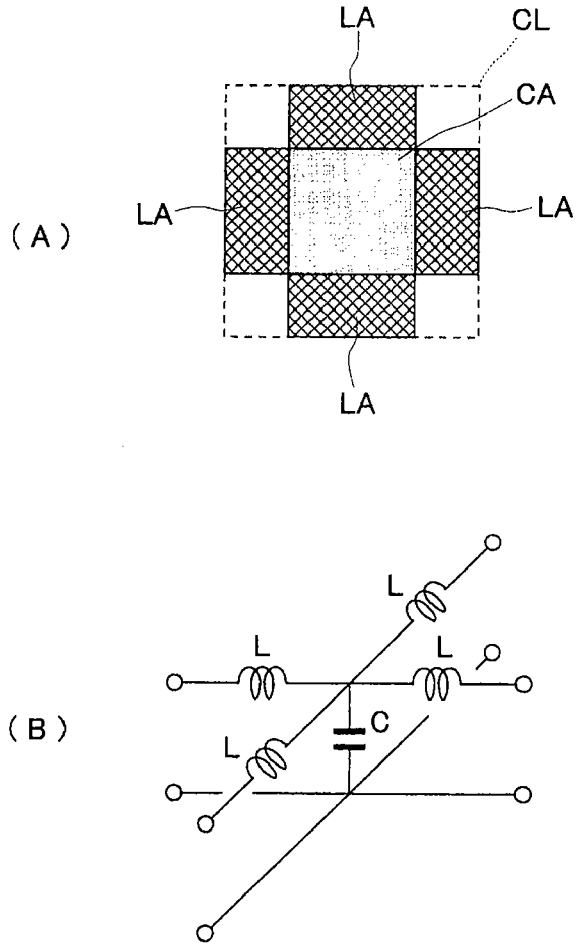
FIG. 4 illustrates the structure of a unit cell used in a planar circuit and a high-frequency circuit device and a circuit of the unit cell according to a first embodiment.

FIG. 4 illustrates a unit cell CL which is a basic conductor pattern formed in a conductor film of a substrate and an equivalent circuit of the unit cell CL. The unit cell CL includes a capacitive region CA at the center thereof. In addition, the unit cell CL includes an inductive region LA in an area located near the middle of each side in the peripheral portion. FIG. 4(B) illustrates an equivalent circuit of a circuit formed from the unit cell shown in FIG. 4(A) and a ground conductor film disposed on the rear surface of the substrate. The ground conductor film faces the unit cell across the substrate. A capacitance component C is induced between the capacitive region CA and the ground conductor film, while an inductive component L is induced by the inductive region LA.

Figure 5:
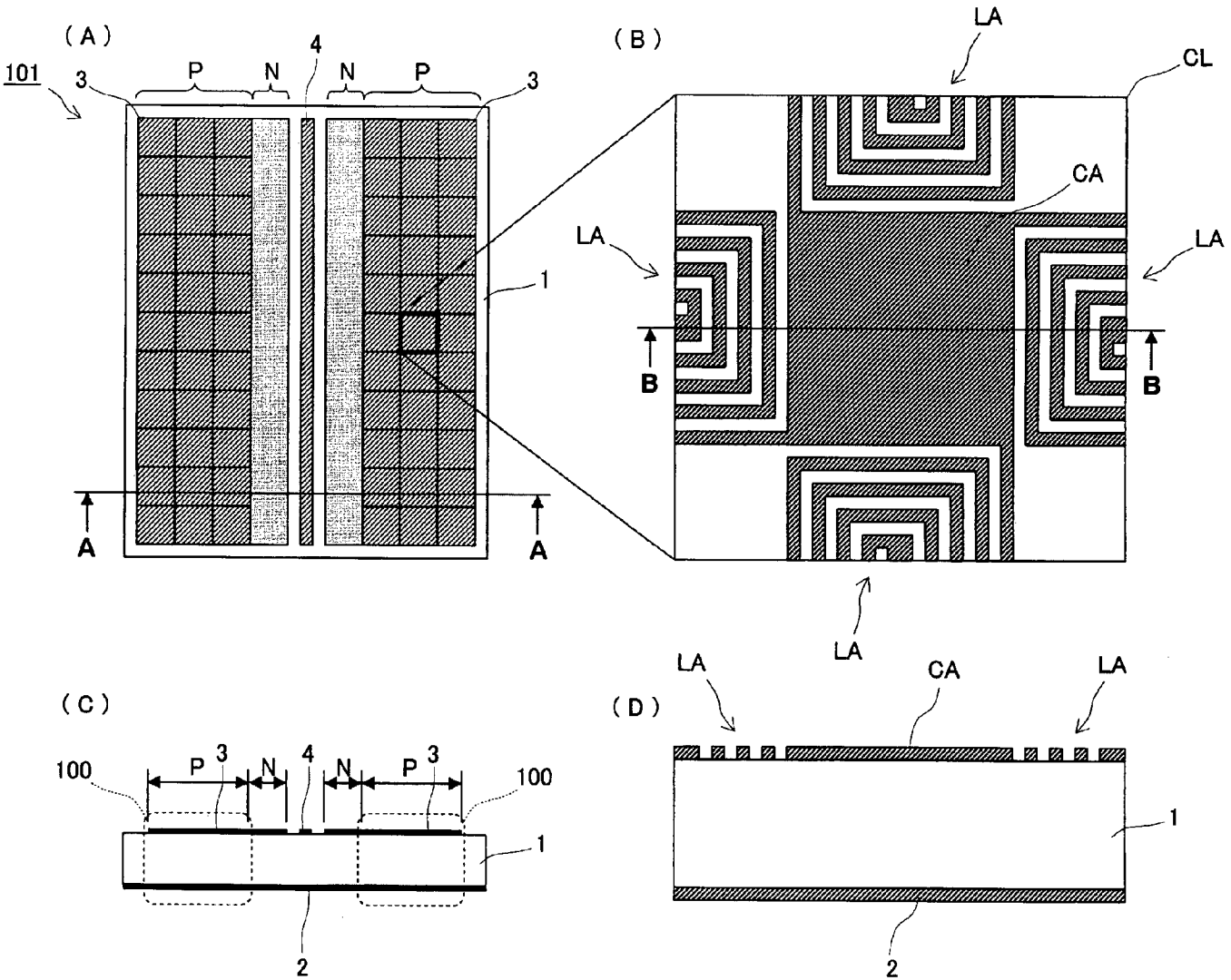
FIG. 5 illustrates the structure of the high-frequency circuit device.

FIG. 5 illustrates an example of application of the unit cell to a substrate comprising a waveguide. FIG. 5(A) is a plan view of the substrate. FIG. 5(B) is an enlarged view of the unit cell portion. FIG. 5(C) is a cross-sectional view taken along line A-A of FIG. 5(A). FIG. 5(D) is a cross-sectional view taken along line B-B of FIG. 5(B). A transmission line conductor 4 and patterned conductor films 3 are formed on the upper surface of the substrate. A ground conductor film 2 is formed on the substantially entire lower surface of the substrate 1. As shown in FIGS. 5(B) and 5(D), a plurality of unit cells is two-dimensionally disposed in a pattern formed region P of the patterned conductor film 3. In contrast, the unit cell CL is not formed in a pattern unformed region N, but a continuous ground conductor film is simply formed in the pattern unformed region N.

In this way, the patterned conductor film 3, the ground conductor film 2, and the substrate 1 form a planar circuit 100. In addition, the transmission line conductor 4, the patterned conductor films 3 (in particular, the pattern unformed regions N of the patterned conductor films 3) disposed on either side of the transmission line conductor 4, and the ground conductor film 2 disposed on the lower surface of the substrate 1 form a grounded coplanar transmission line.

As shown in FIG. 5(B), the unit cell CL includes the capacitive region CA at the center thereof and the inductive region LA in an area located near the middle of each side in the peripheral portion. As described below, the inductive region LA is part of a conductor pattern having a multiple spiral shape, which is formed together with the inductive region of the neighboring unit cell.

Figure 6:
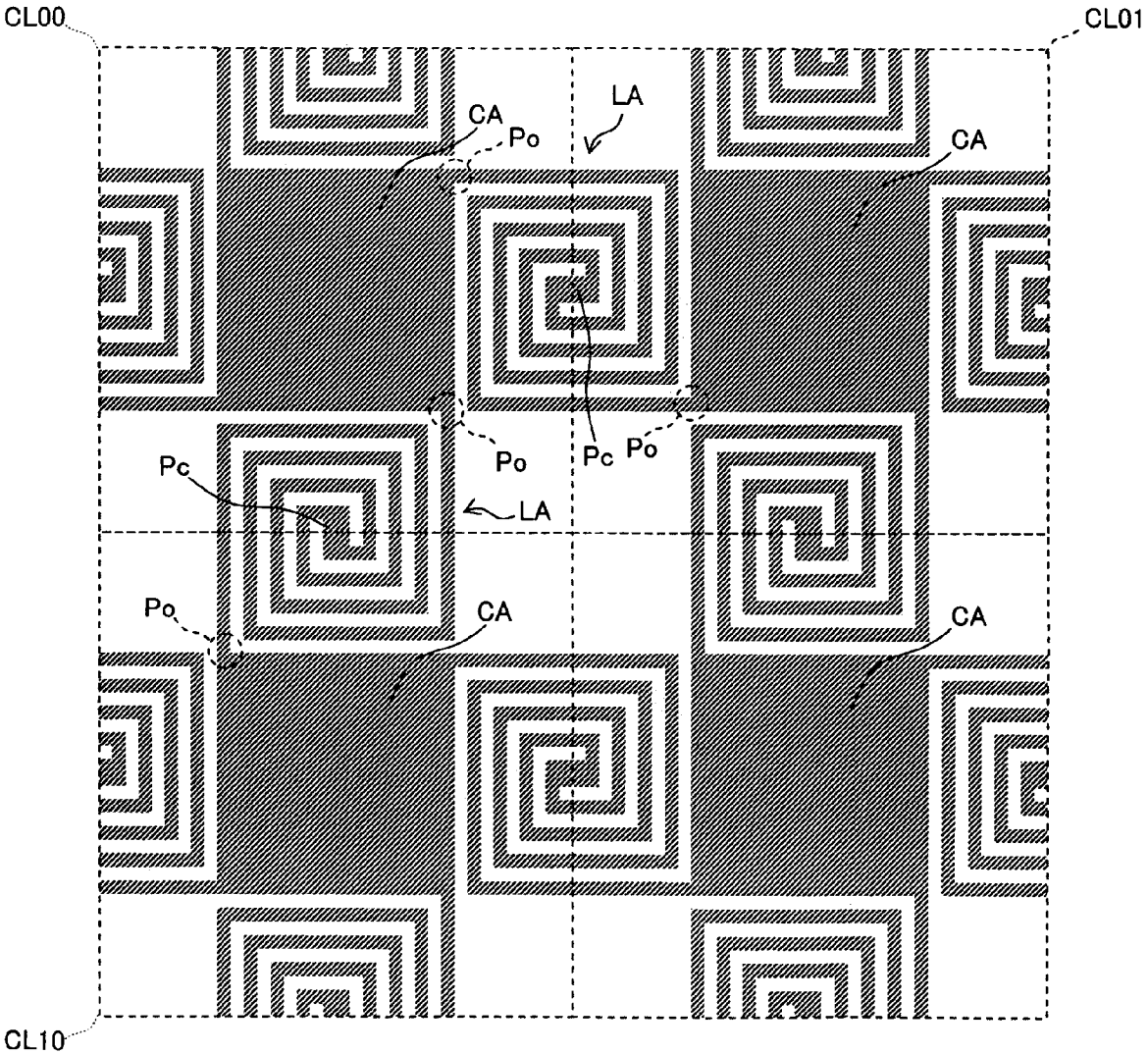
FIG. 6 illustrates an example of two-dimensional arrangement of a plurality of the unit cells.

FIG. 6 illustrates a positional relationship among a plurality of the unit cells. When looking at a unit cell CL00 and a unit cell CL01 located immediately right of the unit cell CL00 in FIG. 6, the center ends Pc of the inductive regions LA are connected to each other at a halfway portion between the two unit cells CL00 and CL01. Each of outer peripheral ends Po is connected to its capacitive region CA. The inductive region LA is formed so as to have a conductor pattern having a two-fold rotationally symmetric double spiral shape.

Similarly, when looking at the unit cell CL00 and a unit cell CL10 located immediately below the unit cell CL00, the center ends Pc of the inductive regions LA are connected to each other at a halfway portion between the two unit cells CL00 and CL10. Each of outer peripheral ends Po is connected to its capacitive region CA. As in the above-described example, the inductive region LA is formed so as to have a conductive pattern having a two-fold rotationally symmetric double spiral shape.

The positional relationship between any other two adjacent unit cells disposed in the longitudinal and transverse directions is similar to the above-described structure. By two-dimensionally arranging (tiling) the unit cells in this manner, the pattern formed region P of the patterned conductor film 3 shown in FIG. 5(A) is achieved.

Figure 7:
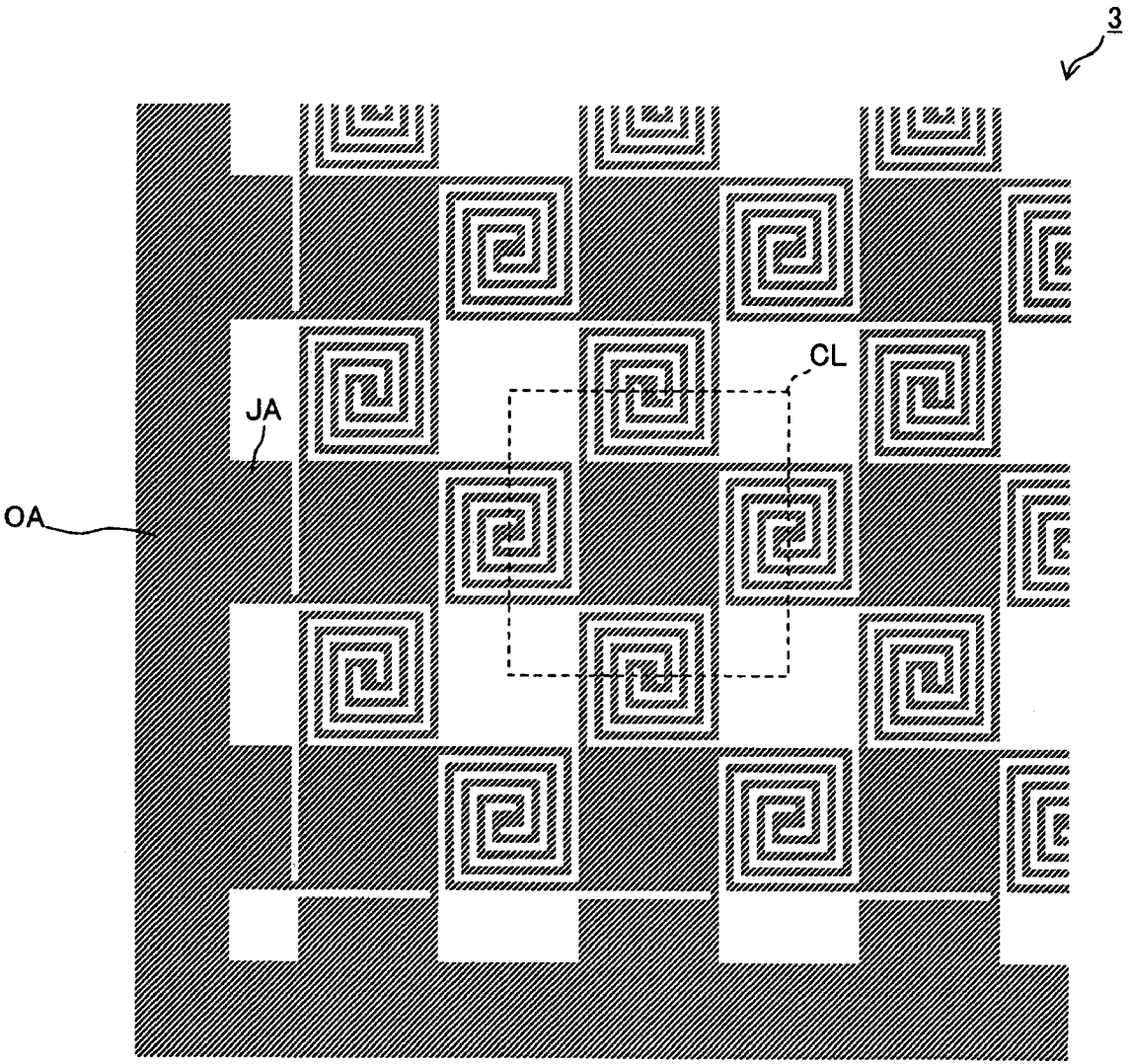
FIG. 7 illustrates an example of a pattern at the outer peripheral boundary of a patterned conductor film.

FIG. 7 illustrates an example of a pattern at the outer peripheral boundary of the patterned conductor film 3. At the outer peripheral boundary of the patterned conductor film 3, an area where an inductive region adjacent to the outer periphery cannot be formed in a unit cell in the vicinity of the outer periphery. In such a case, a peripheral region OA is formed so as to be a continuous ground conductor film. A relay region JA including a continuous internal conductor film without a multiple spiral-shaped conductor pattern is formed in a region that would otherwise be the inductive region.

Figure 8:
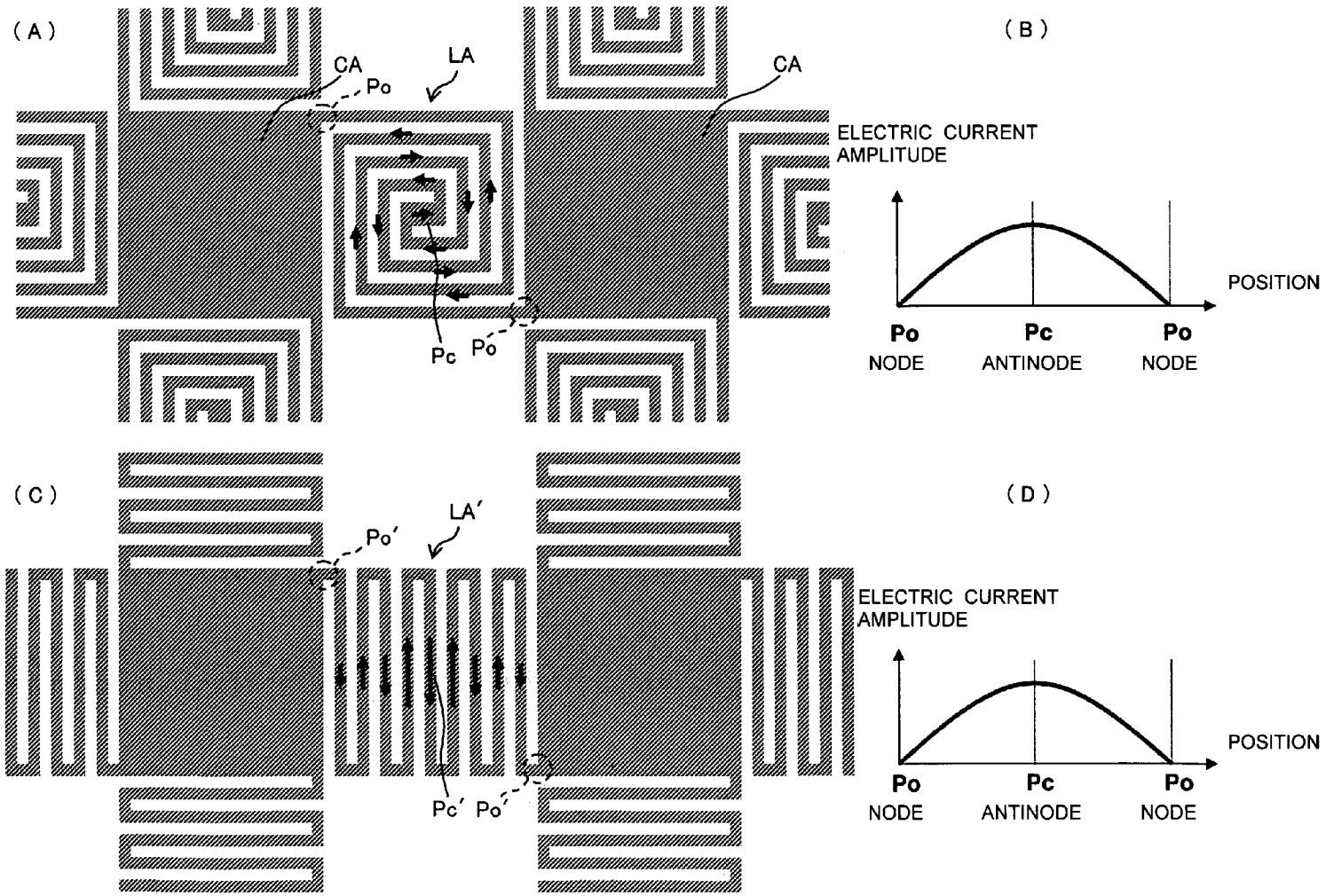
FIG. 8 illustrates an example of electrical current distribution at the frequency of a band gap.

FIG. 8 illustrates simplified electrical current vectors and the current intensity distributions in a band gap when the inductive region of two adjacent unit cells has a double spiral-shaped conductor pattern and when the inductive region of two adjacent unit cells has a meandering line shaped conductor pattern as described in Patent Document 1. The band gap induced by the planar circuit according to the first embodiment is described in more detail below.

When the inductive region of two adjacent unit cells has a double spiral-shaped conductor pattern, the electrical current vectors in the inductive region LA flow in a path starting from one of the outer peripheral ends Po to the center ends Pc, and to the other peripheral end Po, as shown in FIG. 8(A). The distribution of the amplitude of the electrical current in the inductive region LA has a node-antinode-node pattern in a path starting from one of the outer peripheral ends Po to the center ends Pc, and to the other outer peripheral end Po, as shown in FIG. 8(B).

However, the pattern is not always a sine wave due to the wiring capacitance between adjacent transmission lines. In this way, since all of the capacitive regions CA serve as the nodes of the electrical current, a blocking characteristic that prevents the propagation of the waves can be obtained.

In contrast, in FIG. 8(C), the shape of the inductive region LA shown in FIG. 8(A) is changed to a meandering line shape. Even in such a case, the electrical current vectors in the inductive region LA flow in a path starting from one of the outer peripheral ends Po' of the meandering line to the center ends Pc', and to the other outer peripheral end Po'. The distribution of the amplitude of the electrical current in an inductive region LA' has a node-antinode-node pattern in the path starting from one of the outer peripheral ends Po' of the meandering line to the center ends Pc', and to the other outer peripheral end Po', as shown in FIG. 8(D). As in the above-described case, the pattern is not always a sine wave due to the wiring capacitance between adjacent transmission lines.

In such a transmission line having a meandering line shape, since the directions of electrical currents flowing in the adjacent lines are opposite, the inductive energy is canceled out. Thus, the obtained inductance component is small while the obtained resistance component is large. In contrast, the inductive region LA having the spiral-shaped conductor pattern shown in FIG. 8(A), the inductive region LA can perform an operation with a high Q value. In a conductor pattern having a double spiral shape as shown in FIG. 8(A), the directions of electrical currents flowing in the adjacent lines are opposite. Accordingly, in order to obtain a high Q-value operation, a design that enables a reduction in the number of lines (the number of conductor lines appearing in a cross section passing through the center of a unit cell) is required.

In the above-described structure, the patterned conductor film 3 entirely becomes conductive for a direct current. Accordingly, application of a direct current voltage bias can be facilitated.

Analysis of the characteristics of the planar circuit according to the present invention is described with reference to FIGS. 9 to 15.

Figure 9:
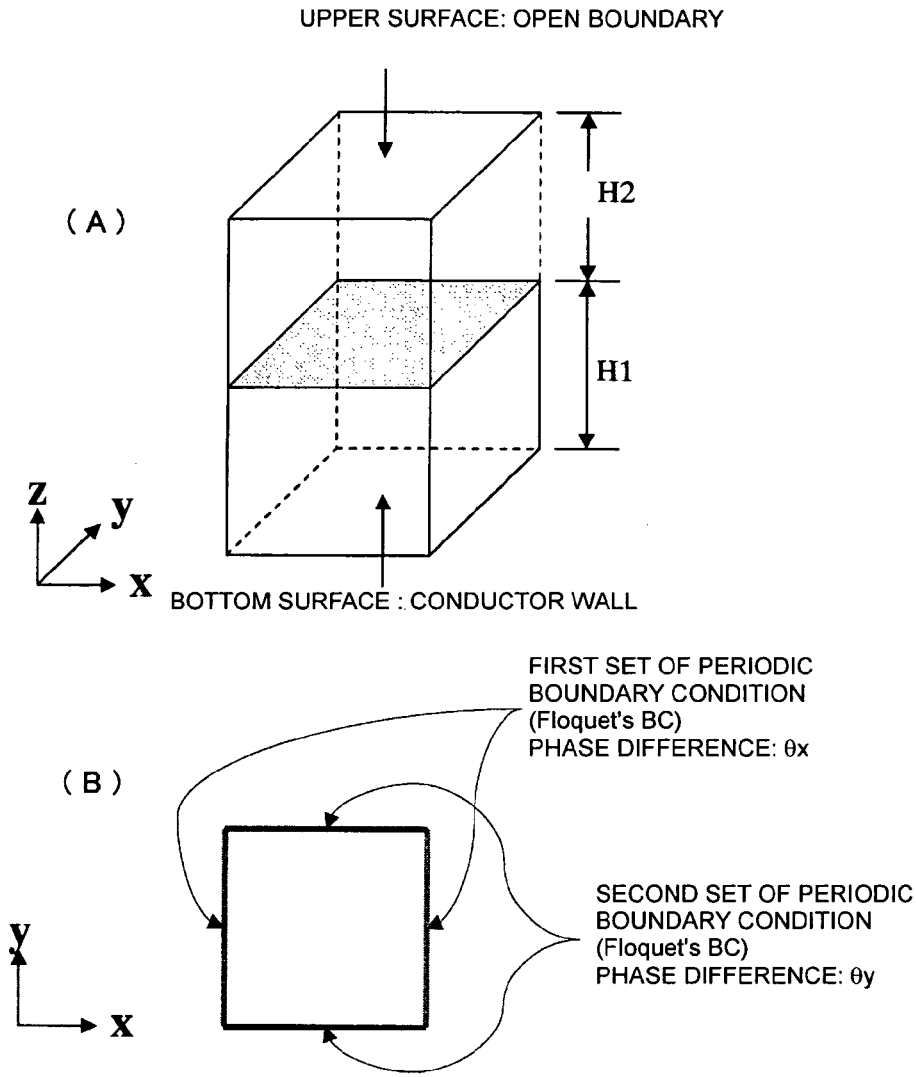
FIG. 9 illustrates an analysis model using a periodic boundary condition.
Figure 10:
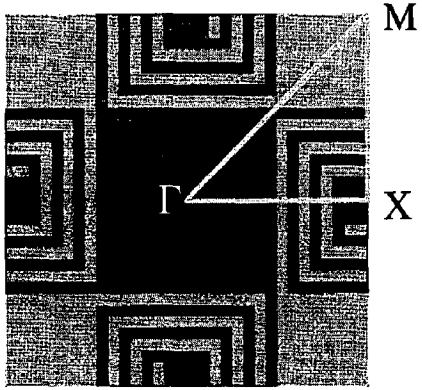
FIG. 10 illustrates an example of computation of the dispersion relation.
Figure 10:
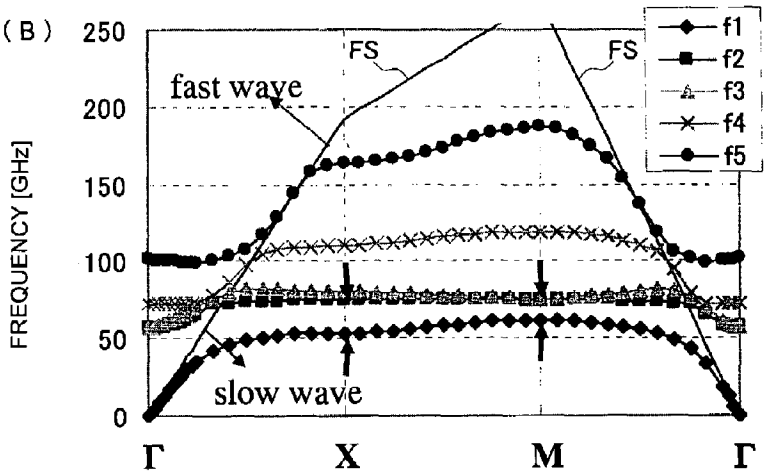
Figure 10:
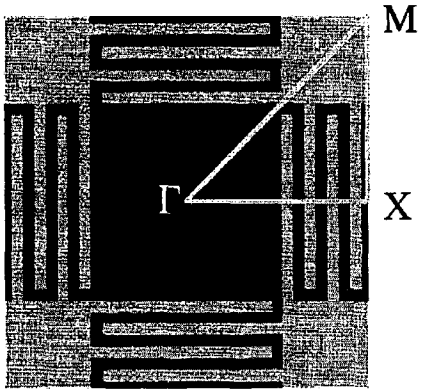
Figure 10:
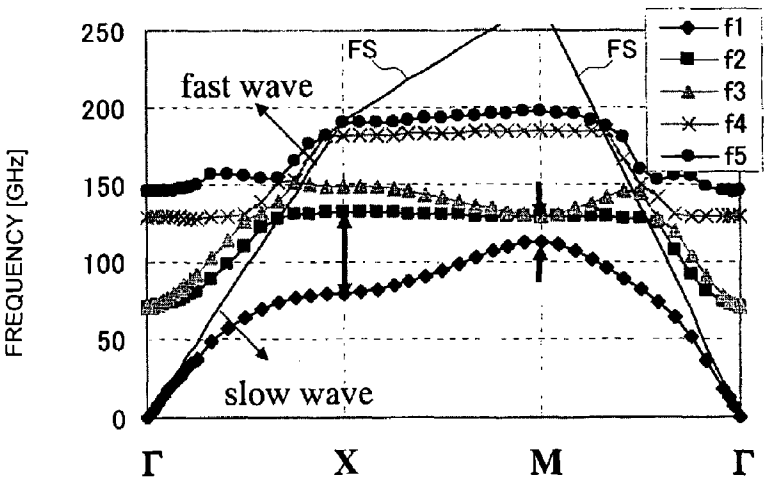

FIG. 9 illustrates an analysis model using a periodic boundary condition. FIG. 9(A) is a perspective view of the analysis model. FIG. 9(B) is a top view of the analysis model. In this embodiment, the analysis model has a bottom conductor wall and an open top boundary. The relative permittivity of a substrate portion H1 is 24, the relative permittivity of an upper space H2 is 1, and the electric conductivity of a conductor film on the upper surface of the substrate is 53 MS/m. The size of a unit cell is variable. Let θx denote the phase difference between the boundaries between unit cells in the x-axis direction and θy denote the phase difference between the boundaries between unit cells in the y-axis direction.

The analysis path and creation of a graph of a change in the frequency along the analysis path are described next with reference to FIG. 35.

FIG. 35(A) illustrates the analysis path. In the analysis path of this simulation, θy is fixed 0 first. Then, θx is increased from 0° to 180°, and θx is fixed to 180°. Thereafter, θy is increased from 0° to 180°. Subsequently, θx and θy are decreased. Finally, θx and θy return to the original values. An angle Ka denotes a value monotonically increased in accordance with the increase and decrease in θx and θy.

In FIG. 35(B), Γ denotes a point at which (θx, θy)=(0°, 0°). X denotes a point at which (θx, θy)=(180°, 0°). M denotes a point at which (θx, θy)=(180°, 180°).

FIG. 35(C) illustrates an example of a change in the frequency along the analysis path when the size (the length of a side) of the cell A=208 μm and the relative permittivity ∈r=24. For convenience of creation of a graph, the abscissa represents Ka.

In an example shown in FIG. 10(A), H1=0.3 mm and H2=0.3 mm. The unit cell has sides of 160 μm. The linewidth/spacewidth in the inductive region is 5 μm/5 μm. In the drawing, the analysis path Γ-X-M-Γ is shown. FIG. 10(B) illustrates the dispersion relation where the abscissa represents the analysis path Γ-X-M-Γ and the ordinate represents the frequency. A mountain-shaped solid curve FS in the drawing corresponds to that shown in FIG. 35(C). A slow wave appears inside the curve FS. A fast wave appears outside the curve FS. The term "slow" and "fast" refer to a slow phase velocity and a fast phase velocity of a wave propagating in a free medium of the substrate relative permittivity, respectively. The slow wave is a wave of electrical power propagating in a pattern plane (i.e., a guided wave). In contrast, the fast wave is a wave that has a wavenumber vector in a direction perpendicular to the pattern plane and resonates in the radiation direction or the thickness direction (i.e., leakey wave). In a slow wave region, this structure operates with a band gap (a forbidden band).

Here, the characteristics at the points X and M are as follows:

X point characteristics forbidden band (f1-f2): 53.5-76.0 GHz (Δ 22.5 GHz)

relative bandwidth (f1-f2): 34.6%

M point characteristics forbidden band (f1-f2): 61.7-75.9 GHz (Δ 14.2 GHz)

relative bandwidth (f1-f2): 20.5%.

As shown by a portion sandwiched by two arrows at each of the X point and the M point in FIG. 10(B), a band gap appears between a mode f1 that becomes a slow wave in the entire path Γ-X-M-Γ and a mode f2 having a frequency higher that that of the mode f1.

FIGS. 10(C) and 10(D) illustrate examples of the analysis path and creation of a graph of a change in the frequency along the analysis path when the inductive region is composed of a meandering line pattern. FIGS. 10(C) and 10(D) correspond to FIGS. 10(A) and 10(B), respectively. The linewidth/spacewidth in the inductive region is 5 μm/5 μm. In addition, the other conditions are the same as those in FIG. 10(A). FIG. 10(D) represents the dispersion relation.

Here, the characteristics at the points X and M are as follows:

X point characteristics forbidden band (f1-f2): 79.8-131.7 GHz (Δ 51.9 GHz)

relative bandwidth (f1-f2): 49.1%

M point characteristics forbidden band (f1-f2): 113.1-128.9 GHz (Δ 15.8 GHz)

relative bandwidth (f1-f2): 13.1%.

As can be seen from comparison with FIG. 10(B), the band gap is increased at the X point. In contrast, the band gap is decreased so that a bottleneck shape is formed at the M point. In addition, the flatness of the first mode f1 and a third mode f3 deteriorates in the slow wave area. This is because the waves in the first mode f1 tend to propagate in a direction at an angle of about 45° due to the dispersion relation of the first mode f1 in the case where the waves are excited at a frequency of 110 GHz.

A design example of the number of lines of an inductive region for causing a band gap at a predetermined frequency is described next with reference to FIGS. 11 to 13.

Figure 11:
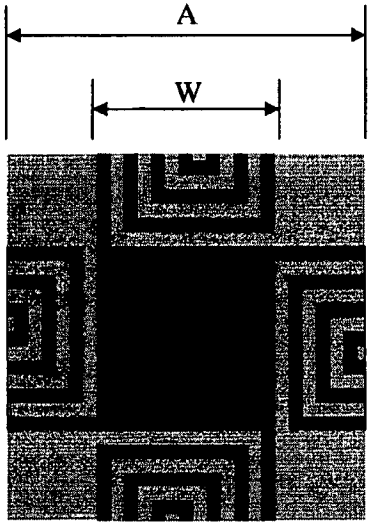
FIG. 11 illustrates an analysis result at an M point when the number of lines n of a conductor pattern in an inductive region is set to 6.
Figure 11:
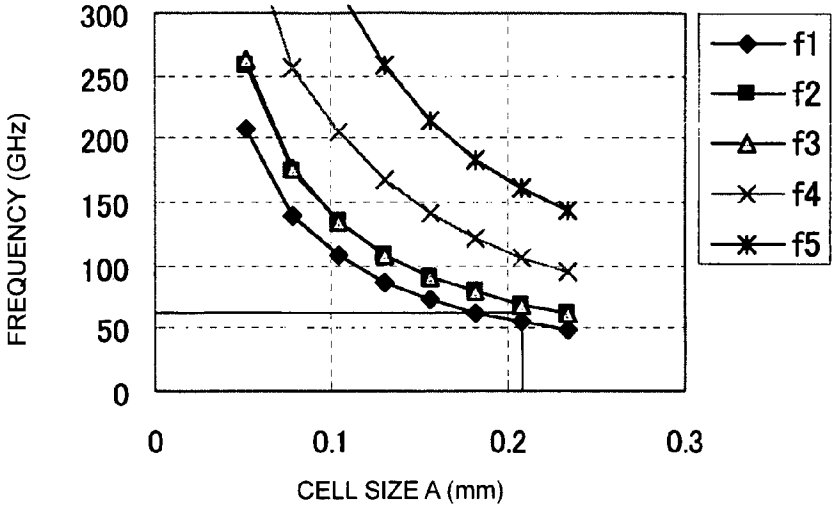

FIG. 11 illustrates an example when the number of lines n of an inductive region is 6. Let A denote the length of a side of a unit cell (i.e., cell size), W denote the width of the capacitive region and the inductive region, L denote the line width of the inductive region, and S denote a space width. Then, FIG. 11 illustrates a change in frequency of each of the five modes f1 to f5 in accordance with a change in the cell size A. In this example, the thickness of the substrate H1 is 0.3 mm and the thickness of the upper space H2 is 0.3 mm, which are constant values. With the cell size A being changed while maintaining the number of lines n constant, W, L, and S are changed. FIG. 11(C) illustrates an example in which the cell size A is changed between 0.052 mm and 0.234 mm.

As described above, the frequencies of the first mode f1 and the second mode f2 are changed in accordance with a change in the cell size A. In order to set a frequency of a band gap generated between the two modes to 60 GHz, the design indicated by No. 7 in FIG. 11(C) can be employed. According to the conditions of the design No. 7, the frequency of the first mode f1 is 54.2 GHz and the frequency of the second mode f2 is 68.5 GHz. Accordingly, a band gap is generated between the frequencies of 54.2 GHz and 68.5 GHz. That is, the propagation of the spurious mode of 60 GHz, which is the use frequency, is blocked by the band gap.

Figure 12:
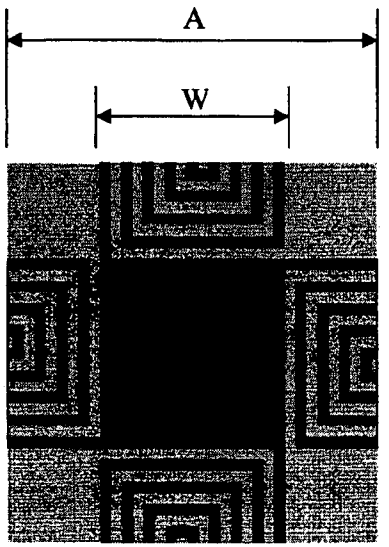
FIG. 12 illustrates an analysis result at the M point when the number of lines n of the conductor pattern in the inductive region is set to 8.
Figure 12:
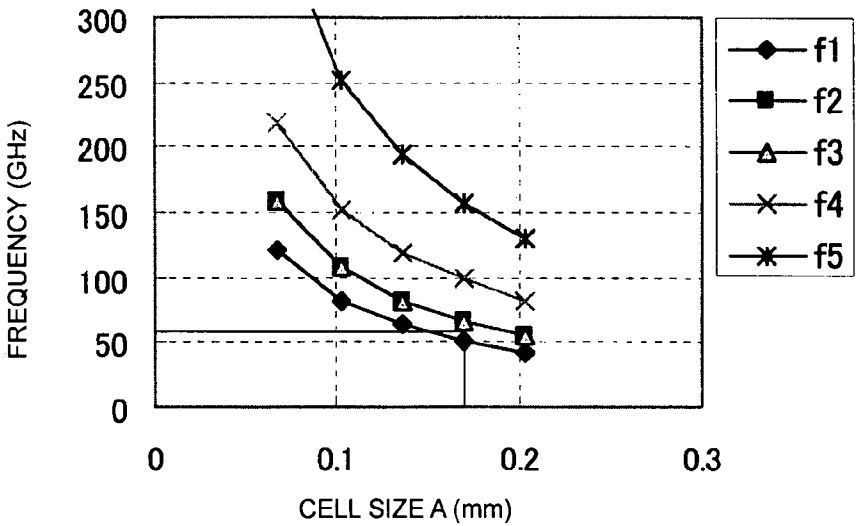

FIG. 12 illustrates an example when the number of lines n in an inductive region is 8. In this case, in order to set a frequency of a band gap generated between the first mode f1 and the second mode f2 to 60 GHz, the unit cell indicated by the design No. 4 can be employed.

Figure 13:
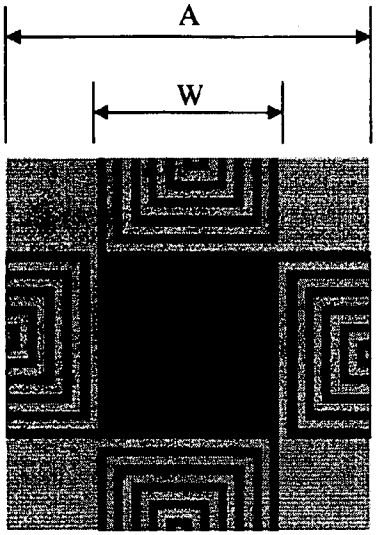
FIG. 13 illustrates an analysis result at the M point when the number of lines n of the conductor pattern in the inductive region is set to 10.
Figure 13:
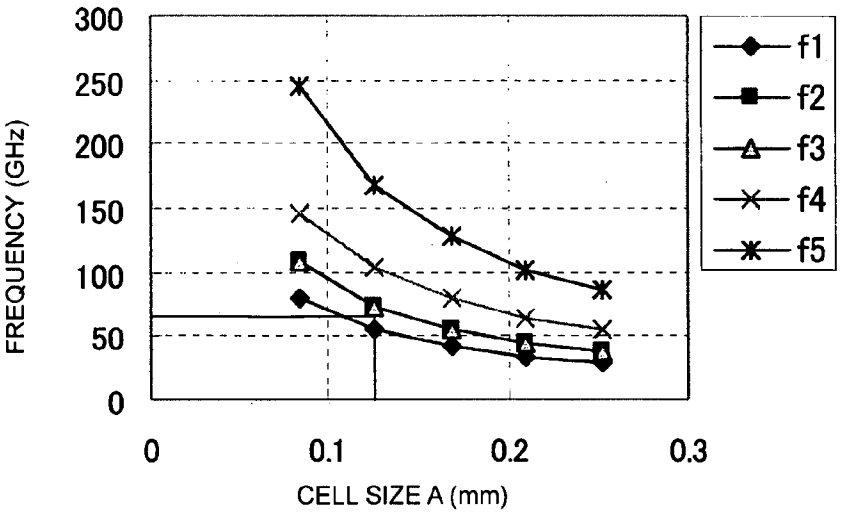

FIG. 13 illustrates an example when the number of lines n of the inductive region is 10. In this case, in order to set a frequency of a band gap generated between the first mode f1 and the second mode f2 to 60 GHz, the unit cell indicated by the design No. 2 can be employed.

Figure 14:
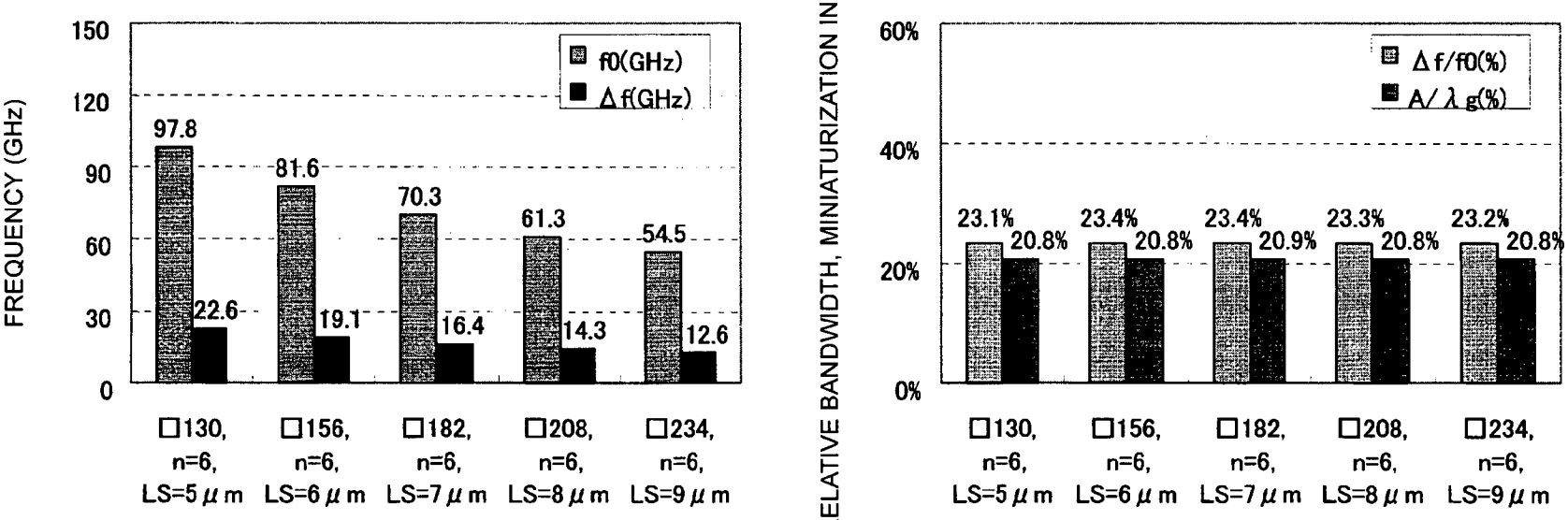
FIG. 14 illustrates the dependency on the line width of the inductive region.

The dependencies of the line width and the number of lines of the inductive region are described with reference to FIGS. 14 and 15.

FIG. 14(A) illustrates a frequency fo of a band gap and a frequency width Δf of the band gap when the number of lines n of the inductive region is 6 and the linewidth L/spacewidth S is changed from 5 μm/5 μm to 9 μm/9 μm. FIG. 14(B) illustrates a relative bandwidth Δf/fo and a miniaturization index A/λg, where λg is the wavelength in the substrate. The condition of the periodic boundary analysis was the wavenumber×cell constant=(180°, 180°). That is, the condition indicates the M point.

In addition, in accordance with an increase in the linewidth L/spacewidth S, the cell size A was increased. For example, when the linewidth L/spacewidth S was 5 μm/5 μm, the cell size A was set to 130 μm. When the linewidth L/spacewidth S was 9 μm/9 μm, the cell size A was set to 234 μm. Let fo denote the average frequency of the first mode and the second mode (when f1 represents the frequency of the first mode and f2 represents the frequency of the second mode, fo=(f1+f2)/2). Then, as the cell size A was increased, the average frequency fo decreased. In each of the models, the relative bandwidth Δf/fo was about 23%, and the miniaturization index A/λg was about 21%.

Figure 15:
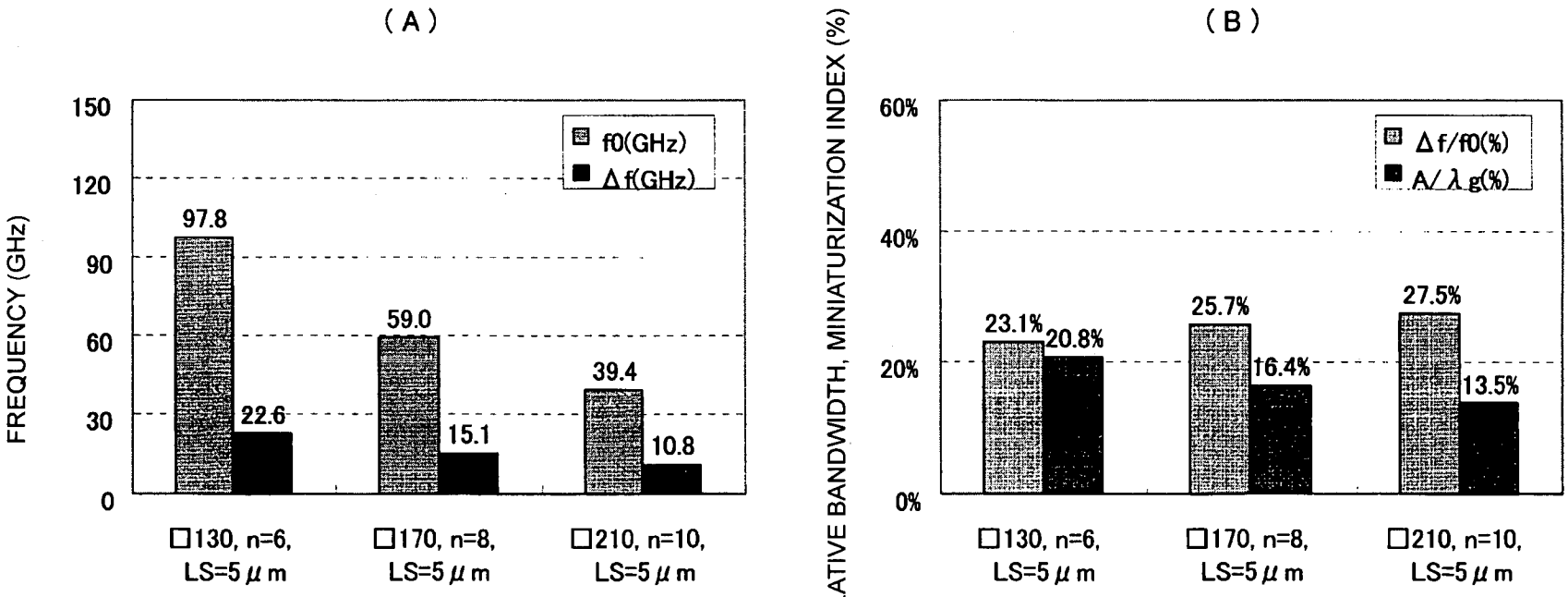
FIG. 15 illustrates the dependency on the number of lines of the inductive region.

FIG. 15 illustrates an example in which the linewidth L/spacewidth S in the inductive region was set to a constant value of 5 μm/5 μm, and the number of lines n was changed to 6, 8, or 10. In accordance with the increase in the number of lines n, the cell size A was increased. For example, when the number of lines n was 6, the cell size A was set to 130 μm. When the number of lines n was 10, the cell size A was set to 210 μm. As the cell size A was increased, the average frequency fo of the first mode and the second mode decreased. In addition, the relative bandwidth Δf/fo monotonically increased, and the miniaturization index A/λg monotonically decreased. Accordingly, by increasing the number of lines, a wide relative bandwidth can be obtained. By decreasing the number of lines, the size can be reduced.

The concept for designing a band gap obtained through analysis of a one-dimensional equivalent circuit is described next with reference to FIGS. 36 and 37.

Figure 36:
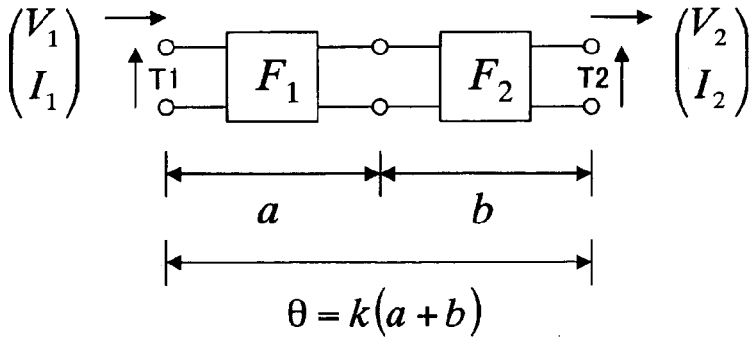
FIG. 36 illustrates the configuration of a one-dimensional equivalent circuit having a periodic boundary condition.

FIG. 36 illustrates a circuit including the capacitive region and the inductive region. This circuit is a one-dimensional equivalent circuit having a periodic boundary condition. Connection matrices of two circuits F1 and F2 shown in FIG. 36 are expressed as follows.

(1) Connection Matrices $$F_1 = \begin{pmatrix} A_1 & B_1 \\ C_1 & D_1 \end{pmatrix}, F_2 = \begin{pmatrix} A_2 & B_2 \\ C_2 & D_2 \end{pmatrix} \quad (1)$$

Since the voltages and the electrical currents of a terminal T1 and a terminal T2 satisfy the periodic boundary condition, the following relationship can be satisfied using the two connection matrices:

(2) Periodic Boundary Condition $$\begin{pmatrix} V_1 \\ I_1 \end{pmatrix} = F_1 F_2 \begin{pmatrix} V_2 \\ I_2 \end{pmatrix} = e^{j\theta} \begin{pmatrix} V_2 \\ I_2 \end{pmatrix} \quad (2)$$

where θ (rad) represents a phase difference. θ can be expressed by the following equation (3) using the wavenumber k (rad/m) and sizes a (m) and b (m).

(3) Phase Difference $$\theta = k(a+b) \quad (3)$$

To obtain non-zero voltage and the electrical current solution of equation (2), the following eigenvalue equation needs to be satisfied:

(4) Eigenvalue Equation (Dispersion Relation)

$$\det(F_1 F_2 - e^{j\theta} E) = 0 \quad (4)$$

$$\cos\theta = \frac{1}{2}(A_1 A_2 + D_1 D_2 + B_1 C_2 + C_1 B_2)$$

The left-hand side of equation (4) is a function of a wavenumber vector (k). The right-hand side of equation (4) is a function of a frequency (ω). That is, equation (4) represents the dispersion relation.

In the case where the absolute value of the right-hand side of equation (4) is less than or equal to 1, the phase difference (θ) has a real root. In this case, the wavenumber vector (k) is a real number, which indicates propagation. In contrast, in the case where the absolute value of the right-hand side of equation (4) is greater than 1, the wavenumber vector (k) is an imaginary number, which indicates a cut-off state. That is, the frequency range that satisfies such a condition becomes the forbidden band (band gap).

The case where the two circuits included in the one-dimensional equivalent circuit shown in FIG. 36 are distributed constant transmission lines is discussed. The distributed constant transmission lines are expressed using characteristic impedance (Z) and a propagation constant (γ) as follows:

(5) Connection Matrix of Distributed Constant Transmission Line $$F_1 = \begin{pmatrix} \cosh\gamma_1 a & Z_1 \sinh\gamma_3 a \\ \frac{1}{Z_1}\sinh\gamma_1 a & \cosh\gamma_1 a \end{pmatrix}, F_2 = \begin{pmatrix} \cosh\gamma_2 b & Z_2 \sinh\gamma_2 b \\ \frac{1}{Z_2}\sinh\gamma_2 b & \cosh\gamma_2 b \end{pmatrix} \quad (5)$$

By substituting equation (5) into equation (4), the dispersion relation is obtained as follows:

(6) Dispersion Relation of Distributed Constant Transmission Line According to Periodic Boundary Condition $$\cos(k(a+b)) = \cosh\gamma_1 a \cdot \cosh\gamma_2 b + \frac{1}{2}\left(\frac{Z_1}{Z_2} + \frac{Z_2}{Z_1}\right) \cdot \sinh\gamma_1 a \cdot \sinh\gamma_2 b \quad (6)$$

To increase the forbidden band (band gap), the absolute value of the right-hand side is set to be larger than 1 by as large an amount as possible. The case where the propagation constant (γ) of the distributed constant transmission line is a phase constant (jβ) is discussed. As can be seen, a factor that increases the right-hand side to a value greater than 1 under such a condition is a factor computed using an impedance ratio indicated in the following equation (7):

$$F_Z = \frac{1}{2}\left(\frac{Z_1}{Z_2} + \frac{Z_2}{Z_1}\right) \quad (7)$$

Figure 37:
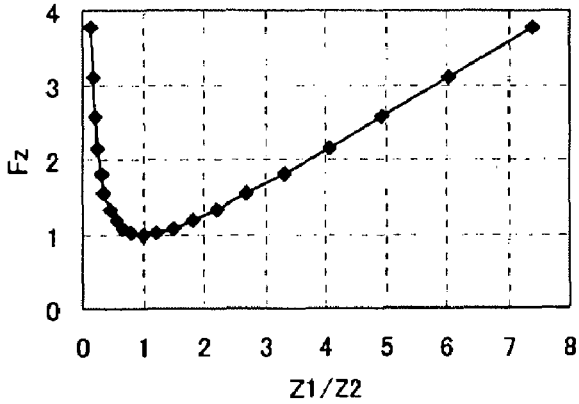
FIG. 37 illustrates a relationship between the connection matrix of a distributed constant transmission line and an impedance ratio in the one-dimensional equivalent circuit.

FIG. 37 is a graph of Fz in which the abscissa represents the impedance ratio Z1/Z2.

As can be seen from the graph, Fz has a minimum value of 1 when the impedance ratio is 1.

To increase the forbidden band (band gap), Fz needs to be a larger value as many as possible. Accordingly, for the transmission line condition, a ratio of the impedance of the high-impedance transmission line to the impedance of the low-impedance transmission line needs to be high.

This understanding of the analysis of the one-dimensional equivalent circuit can be applied to the circuit design of a two-dimensional circuit.

Second Embodiment

Figure 16:
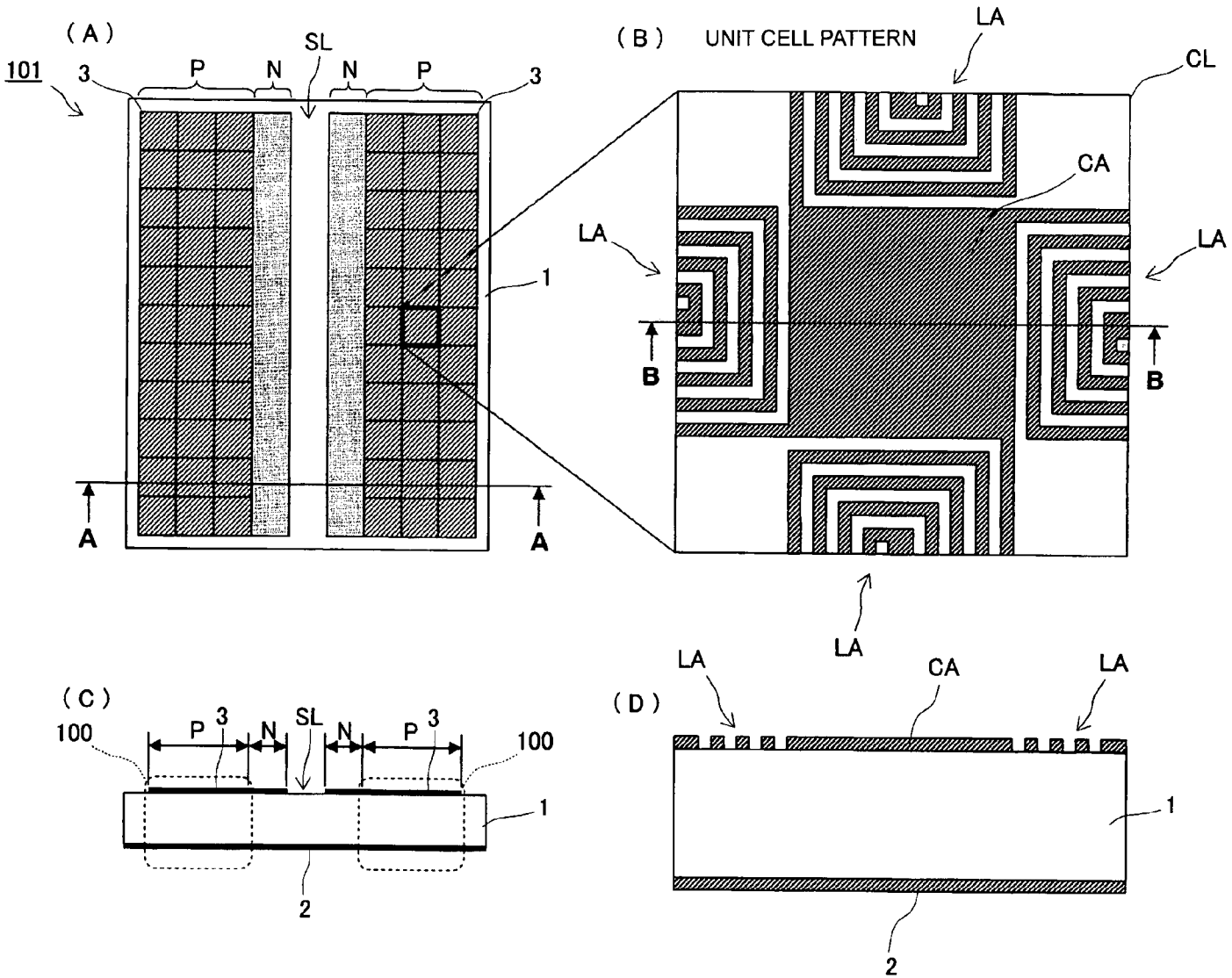
FIG. 16 illustrates the structures of a planar circuit and a high-frequency circuit device according to a second embodiment.

A planar circuit and a high frequency circuit device according to a second embodiment are described next with reference to FIG. 16.

While the first embodiment has been described with reference to the example in which the ground conductor films on either side of the transmission line conductor of the grounded coplanar transmission line are patterned conductor films, the second embodiment has a grounded slot line serving as a waveguide. FIG. 16(A) is a top view of the planar circuit. FIG. 16(B) is an enlarged view of a unit cell of the planar circuit. FIG. 16(C) is a cross-sectional view taken along line A-A of FIG. 16(A). FIG. 16(D) is a cross-sectional view taken along line B-B of FIG. 16(B). Patterned conductor films 3 are formed on the upper surface of a substrate 1. In addition, a slot SL is formed on the upper surface of the substrate 1. A ground conductor film 2 is formed on the substantially entire lower surface of the substrate 1. As shown in FIGS. 16(B) and 16(D), a plurality of unit cells are two-dimensionally disposed in pattern formed regions P of the patterned conductor films 3. The unit cell CL is similar to that described in the first embodiment. In contrast, the unit cell CL is not formed in a pattern unformed region N, but a continuous ground conductor film is simply formed in the pattern unformed region N.

In this way, the slot SL, the patterned conductor films 3 located on either side of the slot SL (in particular, the pattern unformed regions N of the patterned conductor films 3), and the ground conductor film 2 on the lower surface of the substrate 1 form a grounded slot line. Like the first embodiment, such a slot line can prevent propagation of a spurious mode, such as a parallel plate mode, in the substrate 1.

Third Embodiment

A planar circuit and a high frequency circuit device according to a third embodiment are described next with reference to FIGS. 17 to 25.

FIG. 17(A) is a top view of the planar circuit. FIG. 17(B) is an enlarged view of a unit cell of the planar circuit. FIG. 17(C) is a cross-sectional view taken along line A-A of FIG. 17(A). FIG. 17(D) is a cross-sectional view taken along line B-B of FIG. 17(B). Patterned conductor films 3 are formed on the upper surface of a substrate 1. In addition, a slot SL is formed on the upper surface of the substrate 1. Patterned conductor films 5 are formed on the lower surface of the substrate 1. In addition, a slot is formed on the lower surface of the substrate 1. As shown in FIGS. 17(B) and 17(D), a plurality of unit cells are two-dimensionally disposed in pattern formed regions P of the patterned conductor films 3 and 5. The unit cell CL is similar to that described in the first and second embodiments. The pattern of a capacitive region CA and the inductive region LA of the unit cell formed in the patterned conductor film 5 on the lower surface and the pattern on the upper surface have plane symmetry. When viewed from the upper surface or the lower surface, the patterns of the capacitive regions CA on the upper and lower surfaces overlap. Similarly, the patterns of the inductive regions LA on the upper and lower surfaces overlap. In contrast, the unit cell CL is not formed in a pattern unformed region N, but a continuous ground conductor film is simply formed in the pattern unformed region N. In this way, a two-sided slot transmission line or a planar dielectric transmission line (PDTL) is formed.

It is ideal that the patterns of the capacitive regions CA on the upper and lower surfaces overlap and the patterns of the inductive regions LA on the upper and lower surfaces overlap when the substrate 1 is viewed from the upper surface or the lower surface. However, the directions of rotation of the spirals may be reversed. In addition, even if the patterns are slightly offset when perspectively viewed, the characteristics are not significantly degraded.

Figure 18:
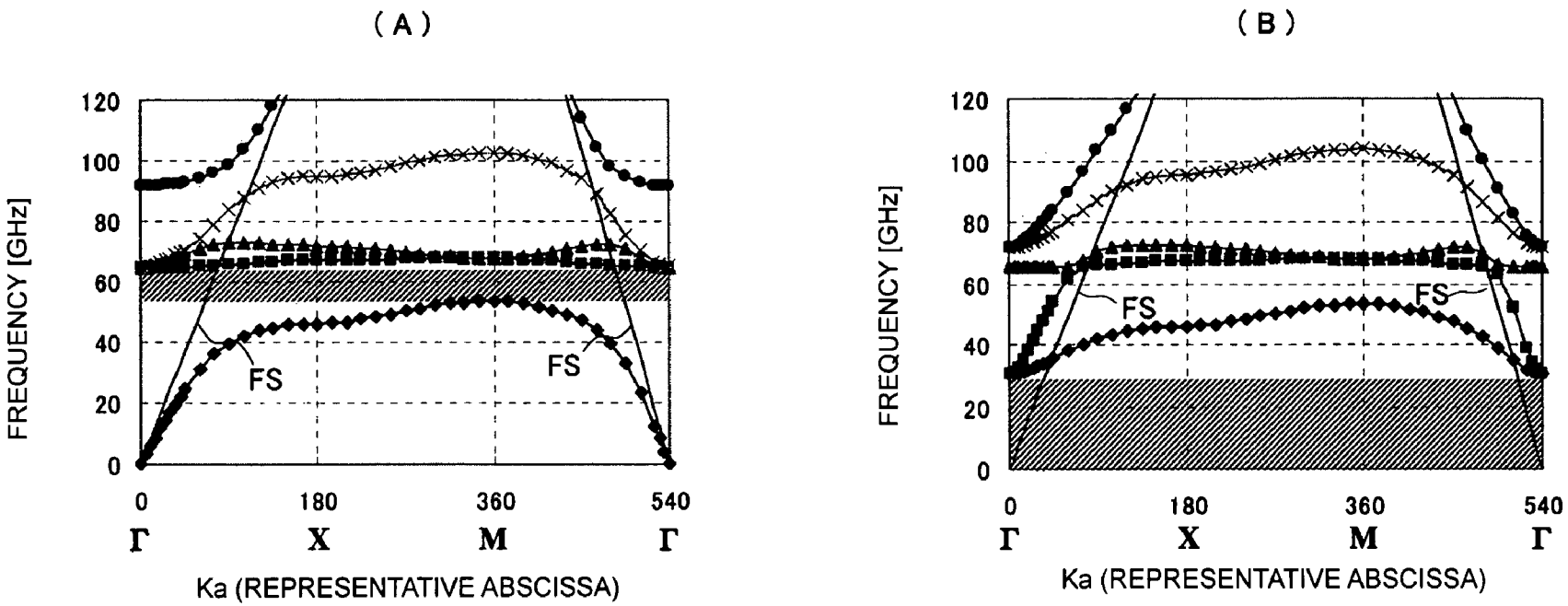
FIG. 18 illustrates a difference in characteristics between a two-sided electrode forming model and a one-sided electrode forming model.

FIG. 18 illustrates a difference in characteristics between the planar circuit including a substrate having patterned conductor films on either side thereof and the planar circuit including a substrate having a patterned conductor film on only one side thereof. The dimensions of parts of a unit cell are as follows:

cell size: A=208 μm
number of lines n: 6
linewidth L/spacewidth S: 8 μm/8 μm
width of the capacitive region W: 104 μm
thickness of the substrate H1: 300 μm
vertical space H2: 300 μm.

Figure 17:
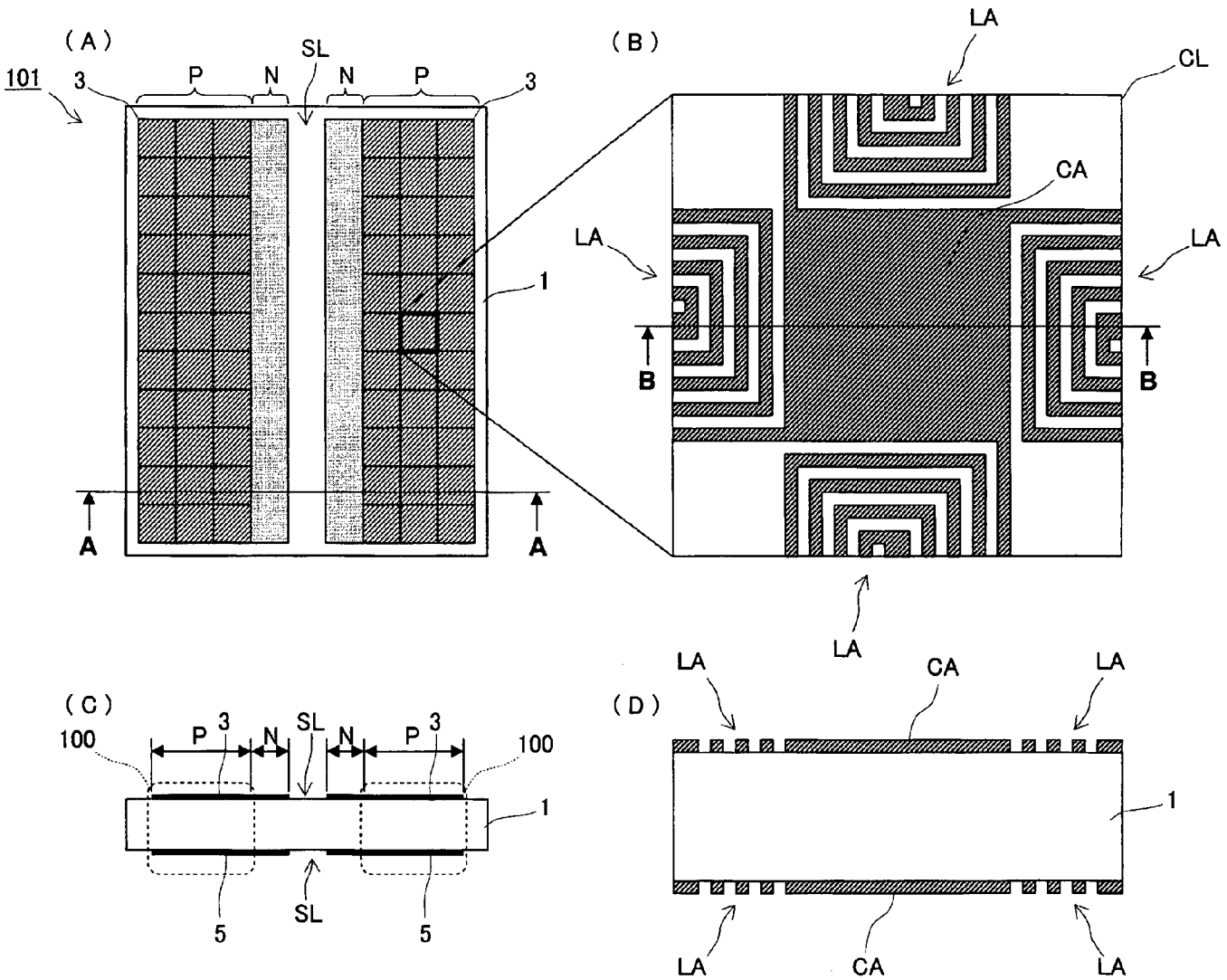
FIG. 17 illustrates the structures of a planar circuit and a high-frequency circuit device according to a third embodiment.

FIG. 18(A) illustrates the dispersion relation of a two-sided electrode formed model. FIG. 18(B) illustrates the dispersion relation of a one-sided electrode formed model. As shown in FIG. 18(A), in the two-sided electrode formed model, a band gap appears at about 60 GHz. In contrast, as shown in FIG. 18(B), in the one-sided electrode formed model, a band gap appears between a direct current level and about 30 GHz. However, the dispersion relation is present in a fast wave area (outside the line FS) at about 60 GHz. This indicates that the waves are irradiated from an antenna or are reflected by a shield case since the wavelength is long. Accordingly, in order to block the propagation of a spurious mode under such a condition, a two-sided slot transmission line or a planar dielectric transmission line (PDTL) needs to be formed by forming the patterned conductor films 3 and 5 on either surface of the substrate 1, as shown in FIG. 17.

Figure 19:
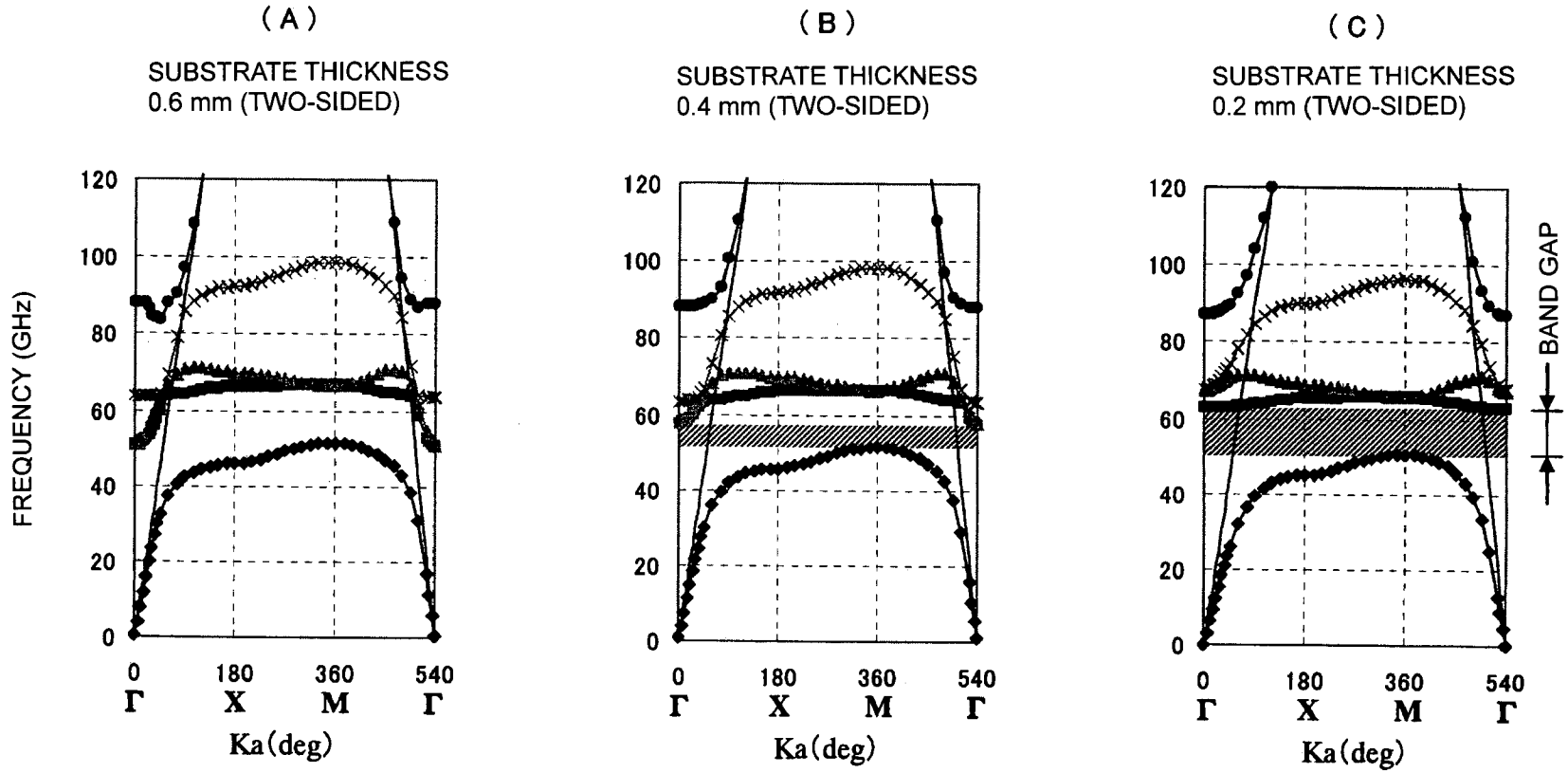
FIG. 19 illustrates the dependency on the thickness of a substrate.

FIG. 19 illustrates the dependency on the thickness of a substrate. FIG. 19(A) illustrates the case in which the thickness of the substrate is 0.6 mm. FIG. 19(B) illustrates the case in which the thickness of the substrate is 0.4 mm. FIG. 19(C) illustrates the case in which the thickness of the substrate is 0.2 mm. In FIG. 19, the representative abscissa Ka is taken.

The dimensions of parts of a unit cell except for the thickness of the substrate are as follows:

cell size: A=170 μm
number of lines n: 8
linewidth L/spacewidth S: 5 μm/5 μm
width of the capacitive region W: 85 μm
vertical space H2: 300 μm.

As shown in FIG. 19, in the case where the thickness of the substrate is 0.6 mm, a band gap is not generated. As the thickness of the substrate is decreased, a wider band gap can be obtained. In addition, the characteristic of the model having a non-patterned ground conductor film on one side is identical to that of a two-sided model having a substrate of a half thickness. For example, FIGS. 19(A), 19(B), and 19(C) show the thickness dependencies of one-sided models having thicknesses of 0.3 mm, 0.2 mm, and 0.1 mm, respectively. Accordingly, by patterning ground conductor films on either surface of the substrate and reducing the thickness of the substrate, a wide band gap can be obtained.

Examples of the analysis of the planar circuit according to the present invention using a four-port S parameter are described next with reference to FIGS. 20 to 25.

FIG. 20(A) is a perspective view of an analysis model. FIG. 20(B) is a top view of the analysis model. FIG. 20(C) is a front view of the analysis model. As shown in FIG. 20(B), the four sides of a unit cell are defined as ports 1 to 4. In an S-parameter analysis, a mode at a port needs to be a mode including a component of a parallel plate mode. As shown in FIG. 20(C), the parallel plate mode has an electric field component inside the substrate in the thickness direction (the z direction) and a magnetic field component H inside the substrate in the transverse direction (the x or y direction).

Figure 21:
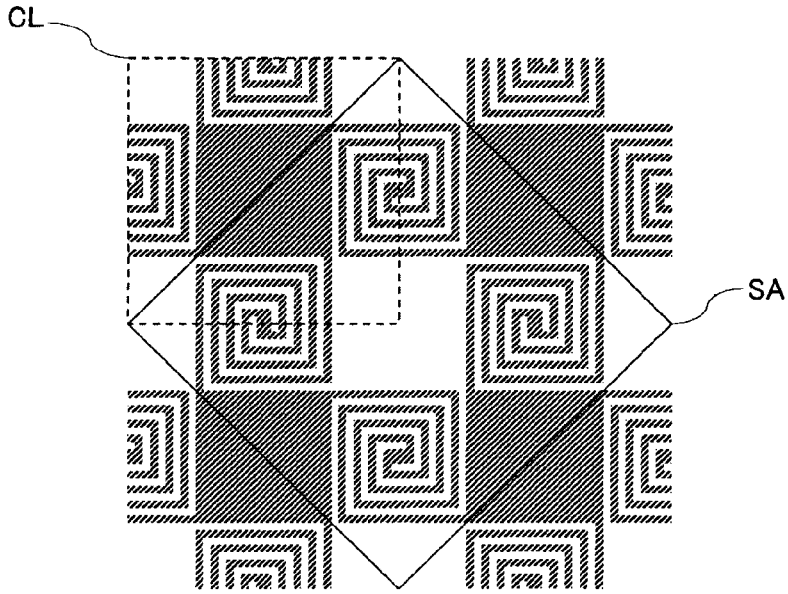
FIG. 21 illustrates an example of how an analysis area is defined.

FIG. 21 illustrates an example of how the analysis area is defined. In this example, an S parameter having four ports indicated by "SA" (a square having dimensions twice those of the unit cell CL) is computed. If the four sides of the unit cell CL are defined as four ports, the model becomes a multi-conductor port which has microelectrodes in the cross section. Thus, the model cannot be excited in a mode such as that of a micro-strip line.

FIGS. 22 to 25 illustrate examples of S parameters and the dispersion relation when the number of lines n of the inductive region is changed.

Figure 22:
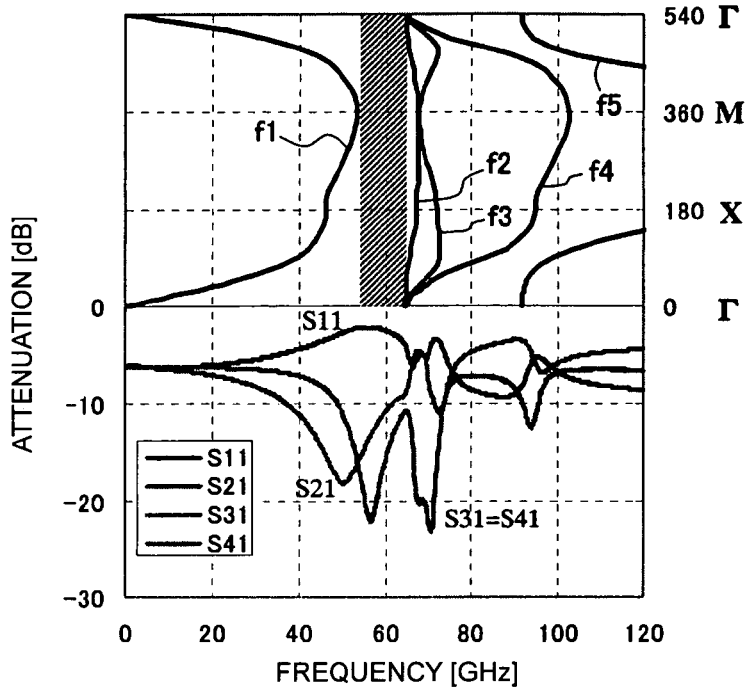
FIG. 22 illustrates examples of the S parameter and a band gap in the case where the number of lines n=6 and the linewidth/spacewidth=8 μm/8 μm in the inductive region.

FIG. 22 illustrates an example in the case where the number of lines n=6 and the linewidth L/spacewidth S=8 μm/8 μm. The dimensions of parts of a unit cell are as follows:

cell size: A=208 μm
width of the capacitive region W: 104 μm
thickness of the substrate H1: 300 μm
vertical space H2: 300 μm.

Figure 23:
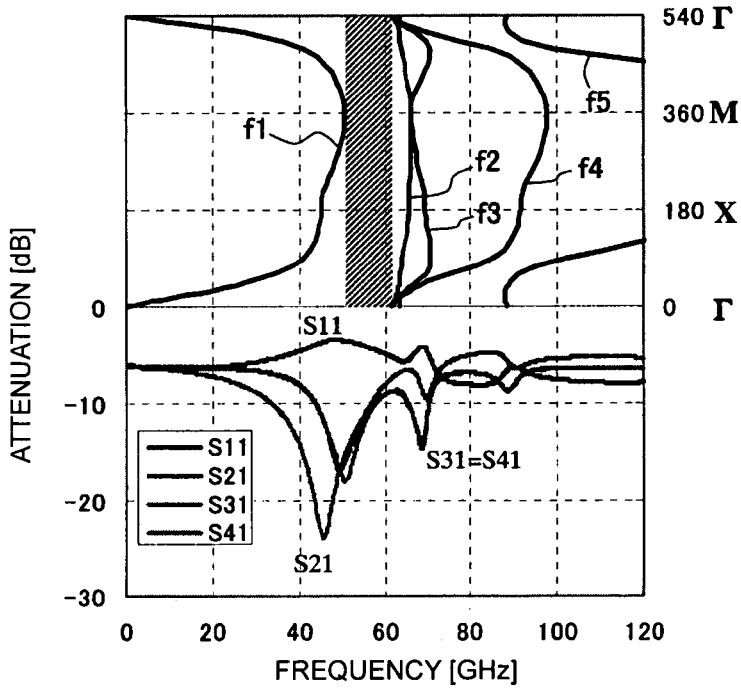
FIG. 23 illustrates examples of the S parameter and a band gap in the case where the number of lines n=8 and the linewidth/spacewidth=5 μm/5 μm in the inductive region.

FIG. 23 illustrates an example in the case where the number of lines n=8 and the linewidth L/spacewidth S=5 μm/5 μm. The dimensions of parts of a unit cell are as follows:

cell size: A=170 μm
width of the capacitive region W: 85 μm
thickness of the substrate H1: 300 μm
vertical space H2: 300 μm.

Figure 24:
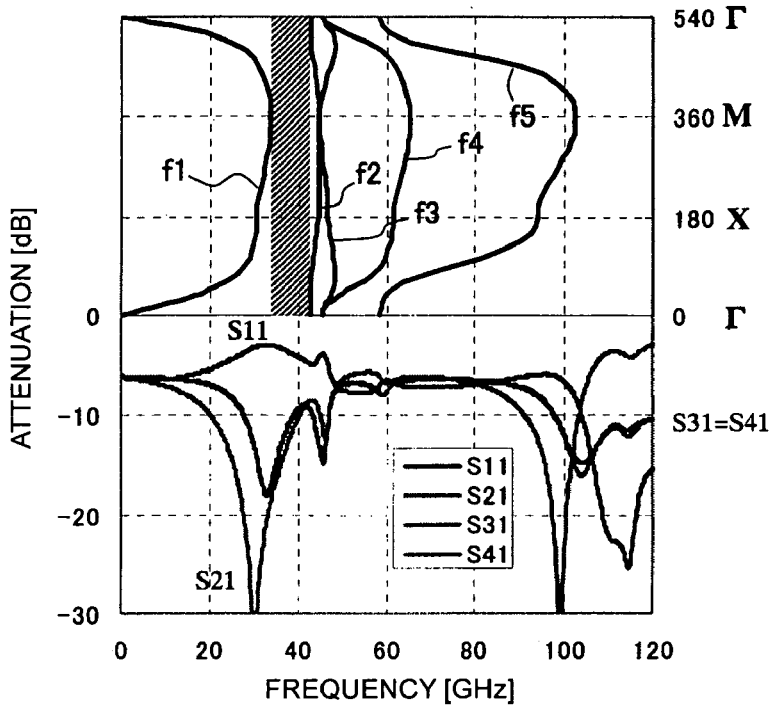
FIG. 24 illustrates examples of the S parameter and a band gap in the case where the number of lines n=10 and the linewidth/spacewidth=5 μm/5 μm in the inductive region.

FIG. 24 illustrates an example in the case where the number of lines n=10 and the linewidth L/spacewidth S=5 μm/5 μm. The dimensions of parts of a unit cell are as follows:

cell size: A=210 μm width of the capacitive region W: 105 Ξm
thickness of the substrate H1: 300 μm
vertical space H2: 300 μm.

By using patterned conductor films on either surface of the substrate under such conditions, a band gap was able to be generated at about 60 GHz. When analyzing the four-port S parameter for a square having sides that are the diagonal lines of the unit cells, S11 was high (the reflection was high) in a band gap, and S21 to S41 were attenuated. In addition, S31 overlapped S41 due to the symmetry property of the pattern.

Figure 25:
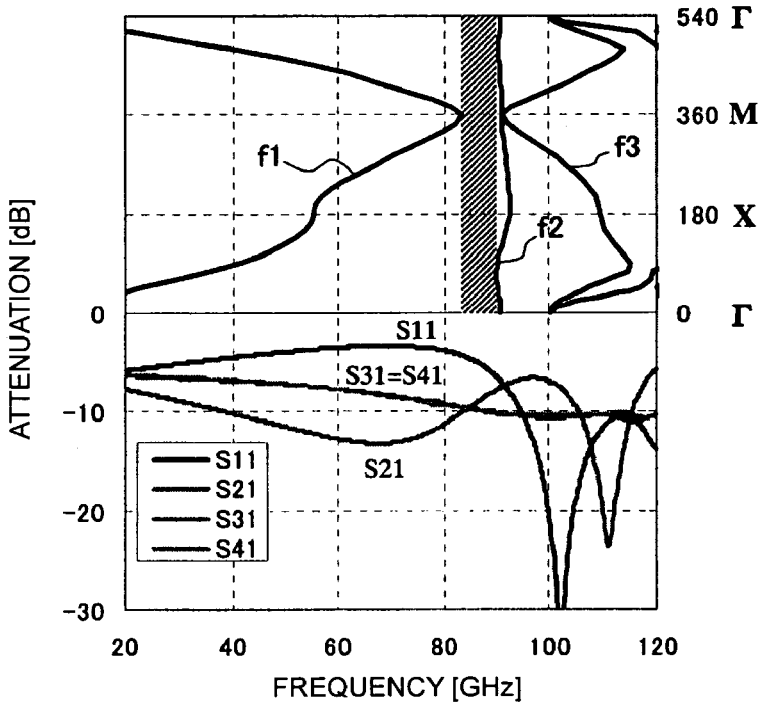
FIG. 25 illustrates examples of the S parameter and a band gap in the case where the inductive region has a meandering line pattern.

FIG. 25 illustrates a comparison example in which the inductive region has a meandering line shape. The dimensions of parts of the unit cell are as follows:

cell size: A=210 μm
linewidth L/spacewidth S: 5 μm/5 μm
width of the capacitive region W: 95 μm
thickness of the substrate H1: 300 μm
vertical space H2: 300 μm.

As can be seen from FIG. 25, in the case of a meandering line type, the band gap is moved towards a high frequency side as compared with a spiral type having the same cell size. Accordingly, in the case of a meandering line type, the size of the unit cell for generating a band gap at a desired frequency is larger than that of a spiral type. In addition, in the case of a meandering line type, although S11 in the band gap was high (the reflection is high), a decrease in S21 to S41 was small. As described above, it can be seen that, in the case of a meandering line type, the propagation of a spurious mode, such as a parallel plate mode, is not satisfactorily blocked in the frequency range of the band gap.

Fourth Embodiment

A high-frequency circuit device according to a fourth embodiment is described next with reference to FIGS. 26 and 27.

Figure 26:
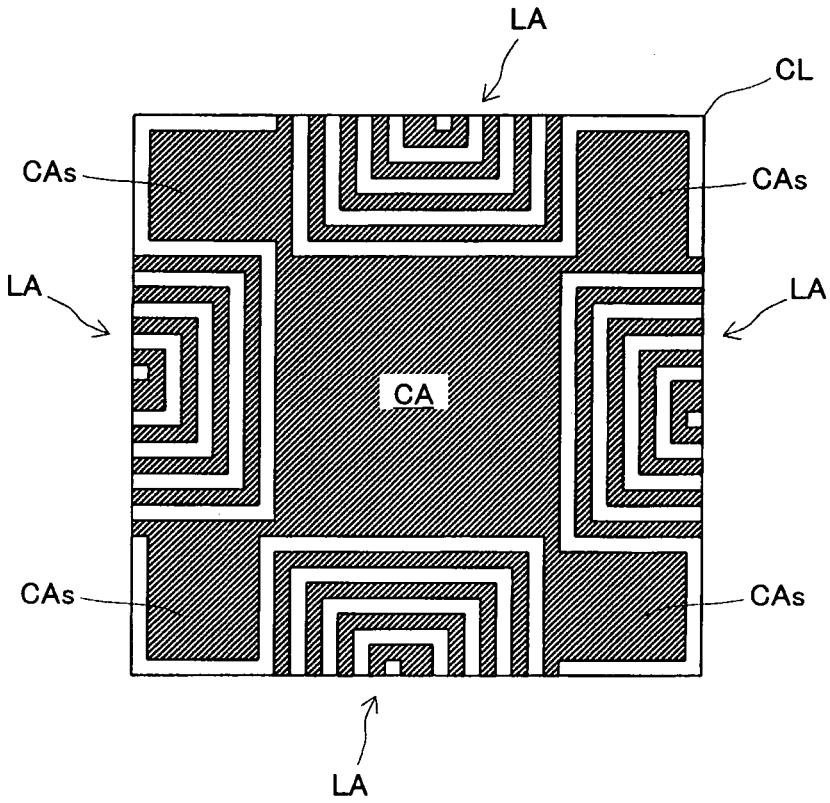
FIG. 26 illustrates a unit cell used in a planar circuit and a high-frequency circuit device according to a fourth embodiment.

FIG. 26 is a plan view of a unit cell. A unit cell CL has a capacitive region CA at the center thereof. However, unlike the example shown in FIG. 5, the capacitive region CA extends towards spaces at the four corners of the unit cell so as to form capacitive regions CAs. An inductive region LA is similar to that shown in FIG. 5.

Figure 27:
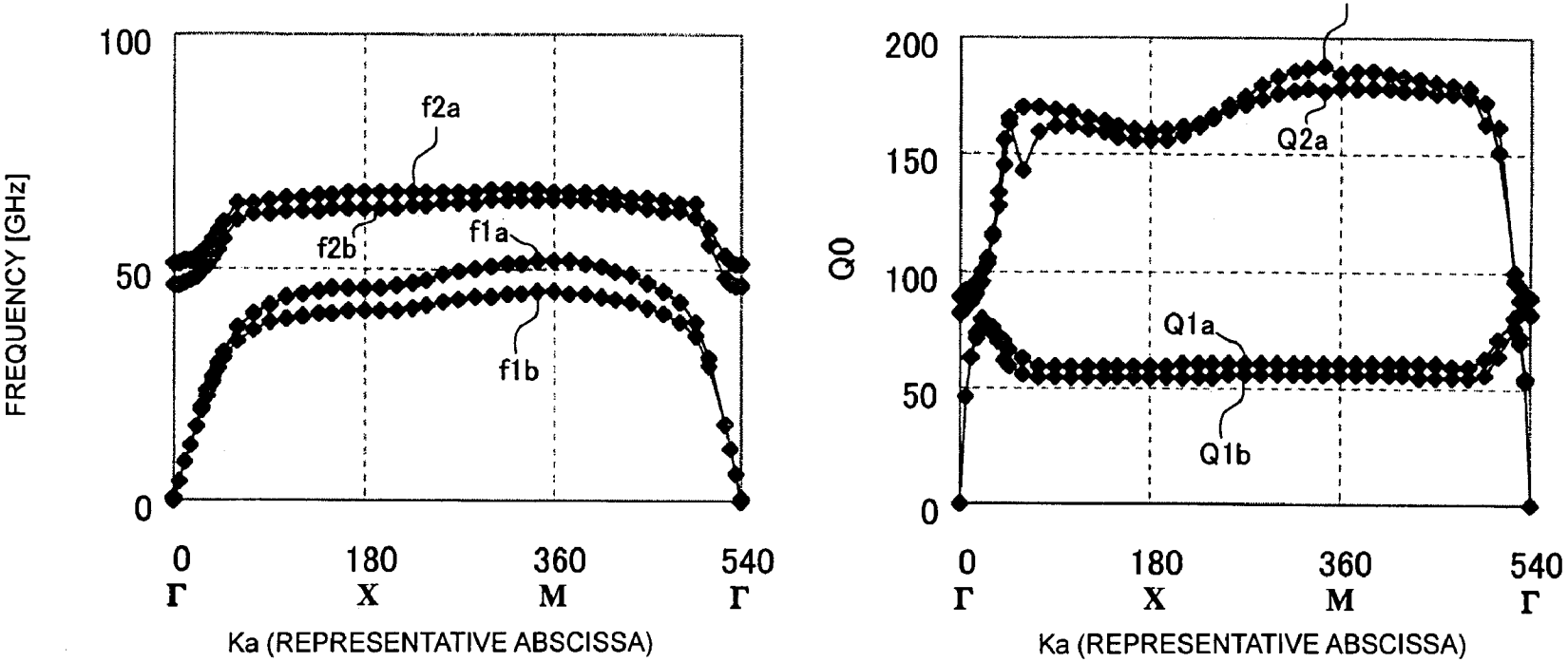
FIG. 27 illustrates examples of the frequency and Q-value characteristics of a model using the unit cells shown in FIGS. 5 and 26.

FIG. 27 illustrates a difference between the characteristics of the planar circuit having the unit cell shown in FIG. 5 and the planar circuit having the unit cell shown in FIG. 26. FIG. 27(A) illustrates the frequency with respect to the representative abscissa Ka. FIG. 27(B) illustrates the Q value (Qo) with respect to the representative abscissa Ka. By adding capacitive regions to the four corners of the unit cell, the frequency can be decreased while maintaining the unit cell size constant. In addition, the band gap between the first mode (f1) and the second mode (f2) can be increased. It can be seen that since the Q value changes in such a small level that is proportional to the frequency, the Q value is not substantially degraded.

Fifth Embodiment

A planar circuit according to a fifth embodiment is described next with reference to FIG. 28.

Figure 28:
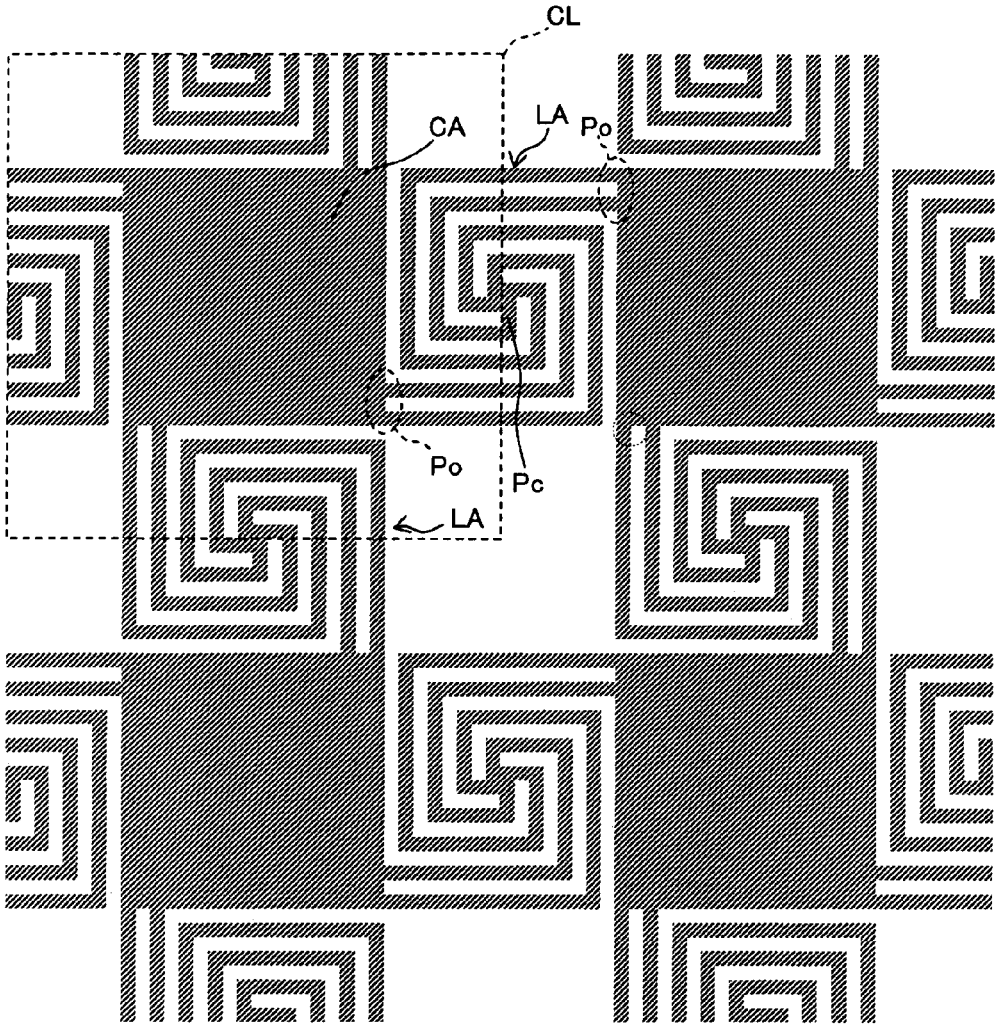
FIG. 28 illustrates a unit cell of a planar circuit and an example of two-dimensional arrangement of a plurality of the unit cells according to a fifth embodiment.

FIG. 28 illustrates a portion of the planar circuit in which a plurality of unit cells are two-dimensionally arranged. In this example, the inductive region LA has a conductor pattern having a quadruple spiral shape. An outer peripheral end Po is connected to a capacitive region CA. Two conductor patterns are connected using the center ends Pc. In this way, even when the multiplex level of the multiple spiral pattern is increased, the inductive region LA can be formed. In the same manner, a sextuple spiral conductor pattern can be formed.

If the line width of the spiral-shaped conductor pattern is smaller than the skin depth of the operating frequency, a skin effect is reduced. Accordingly, a loss reduction effect may be obtained. Thus, by increasing the number of lines of the multiple spiral pattern in the inductive region, the inductive region functions as an inductor element having a higher Q value. However, as the number of lines of the multiple spiral pattern increases, the size of the unit cell increases. Furthermore, if the balance between electrical currents flowing in the spiral-shaped conductors is not suitable, the Q value may decrease. Therefore, in the design, the number of lines and the line width need to be carefully considered.

Sixth Embodiment

Figure 29:
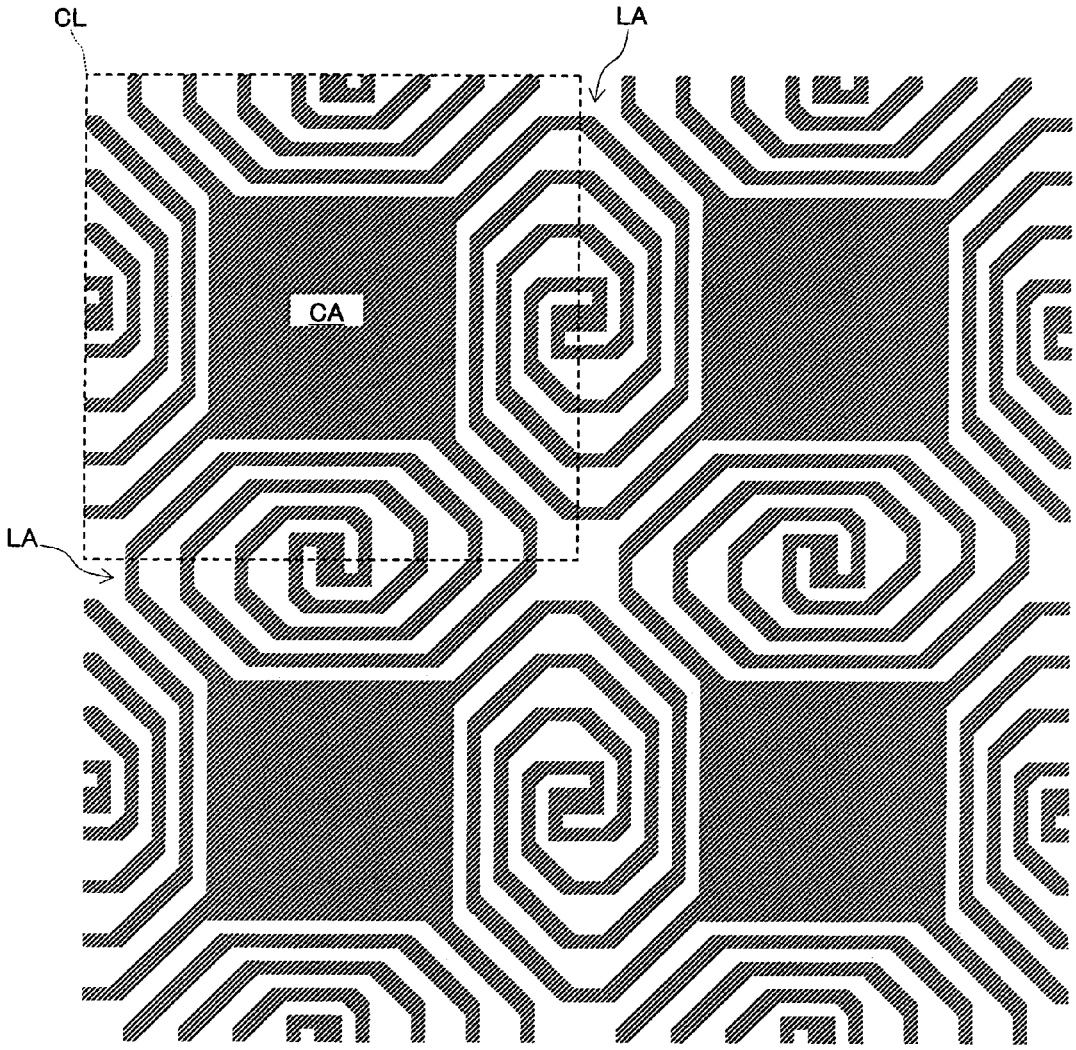
FIG. 29 illustrates a unit cell of a planar circuit and an example of two-dimensional arrangement of a plurality of the unit cells according to a sixth embodiment.

An example of a planar circuit according to a sixth embodiment is described with reference to FIG. 29. FIG. 29 illustrates a portion of the planar circuit in which a plurality of unit cells are two-dimensionally arranged. A conductor pattern of the inductive region LA extends to the four corners of the unit cell CL so that the pitch of the conductor pattern in the direction along each side of the unit cell CL is increased. Even such a conductor pattern shape can provide similar advantages as in the above-described embodiments.

Seventh Embodiment

Figure 30:
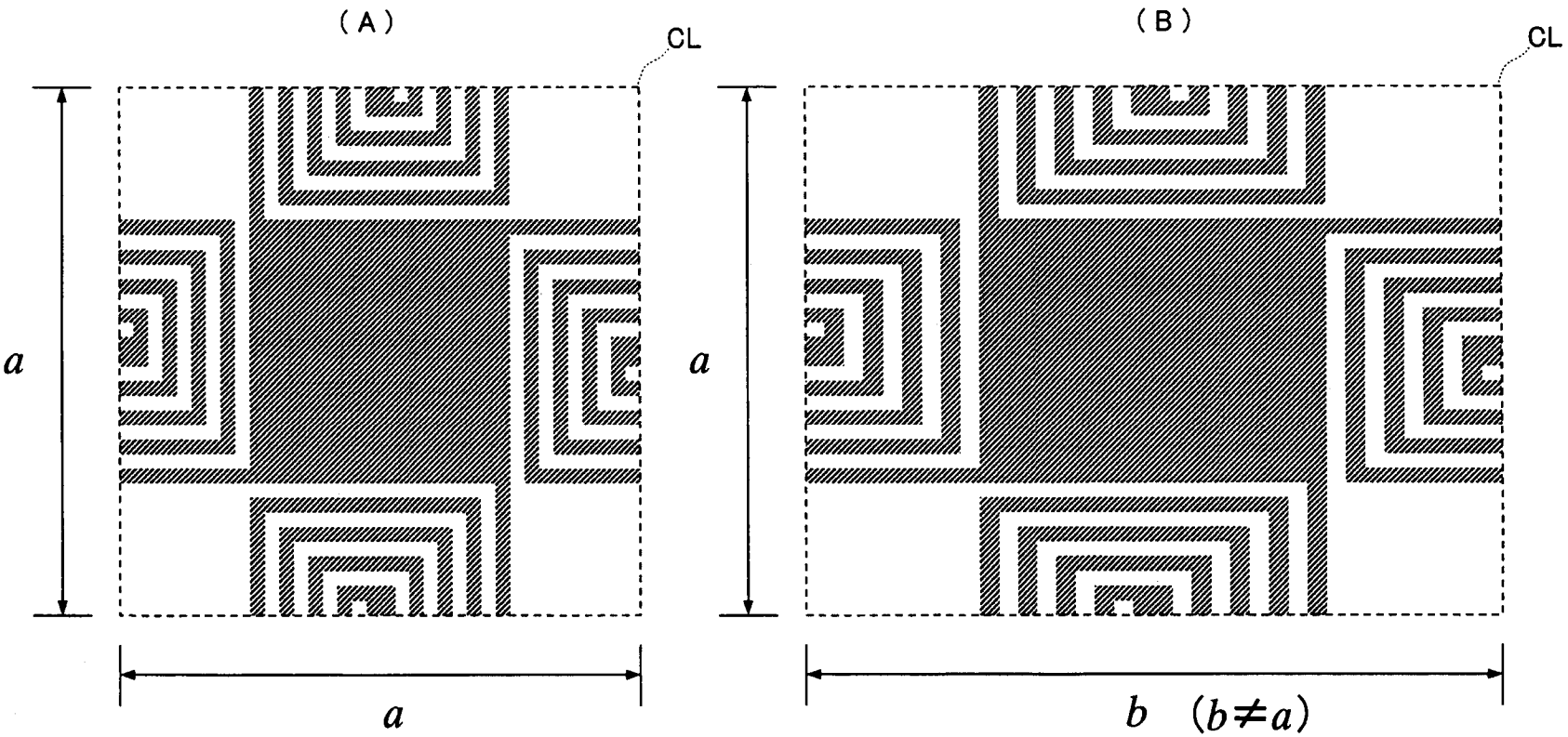
FIG. 30 illustrates an example structure of a unit cell of a planar circuit according to a seventh embodiment.

FIG. 30 illustrates the structure of a unit cell used in a planar circuit according to a seventh embodiment. FIG. 30(A) illustrates a basic shape that is the same as the shape shown in FIG. 5. FIG. 30(B) illustrates a modification of the basic shape. In this embodiment, the lengths of a side "a" and a side "b" of the unit cell that is perpendicular to the side "a" are made different so that the horizontal to vertical ratio is changed from 1:1. It is advantageous that the unit cell has a rectangular shape with two-fold rotational symmetry in the above-described manner. In addition, by using the design flexibility of the horizontal to vertical ratio effectively, the characteristics of the band gap can be anisotropic in the longitudinal and transverse directions.

Eighth Embodiment

Figure 31:
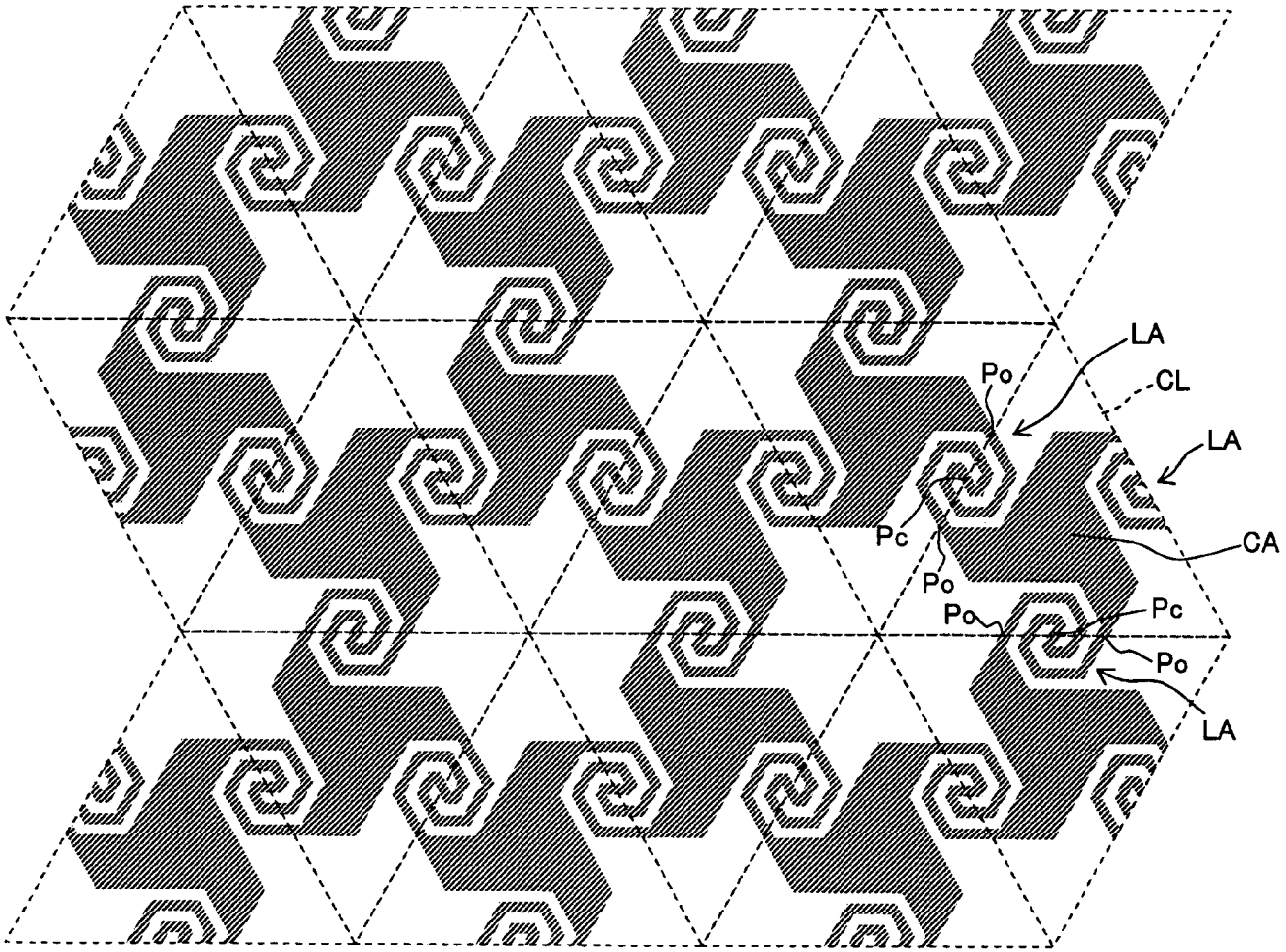
FIG. 31 illustrates a unit cell of a planar circuit and an example of two-dimensional arrangement of a plurality of the unit cells according to an eighth embodiment.

FIG. 31 illustrates the structure of a unit cell used in a planar circuit and two-dimensional arrangement of the unit cells according to an eighth embodiment. In the above-described embodiments, the shape of the unit cell is a square or rectangle. However, in this embodiment, the shape of a unit cell CL is an equilateral triangle, which has three-fold rotational symmetry. The planar circuit is filled with the unit cells CL having such a shape. A capacitive region CA is provided at the center of the unit cell CL. An inductive region LA is provided near the middle area of each side in the periphery of the unit cell CL. In any two adjacent unit cells, the inductive region LA has a double spiral-shaped conductor pattern having two-fold rotational symmetry, in which the center ends Pc are connected to each other at a halfway portion between the two adjacent unit cells and the outer peripheral ends Po are connected to the capacitive regions CA. Even such a conductor pattern in which the unit cells, each having three-fold rotational symmetry, are two-dimensionally arranged can provide similar advantages as in the above-described embodiments.

Ninth Embodiment

Figure 32:
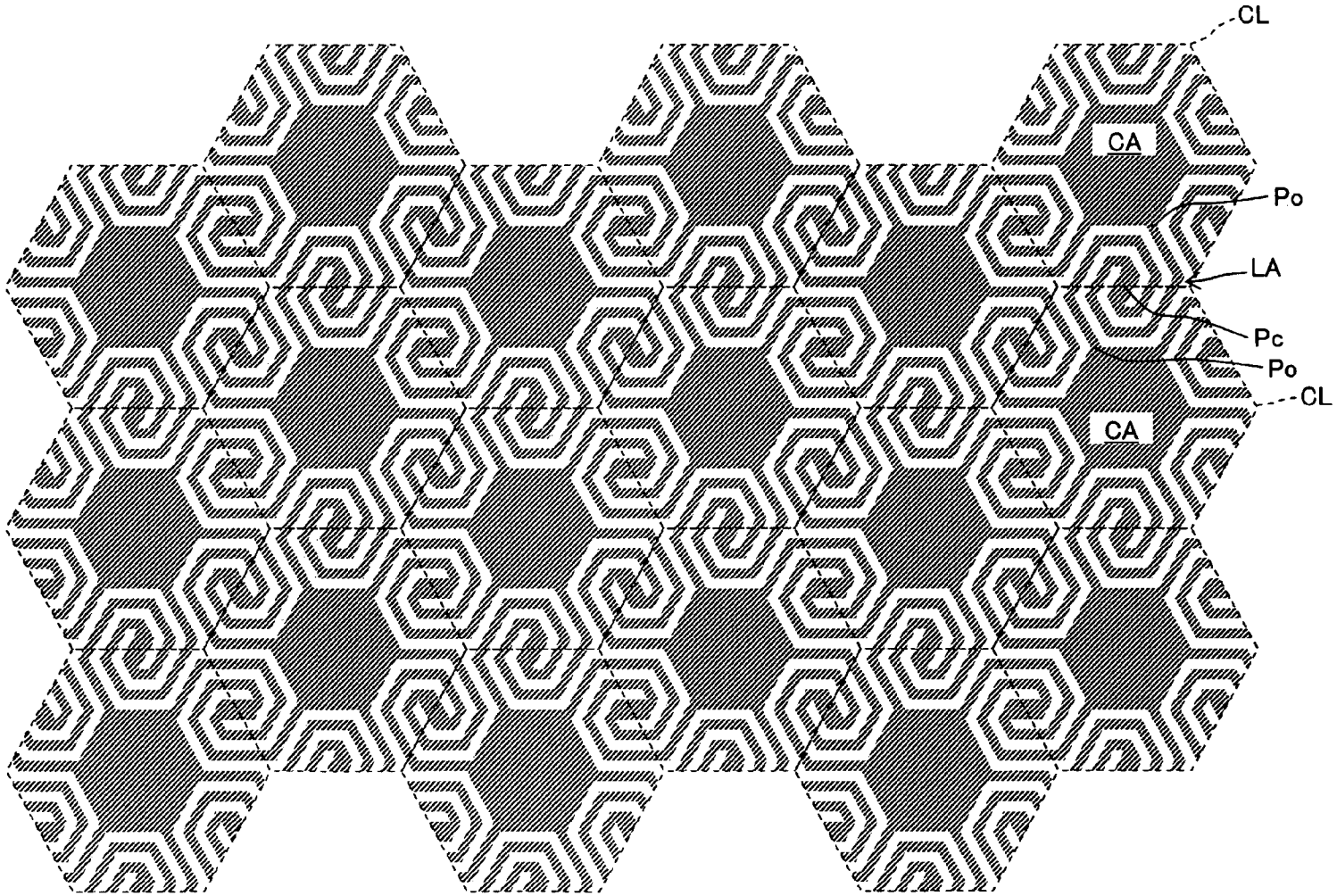
FIG. 32 illustrates a unit cell of a planar circuit and an example of two-dimensional arrangement of a plurality of the unit cells according to a ninth embodiment.

FIG. 32 illustrates the structure of a unit cell used in a planar circuit and two-dimensional arrangement of the unit cells according to a ninth embodiment. In this embodiment, the shape of a unit cell CL is regular hexagon, which has six-fold rotational symmetry. Such unit cells CL are two-dimensionally arranged so that the planar circuit is filled with the unit cells CL. A capacitive region CA is provided at the center of each of the unit cells CL. An inductive region LA is provided near the middle area of each side in the periphery of the unit cell CL. In any two adjacent unit cells, the inductive region LA has a double spiral-shaped conductor pattern having two-fold rotational symmetry, in which the center ends Pc are connected to each other at a halfway portion between the two adjacent unit cells and the outer peripheral ends Po are connected to the capacitive regions CA. Even such a conductor pattern in which the unit cells, each having six-fold rotational symmetry, are two-dimensionally arranged can provide similar advantages as in the above-described embodiments.

Tenth Embodiment

A high-frequency circuit device and a communication apparatus including the high-frequency circuit device according to a tenth embodiment are described with reference to FIGS. 33 and 34.

Figure 33:
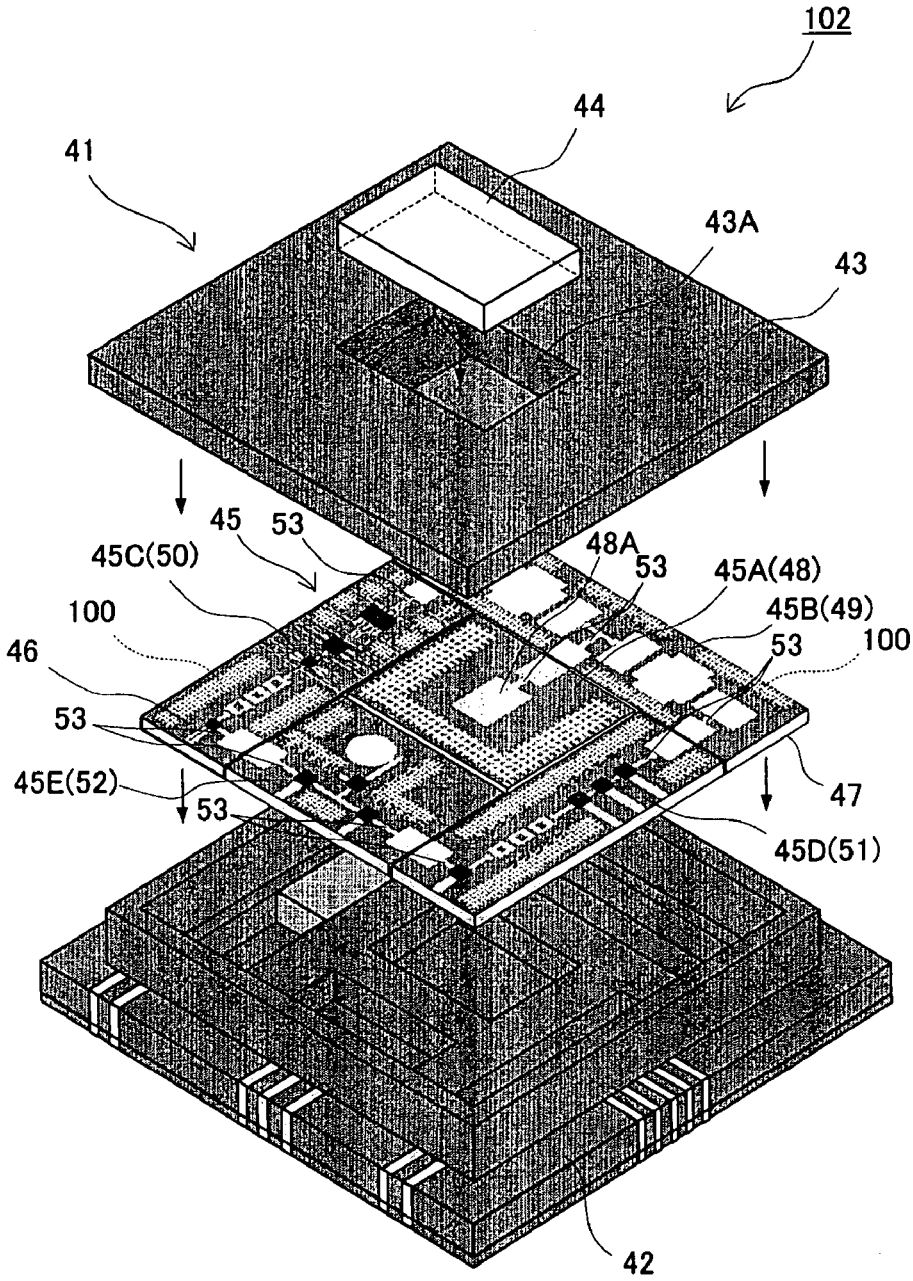
FIG. 33 is an exploded perspective view of a transmission and reception apparatus according to a tenth embodiment.
Figure 34:
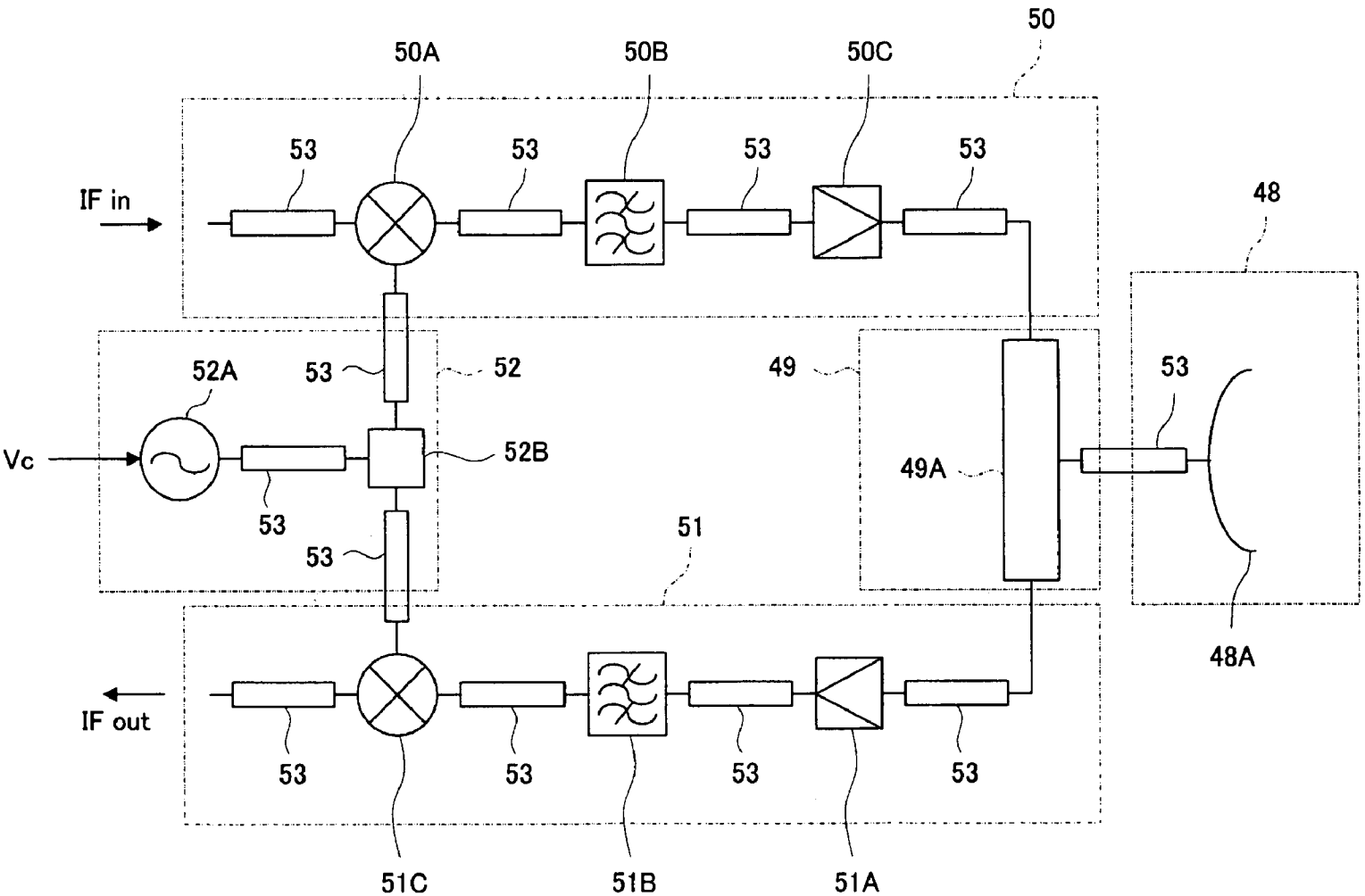
FIG. 34 is a block diagram illustrating an entire configuration of the transmission and reception apparatus.

FIG. 33 is an exploded perspective view of a transmission and reception apparatus. FIG. 34 is a block diagram of a circuit of the transmission and reception apparatus. As shown in FIG. 33, a resin package 41 serves as a housing of the communication apparatus. The resin package 41 includes a box-shaped casing 42 having an opening at the top thereof and a substantially rectangular cover 43 that covers the opening of the casing 42. A substantially rectangular opening 43A is provided at the center of the cover 43. A closing plate 44 that allows electromagnetic waves to pass therethrough is disposed in the opening 43A.

The casing 42 contains a dielectric substrate 45. The dielectric substrate 45 includes, for example, five separate substrates 45A to 45E. One surface of each of the separate substrates 45A to 45E is covered by a planar conductor 46 while the other surface is covered by a planar conductor 47. Each of the separate substrates 45A to 45E has a functional block including an antenna block 48, a duplexer block 49, a transmission block 50, a reception block 51, and an oscillator block 52, which are described below.

The antenna block 48 transmits transmission waves and receives reception waves. The antenna block 48 is provided on the separate substrate 45A located in the central portion of the dielectric substrate 45. The antenna block 48 includes a radiation slot 48A which forms a rectangular opening in the planar conductor 46. In addition, the radiation slot 48A is connected to the duplexer block 49 via a transmission line 53 of a PDTL type.

The duplexer block 49 serves as an antenna duplexer. The duplexer block 49 includes an resonator 49A including a rectangular opening in the planar conductor 46 of the separate substrate 45B. The resonator 49A is connected to the antenna block 48, the transmission block 50, and the reception block 51 via the transmission line 53 of a PDTL type.

The transmission block 50 outputs a transmission signal to the antenna block 48. The transmission block 50 includes electronic components (e.g., a field-effect transistor) mounted on the separate substrate 45C. More specifically, the transmission block 50 includes a mixer 50A, a bandpass filter 50B, and an electrical power amplifier 50C. The mixer 50A mixes a carrier wave output from the oscillator block 52 with an intermediate frequency signal IF and up-converts the mixed signal to a transmission signal. The bandpass filter 50B removes noise from the transmission signal output from the mixer 50A. The electrical power amplifier 50C amplifies the electric power of the transmission signal.

The mixer 50A, the bandpass filter 50B, and the electrical power amplifier 50C are connected to each other using the transmission line 53 of a PDTL type. The mixer 50A is further connected to the oscillator block 52 using the transmission line 53. The electrical power amplifier 50C is further connected to the duplexer block 49 using the transmission line 53.

The reception block 51 is provided on the separate substrate 45D. The reception block 51 receives a reception signal received by the antenna block 48. The reception block 51 then mixes the reception signal with a carrier wave output from the oscillator block 52 to down-convert the reception signal to an intermediate frequency signal IF. The reception block 51 includes a low-noise amplifier 51A, a bandpass filter 51B, and a mixer 51C. The low-noise amplifier 51A amplifies the reception signal with low noise. The bandpass filter 51B removes noise from the reception signal output from the low-noise amplifier 51A. The mixer 51C mixes the carrier wave output from the oscillator block 52 with the reception signal output from the bandpass filter 51B to down-convert the reception signal to the intermediate frequency signal IF.

The low-noise amplifier 51A, the bandpass filter 51B, and the mixer 51C are connected to each other using the transmission line 53. The low-noise amplifier 51A is further connected to the duplexer block 49 using the transmission line 53. The mixer 5C is further connected to the oscillator block 52 using the transmission line 53.

The oscillator block 52 is provided on the separate substrate 45E. The oscillator block 52 oscillates a signal of a predetermined frequency (e.g., a high-frequency signal, such as a microwave-band signal or a millimeter-wave band signal), which serves as a carrier wave. The oscillator block 52 includes a voltage control oscillator 52A and a branch circuit 52B. The voltage control oscillator 52A oscillates a signal of a frequency in accordance with a control voltage Vc. The branch circuit 52B supplies the signal output from the voltage control oscillator 52A to the transmission block 50 and the reception block 51.

The voltage control oscillator 52A and the branch circuit 52B are connected to each other using the transmission line 53 of a PDTL type. In addition, the branch circuit 52B is connected to the transmission block 50 and the reception block 51 using the transmission line 53.

As shown in FIG. 33, the planar circuit 100 is formed in the areas indicated by a hatching pattern on each of the upper surfaces of the separate substrates 45A to 45E. This planar circuit 100 is one of the planar circuits according to the first to ninth embodiments or one of planar circuits according to twelfth to nineteenth embodiments, which are described below. In this embodiment, the planar circuit 100 is disposed around the radiation slot 48A, the resonator 49A, the bandpass filter 50B, the bandpass filter 51B, the voltage control oscillator 52A, and the transmission line 53.

As noted above, since the planar circuit 100 is provided on each of the separate substrates 45A to 45E, an unwanted wave propagating between the planar conductors 46 and 47 of the dielectric substrate 45 can be blocked. Accordingly, by preventing spurious waves, for example, such as a parallel plate mode, from being combined between one and another of the separate substrates 45A to 45E, the isolation can be improved. Since the power loss caused by an unwanted wave is decreased, the efficiency can be increased. In addition, noise caused by an unwanted wave can be reduced.

While the tenth embodiment has been described with reference to a communication apparatus as an example of transmission and reception apparatuses, the present invention is not limited thereto. For example, the present invention can be widely applied to other types of transmission and reception apparatus, such as a radar system.

Eleventh Embodiment

An example of the characteristics of a high-frequency circuit device including a planar circuit according to the present invention obtained through simulation is described as an eleventh embodiment.

Figure 38:
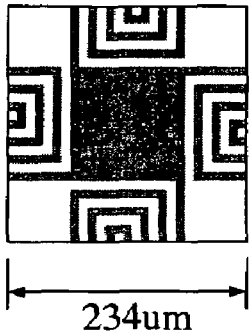
FIG. 38 illustrates a high-frequency circuit device and the structure of a unit cell applied to the high-frequency circuit device according to an eleventh embodiment.
Figure 38:
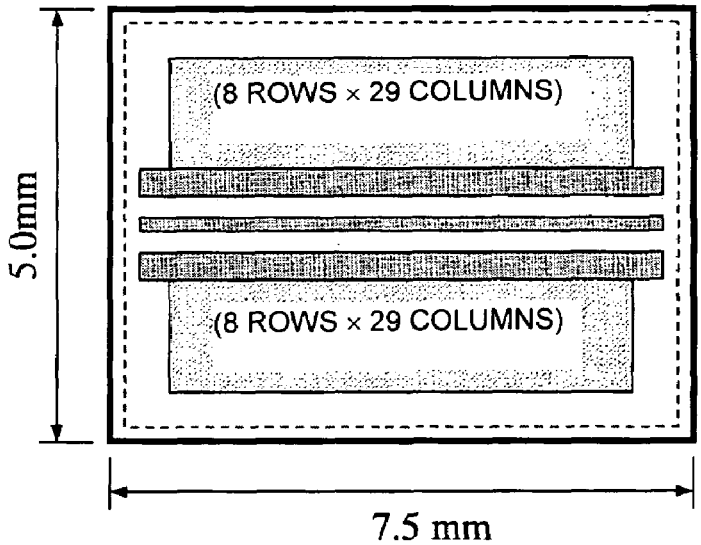

FIG. 38(A) illustrates the shape and dimensions of a unit cell of the planar circuit. FIG. 38(B) illustrates the structure of the high-frequency circuit device. The unit cell has a pattern illustrated in FIG. 38(A). The unit cell has a square shape having sides of 234 μm in which the linewidth L/spacewidth S=9 μm/9 μm, and the number of lines n=6. The high-frequency circuit device is formed by forming a conductive pattern on a substrate having a relative permittivity of 24, a thickness of 0.3 mm, and a size of 5.0 mm×7.5 mm. In this embodiment, the characteristics were obtained for each of the following:

(1) a normal coplanar transmission line CPW having no ground conductor film on the lower surface;

(2) a grounded coplanar transmission line CBCPW having a ground conductor film on the lower surface; and (3) a high-frequency circuit device including a grounded coplanar transmission line CBCPW in which the above-described unit cells are two-dimensionally arranged in ground conductor films disposed on either side of the coplanar transmission line.

More specifically, in the high-frequency circuit device, each of the ground conductor films disposed on either side of the coplanar transmission line includes the unit cells in 8 rows×29 columns.

Figure 39:
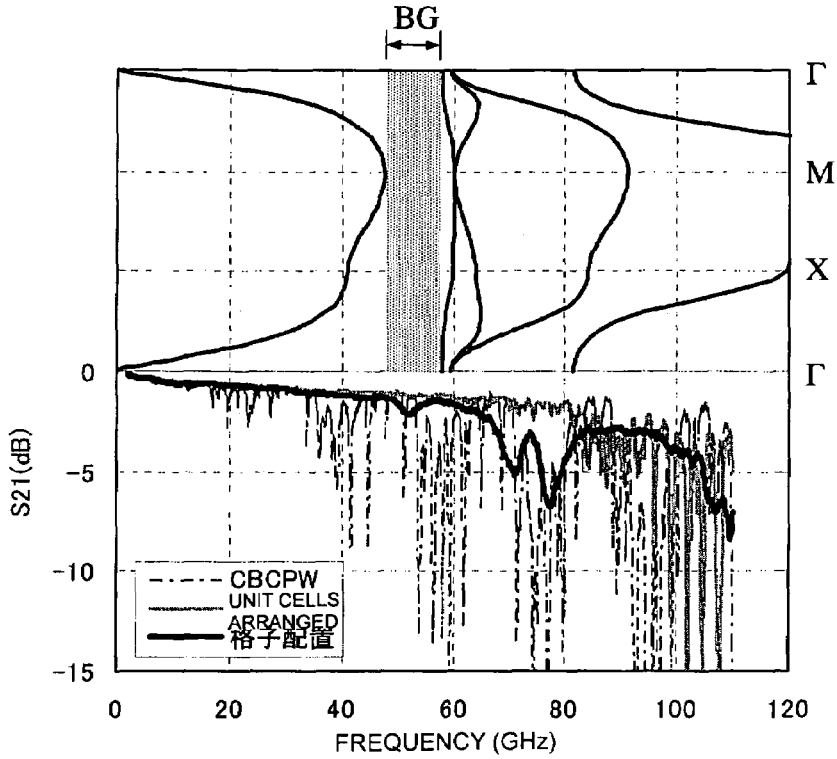
FIG. 39 illustrates the S parameter and the dispersion relation of the high-frequency circuit device.

FIG. 39 illustrates the S parameter and the dispersion relation. The lower section of the drawing represents the transmission characteristic S21, while the upper section of the drawing represents the five modes and the band gaps BG. This result indicates the following:

(1) The CPW has a relatively flat insertion loss characteristic up to about 80 GHz.

However, the occurrence of a ripple due to a surface wave increases from about 80 GHz.

(2) The CBCPW has a large number of ripples that are caused by a parallel plate mode and that appear above about 20 GHz.

(3) The cell arrangement model can prevent the occurrence of ripples which is present in the CBCPW.

In particular, the insertion loss due to a band gap (BG) can be reduced at about 60 GHz.

In addition, although the loss is high at about 90 GHz, a ripple due to the surface wave is planarized.

As described above, in the planar circuit having the unit cells disposed two-dimensionally, the parallel plate mode can be prevented and few ripples caused by a plane wave occur. Accordingly, the transmission characteristic in which few ripples occur in a wide frequency range can be obtained.

Twelfth Embodiment

Structures of a planar circuit and a high-frequency circuit device according to a twelfth embodiment is described next with reference to FIGS. 40 to 51.

Figure 40:
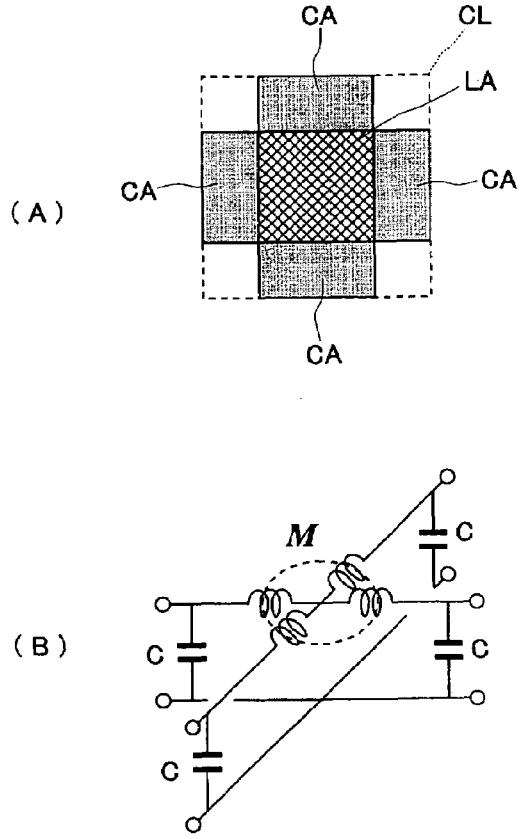
FIG. 40 illustrates the structure of a unit cell and a circuit of the unit cell used in a planar circuit and a high-frequency circuit device according to a twelfth embodiment.

FIG. 40 illustrates a unit cell CL which is a basic conductor pattern formed in a conductor film on a substrate and an equivalent circuit of the unit cell CL. The unit cell CL includes an inductive region LA at the center thereof. In addition, the unit cell CL includes a capacitive region CA in an area near the middle of each side in the periphery thereof. FIG. 40(B) illustrates an equivalent circuit of a circuit that is formed from the unit cell shown in FIG. 40(A) and a ground conductor film disposed on the lower surface of the substrate. The ground conductor film faces the unit cell across the substrate. A capacitance component C is induced between the capacitive region CA and the ground conductor film, while a mutual inductive reactance component M is induced by the inductive region LA.

Figure 41:
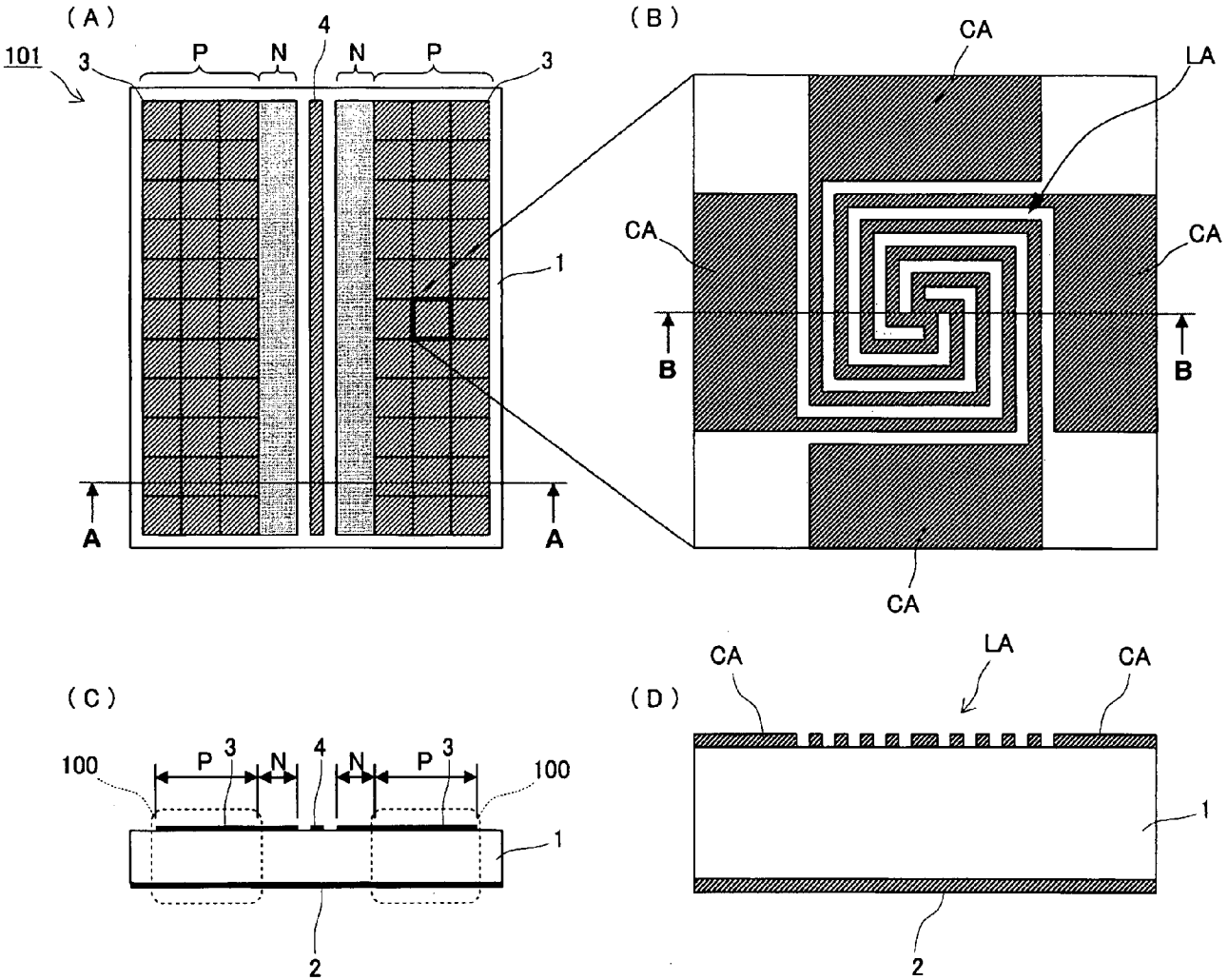
FIG. 41 illustrates the configuration of the high-frequency circuit device.

FIG. 41 illustrates an example of application to a substrate including a waveguide. FIG. 41(A) is a plan view of the substrate. FIG. 41(B) is an enlarged view of the unit cell portion. FIG. 41(C) is a cross-sectional view taken along line A-A of FIG. 41(A). FIG. 41(D) is a cross-sectional view taken along line B-B of FIG. 41(B). A transmission line conductor 4 and a patterned conductor film 3 are formed on the upper surface of the substrate. A ground conductor film 2 is formed on the substantially entire lower surface of the substrate 1. As shown in FIGS. 41(B) and 41(D), a plurality of unit cells are two-dimensionally disposed in a pattern formed region P of the patterned conductor film 3. In contrast, the unit cell CL is not formed in a pattern unformed region N, but a continuous ground conductor film is simply formed in the pattern unformed region N.

In this way, the patterned conductor film 3, the ground conductor film 2, and the substrate 1 form a planar circuit 100. In addition, the transmission line conductor 4, the patterned conductor films 3 (in particular, the pattern unformed regions N of the patterned conductor films 3) disposed on either side of the patterned conductor film 3, and the ground conductor film 2 disposed on the lower surface of the substrate 1 form a grounded coplanar transmission line.

As shown in FIG. 41(B), the unit cell CL includes the inductive region LA having a quadruple spiral shape at the center thereof and the capacitive region CA in an area near the middle of each side in the periphery thereof. As described below, the capacitive region CA continues to the capacitive region of the neighboring unit cell. The unit cell CL has four-fold rotational symmetry.

Figure 42:
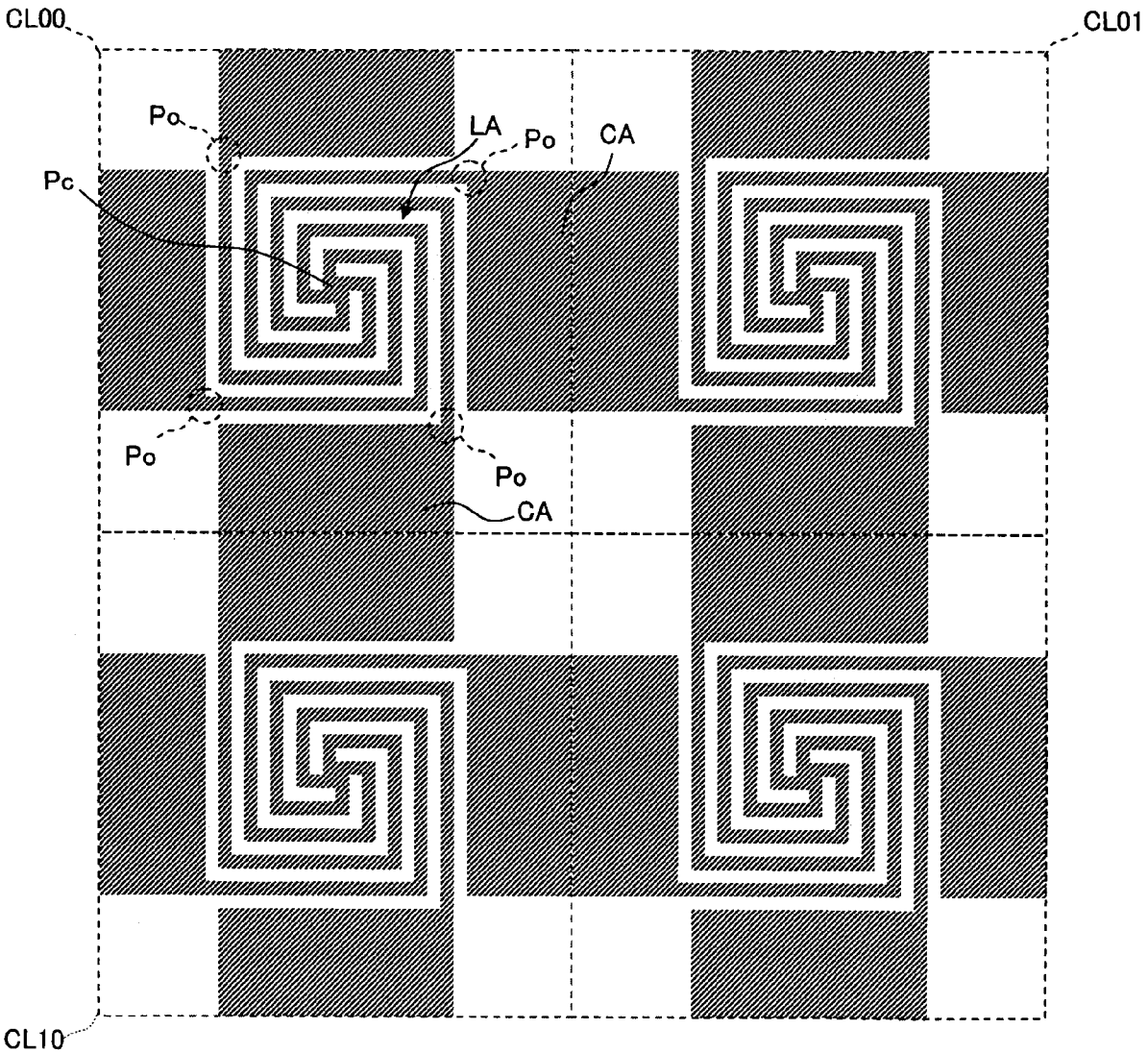
FIG. 42 illustrates an example of two-dimensional arrangement of a plurality of unit cells.

FIG. 42 illustrates a positional relationship among a plurality of the unit cells. Unit cells CL00, CL01, CL10, etc. have the same basic conductor pattern. The unit cell CL00 is discussed hereinafter. Outer peripheral ends of the quadruple spiral-shaped conductor pattern of the inductive region LA disposed at the center of the unit cell CL00 are connected to capacitive regions on the four sides in the periphery of the unit cell CL00.

When looking at the unit cell CL00 and the unit cell CL01 located immediately right of the unit cell CL00 in FIG. 42, the capacitive regions are connected to each other so that the capacitive region CA is disposed at a halfway portion between the two unit cells CL00 and CL01.

Similarly, when looking at the unit cell CL00 and the unit cell CL10 located immediately below the unit cell CL00, the capacitive regions are connected to each other so that the connected capacitive regions CA are disposed a halfway portion between the two unit cells CL00 and CL01.

The positional relationship between any other two adjacent unit cells disposed in the longitudinal and transverse directions is similar to the above-described example. By two-dimensionally arranging (tiling) the unit cells in this manner, the pattern formed region P of the patterned conductor film 3 shown in FIG. 41(A) is achieved.

Figure 43:
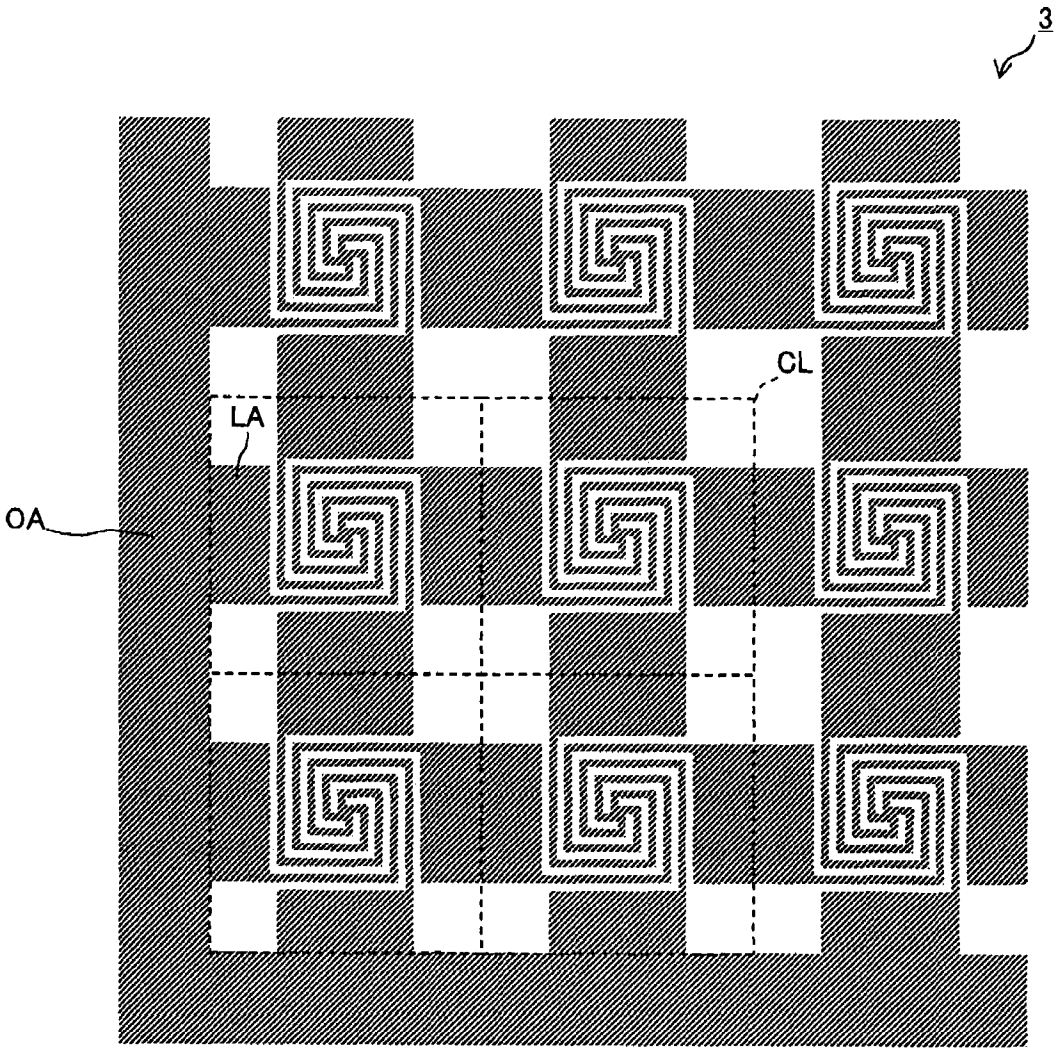
FIG. 43 illustrates an example of a pattern at the outer peripheral boundary of a patterned conductor film.
Figure 44:
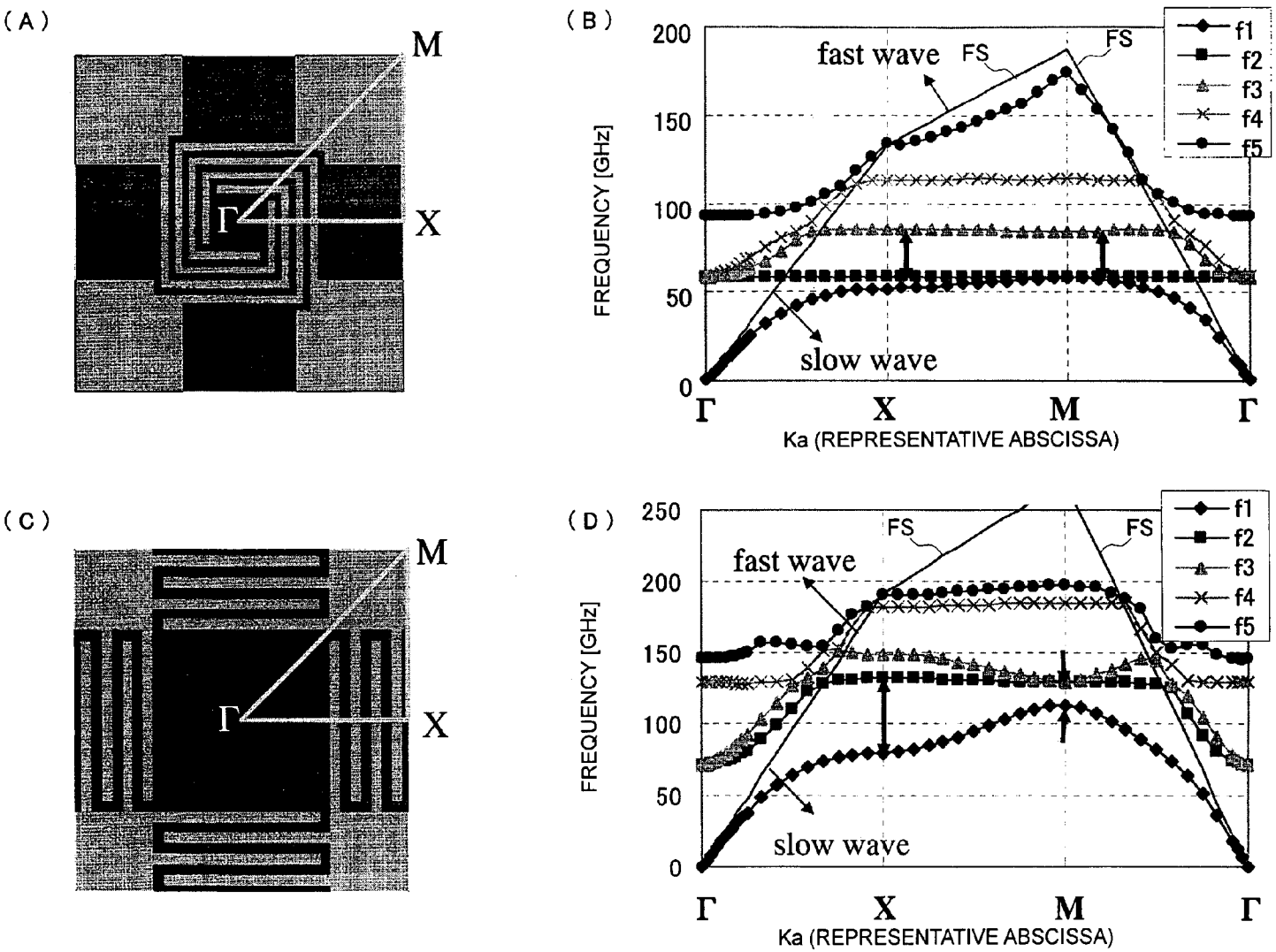
FIG. 44 illustrates an example of computation of the dispersion relation.

FIG. 43 illustrates an example of a pattern at the outer peripheral boundary of the patterned conductor film 3. Since a capacitive region is disposed on each side in the periphery of each unit cell, a peripheral region OA can be defined as a continuous ground conductive film, and the capacitive regions LA of the unit cells can be directly connected to the peripheral region OA.

In the above-described structure, the patterned conductor film 3 entirely becomes conductive for a direct current. Accordingly, application of a direct current voltage bias can be facilitated.

Analysis of the characteristics of the planar circuit according to the present invention is described next with reference to FIGS. 44 to 51.

An analysis model using a periodic boundary condition is the same as that shown in FIG. 9.

Figure 35:
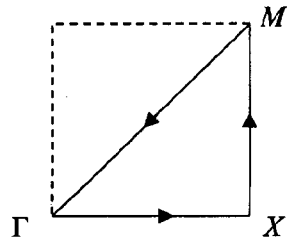
FIG. 35 illustrates an analysis path and a representative abscissa meaning the typical analysis path.
Figure 35:
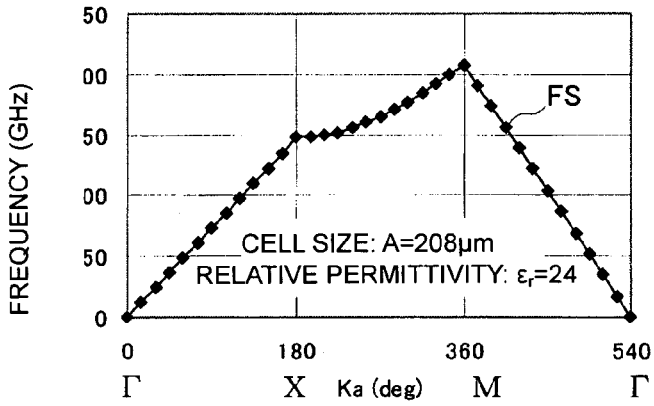

The analysis path and creation of a graph of a change in the frequency along the analysis path are the same as those described in FIG. 35.

In an example shown in FIG. 44(A), H1=0.3 mm and H2=0.3 mm. The unit cell has sides of 230 μm. The linewidth/spacewidth in the inductive region is 5 μm/5 μm. In the drawing, the analysis path Γ-X-M-Γ is shown. FIG. 44(B) illustrates the dispersion relation where the abscissa represents the analysis path Γ-X-M-Γ and the ordinate represents the frequency. A mountain-shaped solid curve FS in the drawing is similar to that shown in FIG. 35(C). A slow wave appears inside the curve FS. A fast wave appears outside the curve FS. The term "slow" and "fast" refer to a slow phase velocity and a fast phase velocity of a wave propagating in a free medium of the substrate relative permittivity, respectively. The slow wave is a wave of electrical power propagating in a pattern plane (i.e., a guided wave). In contrast, the fast wave is a wave that has a wavenumber vector in a direction perpendicular to the pattern plane and resonates in the radiation direction or the thickness direction (i.e., leakey wave). In a slow wave region, this structure operates with a band gap (a forbidden band).

Here, the characteristics at the points X and M are as follows:

X point characteristics (f1-f2: no band gap)

forbidden band (f2-f3): 58.4-85.4 GHz (Δ 27.0 GHz)

relative bandwidth (f2-f3): 37.6%

M point characteristics (f1-f2: no band gap)

forbidden band (f2-f3): 57.8-83.9 GHz (Δ 26.1 GHz)

relative bandwidth (f2-f3): 36.9%.

As shown by an arrowed line having arrowheads at both ends thereof at each of the X point and the M point in FIG. 44(B), a band gap appears between a mode f2 in which a slow wave occurs along the entire path Γ-X-M-Γ and a mode f3 having a frequency higher that that of the mode f2.

FIGS. 44(C) and 44(D) illustrate examples of the unit cell and the characteristics thereof described in Patent Document 1. FIGS. 44(C) and 44(D) correspond to FIGS. 44(A) and 44(B), respectively. In these examples, the linewidth/spacewidth in the inductive region is 5 μm/5 μm. In addition, the other conditions are the same as those in FIG. 44(A). FIG. 44(D) represents the dispersion relation.

Here, the characteristics at the points X and M are as follows:

X point characteristics forbidden band (f1-f2): 79.8-131.7 GHz (Δ 51.9 GHz)

relative bandwidth (f1-f2): 49.1%

M point characteristics forbidden band (f1-f2): 113.1-128.9 GHz (Δ 15.8 GHz)

relative bandwidth (f1-f2): 13.1%.

As can be seen from comparison with FIG. 44(B), the band gap is increased at the X point. In contrast, the band gap is decreased so that a bottleneck shape is formed at the M point. In addition, the flatness of the first mode f1 and a third mode f3 deteriorates in the slow wave area. This is because the waves in the first mode f1 tend to propagate in a direction at an angle of about 45° due to the dispersion relation of the first mode f1 in the case where the waves are excited at a frequency of 110 GHz.

A design example of the number of lines n of an inductive region (the number of conductor transmission lines appearing in a cross section passing through the center of the unit cell) for causing a band gap at a predetermined frequency is described next with reference to FIGS. 45 to 49.

Figure 45:
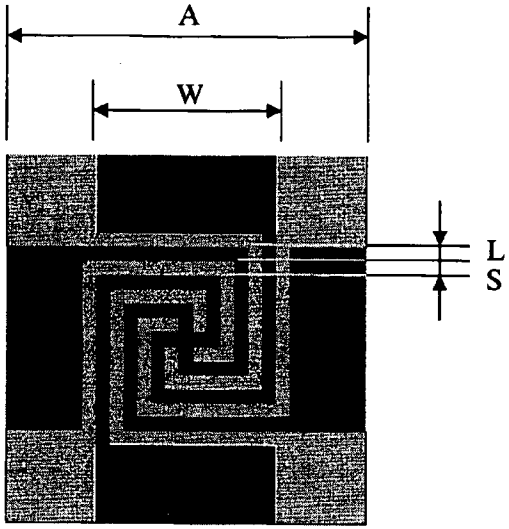
FIG. 45 illustrates an analysis result at an M point when the number of lines n of a conductor pattern in an inductive region is set to 6.
Figure 45:
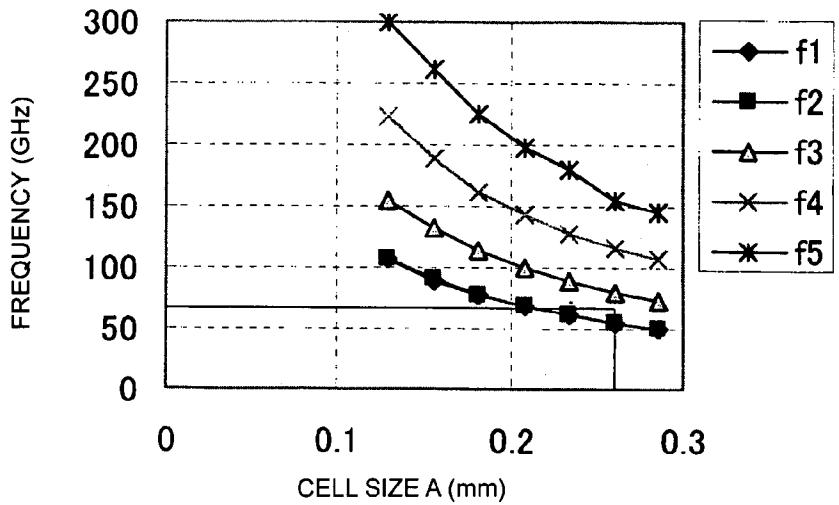

FIG. 45 illustrates an example when the number of lines n in an inductive region is 6. Let A denote the length of a side of a unit cell (i.e., cell size), W denote the width of the capacitive region and the inductive region, L denote the line width of the inductive region, and S denote a space width. Then, FIG. 45 illustrates a change in frequency of five modes f1 to f5 in accordance with a change in the cell size A. In this example, the thickness of the substrate H1 is 0.3 mm and the thickness of the upper space H2 is 0.3 mm, which are constant values. With the cell size A being changed while maintaining the number of lines n constant, W, L, and S are changed. FIG. 45(C) illustrates an example in which the cell size A is changed between 0.130 mm and 0.286 mm.

The frequencies of the second mode f2 and the third mode f3 are changed in accordance with a change in the cell size A. In order to set a frequency of a band gap generated between the two modes to 60 GHz, the design indicated by No. 6 in FIG. 45(C) can be employed. According to the conditions of the design No. 6, the frequency of the second mode f2 is 54.8 GHz and the frequency of the third mode f3 is 80.4 GHz. Accordingly, a band gap is generated between the frequencies of 54.8 GHz and 80.4 GHz. That is, the propagation of a spurious mode of 60 GHz, which is the use frequency, is blocked by the band gap.

Figure 46:
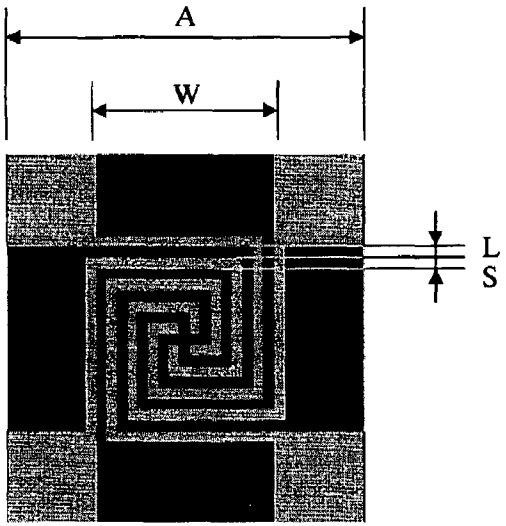
FIG. 46 illustrates an analysis result at the M point when the number of lines n of the conductor pattern in the inductive region is set to 8.
Figure 46:
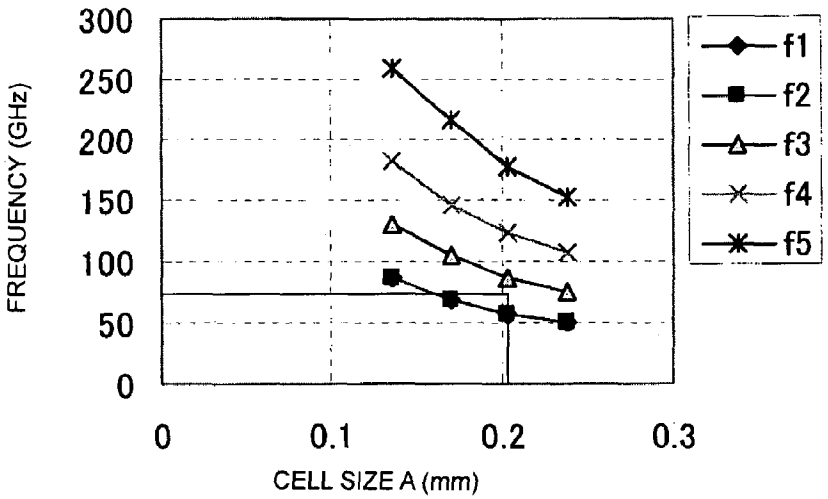

FIG. 46 illustrates an example when the number of lines n of the inductive region is 8. In this case, in order to set a frequency of a band gap generated between the second mode f2 and the third mode f3 to 60 GHz, the unit cell indicated by the design No. 3 can be employed.

Figure 47:
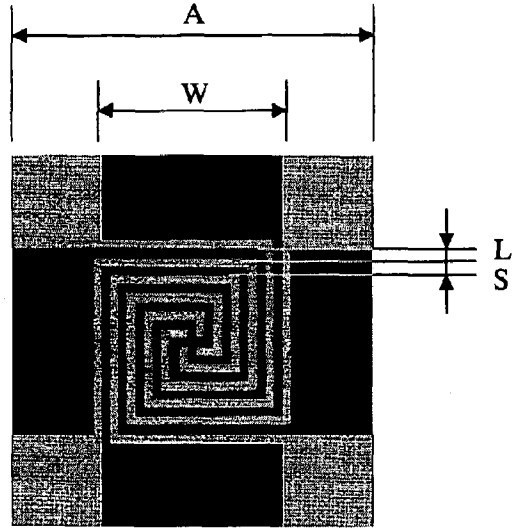
FIG. 47 illustrates an analysis result at the M point when the number of lines n of the conductor pattern in the inductive region is set to 10.
Figure 47:
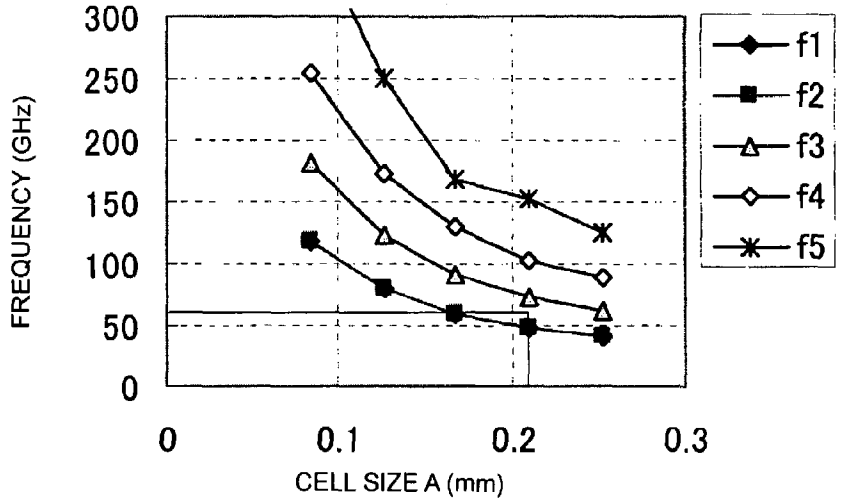

FIG. 47 illustrates an example when the number of lines n of the inductive region is 10. In this case, in order to set a frequency of a band gap generated between the second mode f2 and the third mode f3 to 60 GHz, the unit cell indicated by the design No. 4 can be employed.

Figure 48:
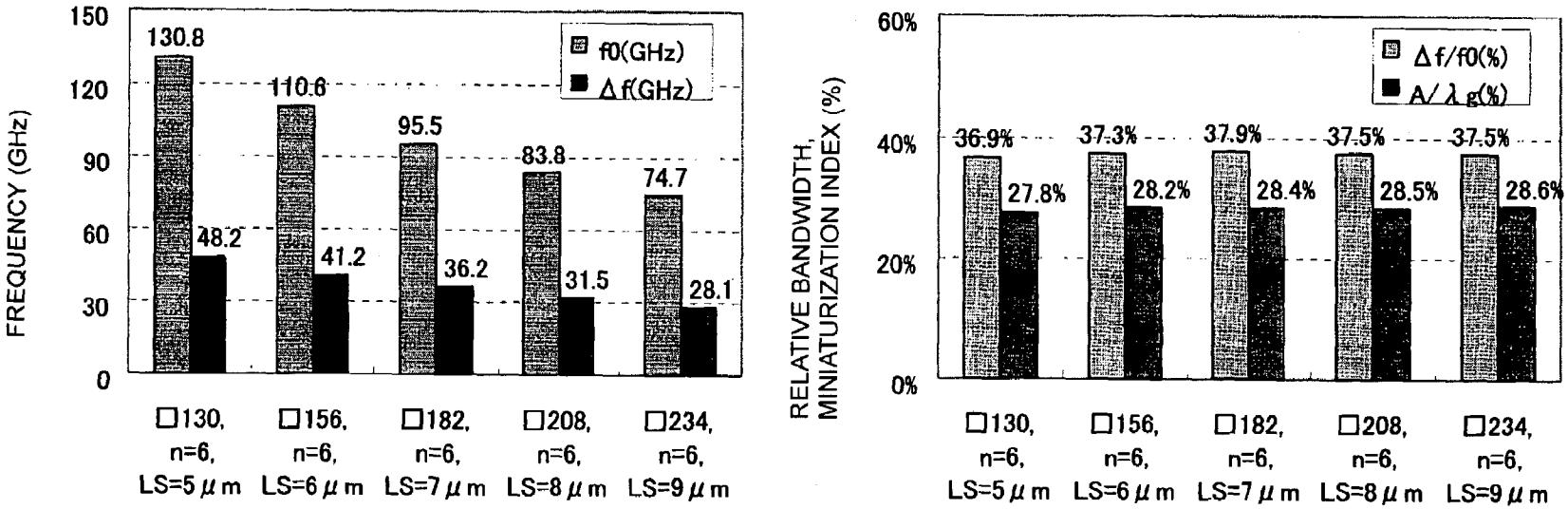
FIG. 48 illustrates the dependency on the line width of the inductive region.

The dependency on the line width and the number of lines of the inductive region is described next with reference to FIGS. 48 and 49.

FIG. 48(A) illustrates a frequency fo of a band gap and a frequency width Δf of the band gap when the number of lines n of the inductive region is 6 and the linewidth L/spacewidth S is changed from 5 μm/5 μm to 9 μm/9 μm. FIG. 48(B) illustrates a relative bandwidth Δf/fo and a miniaturization index A/λg, where λg is the wavelength in the substrate. In this example, the condition of the periodic boundary analysis is the wavenumber×cell constant=(180°, 180°). That is, the condition indicates the M point.

In addition, by increasing the linewidth L/spacewidth S, the cell size A is increased. For example, when the linewidth L/spacewidth S was 5 μm/5 μm, the cell size A was set to 130 μm. When the linewidth L/spacewidth S was 9 μm/9 μm, the cell size A was set to 234 μm. Let fo denote the average frequency of the first mode and the second mode (when f1 represents the frequency of the first mode and f2 represents the frequency of the second mode, fo=(f1+f2)/2). Then, as the cell size A was increased, the average frequency fo decreased. In each of the models, the relative bandwidth Δf/fo was about 37%, and the miniaturization index A/λg was about 28%.

Figure 49:
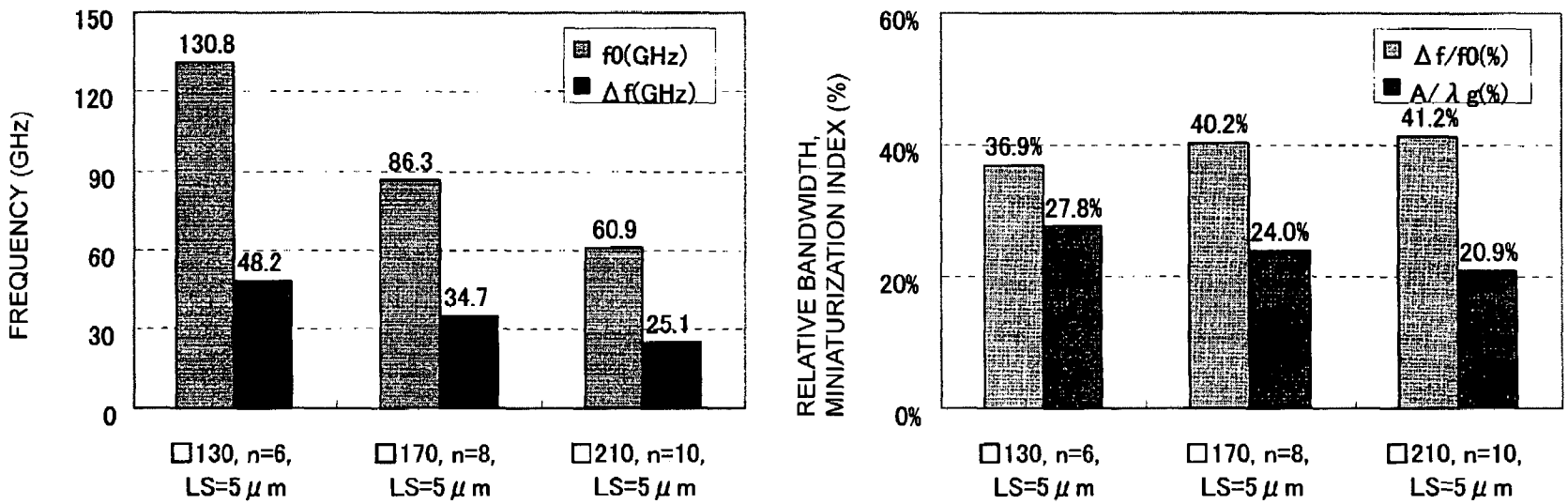
FIG. 49 illustrates the dependency on the number of lines of the inductive region.

FIG. 49 illustrates an example in which the linewidth L/spacewidth S of the inductive region was set to a constant value of 5 μm/5 μm, and the number of lines n was changed to 6, 8, or 10. In accordance with the increase in the number of lines n, the cell size A was increased. For example, when the number of lines n was 6, the cell size A was set to 130 μm. When the number of lines n was 10, the cell size A was set to 210 μm. As the cell size A was increased, the average frequency fo of the first mode and the second mode decreased. In addition, the relative bandwidth Δf/fo monotonically increased, and the miniaturization index A/λg monotonically decreased. Accordingly, by increasing the number of lines, a wide relative bandwidth can be obtained. By decreasing the number of lines, the size can be reduced.

The effect obtained by disposing the inductive region at the center of the unit cell and disposing the capacitive region at the periphery of the unit cell is described next with reference to FIGS. 50 and 51.

Figure 50:
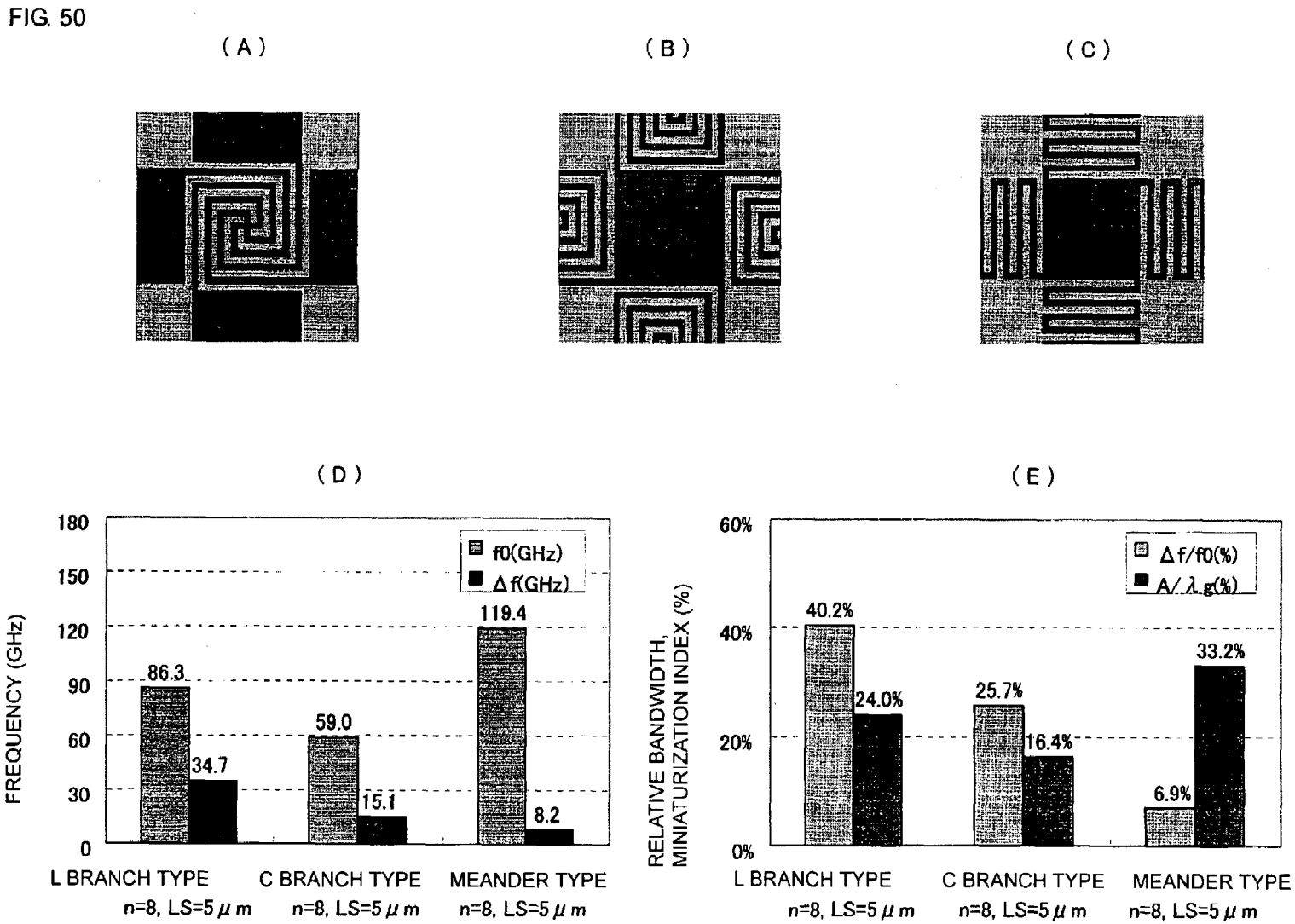
FIG. 50 illustrates differences in characteristics of a variety of unit cells.
Figure 51:
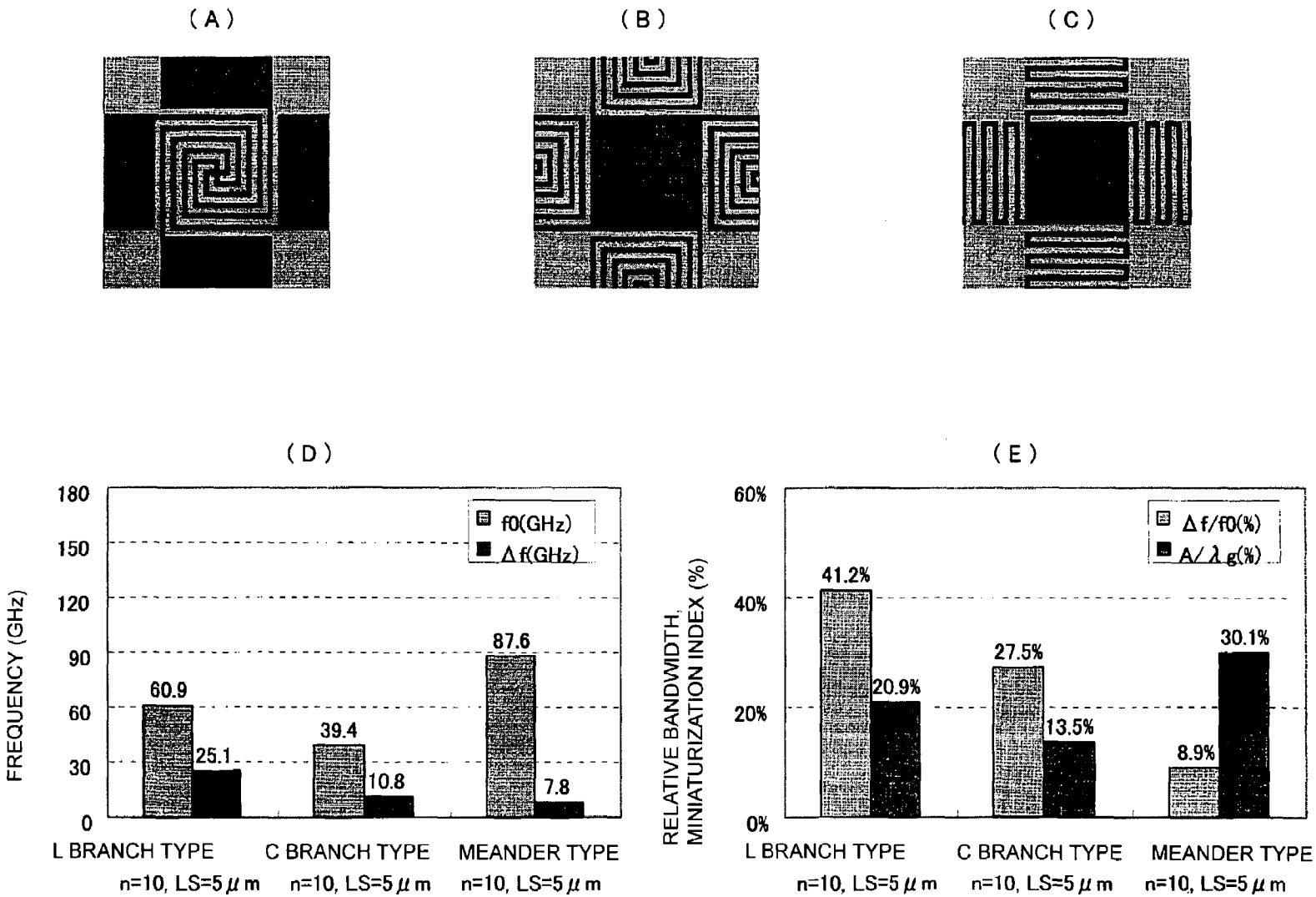
FIG. 51 illustrates differences in characteristics of a variety of unit cells.

FIGS. 50(A) and 51(A) illustrate examples using a unit cell (of an L branch type) shown in FIG. 40. FIGS. 50(B) and 51(B) illustrate examples using a unit cell (of a C branch type) having a capacitive region at the center thereof and an inductive region at the periphery thereof. FIGS. 50(C) and 51(C) illustrate examples using a unit cell (of a meandering line type) having a meandering line shaped inductive region in FIGS. 50(B) and 51(B). FIGS. 50(D) and 51(D) illustrate the frequency fo of a band gap and the frequency width Δf of the band gap when each of the unit cells shown in FIGS. 50(A) and 51(A), FIGS. 50(B) and 51(B), and FIGS. 50(C) and 51(C) is used. FIGS. 50(E) and 51(E) illustrate a relative bandwidth Δf/fo and a miniaturization index A/λg, where λg is the wavelength in the substrate. In FIG. 50, the number of lines n of the inductive region is 8. In FIG. 51, the number of lines n of the inductive region is 10.

When these examples are compared with each other under the same conditions (the cell size, the number of lines, and the line width), the relative bandwidth is as large as a value greater than or equal to 40% since the impedance ratio of the inductive region to the conductive region is high. Thus, the unit cell of an L type has an excellent wide band characteristic as compared with the unit cells of a meandering line type and a C branch type. That is, since the band gap is wide, the unit cell of an L type has an excellent single transmission characteristic. There are similar tendencies even when the number of lines n is changed. Note that although the miniaturization index of the unit cell of an L branch type according to the present invention is lower than that of the unit cell of a C branch type, the size of the unit cell of an L branch type can be reduced less than that of the existing unit cell of a meandering line type.

In this embodiment, the concept for designing a band gap through analysis of a one-dimensional equivalent circuit is the same as that described in FIGS. 36 and 37 above.

Thirteenth Embodiment

Figure 52:
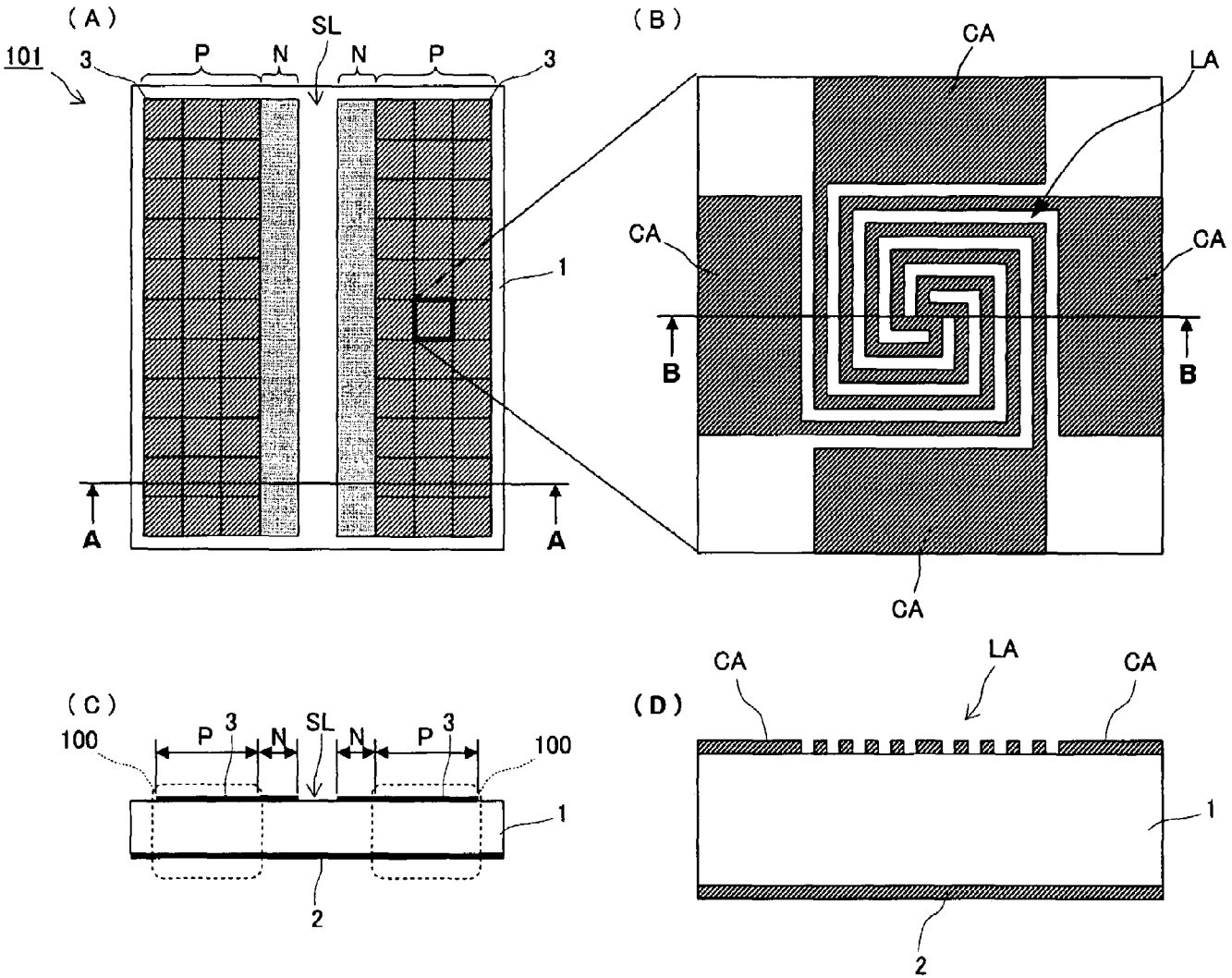
FIG. 52 illustrates the configurations of a planar circuit and a high-frequency circuit device according to a thirteenth embodiment.
Figure 53:
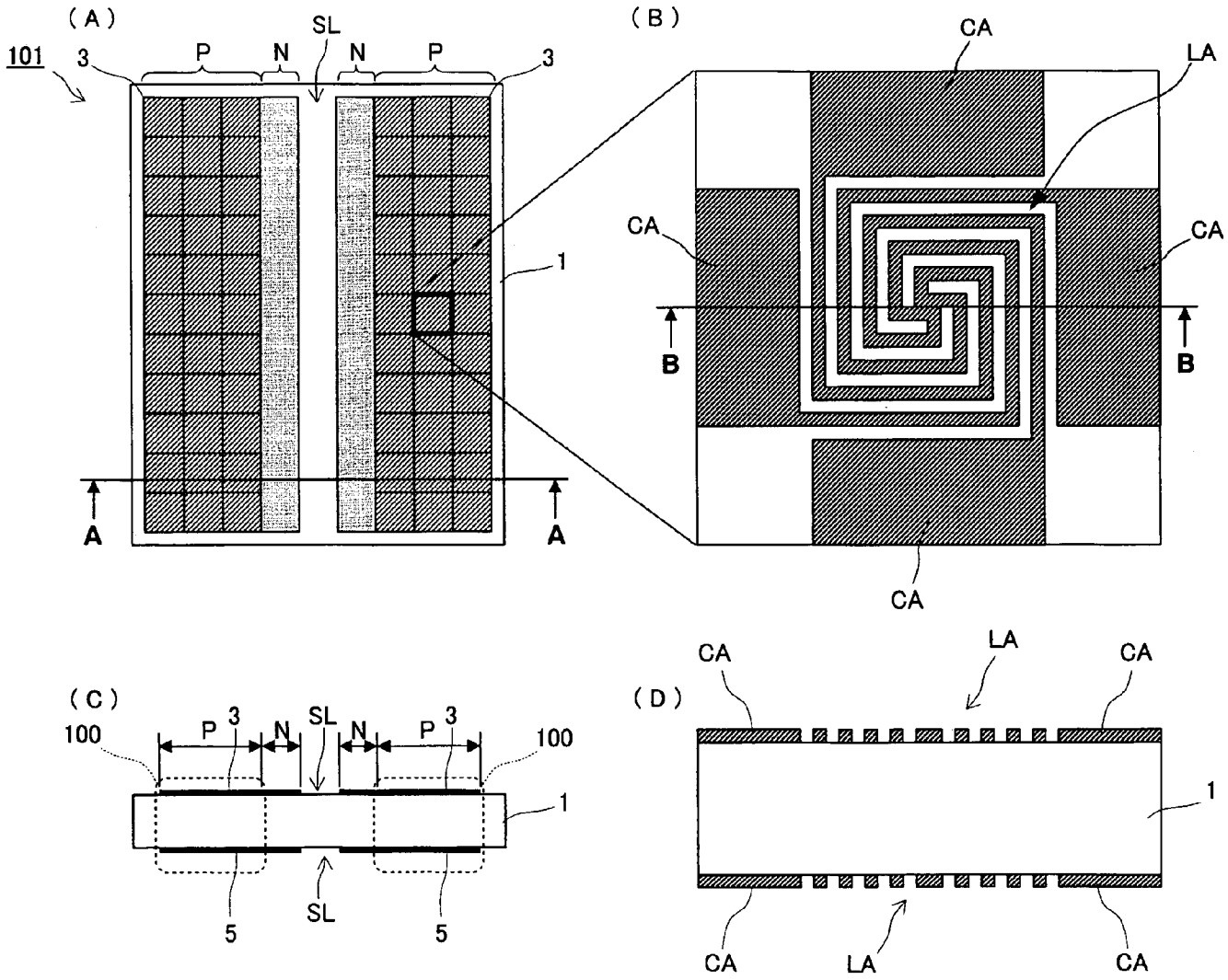
FIG. 53 illustrates the configurations of a planar circuit and a high-frequency circuit device according to a fourteenth embodiment.

A planar circuit and a high frequency circuit device according to a thirteenth embodiment are described next with reference to FIG. 52.

While the twelfth embodiment has been described with reference to the example in which the ground conductor films disposed on either side of the transmission line conductor of the grounded coplanar transmission line are patterned conductor films, the second embodiment has a waveguide formed from a grounded slot line. FIG. 52(A) is a top view of the planar circuit. FIG. 52(B) is an enlarged view of a unit cell of the planar circuit. FIG. 52(C) is a cross-sectional view taken along line A-A of FIG. 52(A). FIG. 52(D) is a cross-sectional view taken along line B-B of FIG. 52(B). A patterned conductor film 3 is formed on the upper surface of a substrate 1. In addition, a slot SL is formed on the upper surface of the substrate 1. A ground conductor film 2 is formed on the substantially entire lower surface of the substrate 1. As shown in FIGS. 52(B) and 52(D), a plurality of unit cells are two-dimensionally disposed in a pattern formed region P of the patterned conductor film 3. The unit cell CL is similar to that described in the first embodiment. In contrast, the unit cell CL is not formed in a pattern unformed region N, but a continuous ground conductor film is simply formed in the pattern unformed region N.

In this way, the slot SL, the patterned conductor films 3 located on either side of the slot SL (in particular, the pattern unformed regions N of the patterned conductor films 3), and the ground conductor film 2 on the lower surface of the substrate 1 form a grounded slot line. Like the first embodiment, such a slot line can block propagation of a spurious mode, such as a parallel plate mode, in the substrate 1.

Fourteenth Embodiment

A planar circuit and a high frequency circuit device according to a fourteenth embodiment are described next with reference to FIGS. 53 to 57.

FIG. 53(A) is a top view of the planar circuit. FIG. 53(B) is an enlarged view of a unit cell of the planar circuit. FIG. 53(C) is a cross-sectional view taken along line A-A of FIG. 53(A). FIG. 53(D) is a cross-sectional view taken along line B-B of FIG. 53(B). A patterned conductor film 3 is formed on the upper surface of a substrate 1. In addition, a slot SL is formed on the upper surface of the substrate 1. A patterned conductor film 5 is formed on the lower surface of the substrate 1. In addition, a slot is formed on the lower surface of the substrate 1. As shown in FIGS. 53(B) and 53(D), a plurality of unit cells are two-dimensionally disposed in pattern formed regions P of the patterned conductor films 3 and 5. The unit cell CL is similar to that described in the first and second embodiments. The pattern of a capacitive region CA and the inductive region LA of the unit cell formed in the patterned conductor film 5 on the lower surface and the pattern on the upper surface exhibit plane symmetry. When viewed from the upper surface or the lower surface, the patterns of the capacitive regions CA on the upper and lower surfaces overlap. Similarly, the patterns of the inductive regions LA on the upper and lower surfaces overlap. In contrast, the unit cell CL is not formed in a pattern unformed region N, but a continuous ground conductor film is simply formed in the pattern unformed region N. In this way, a two-sided slot transmission line or a planar dielectric transmission line (PDTL) is formed.

Examples of the analysis of the planar circuit according to the present invention using a four-port S parameter are described next with reference to FIGS. 54 to 57.

Figure 20:
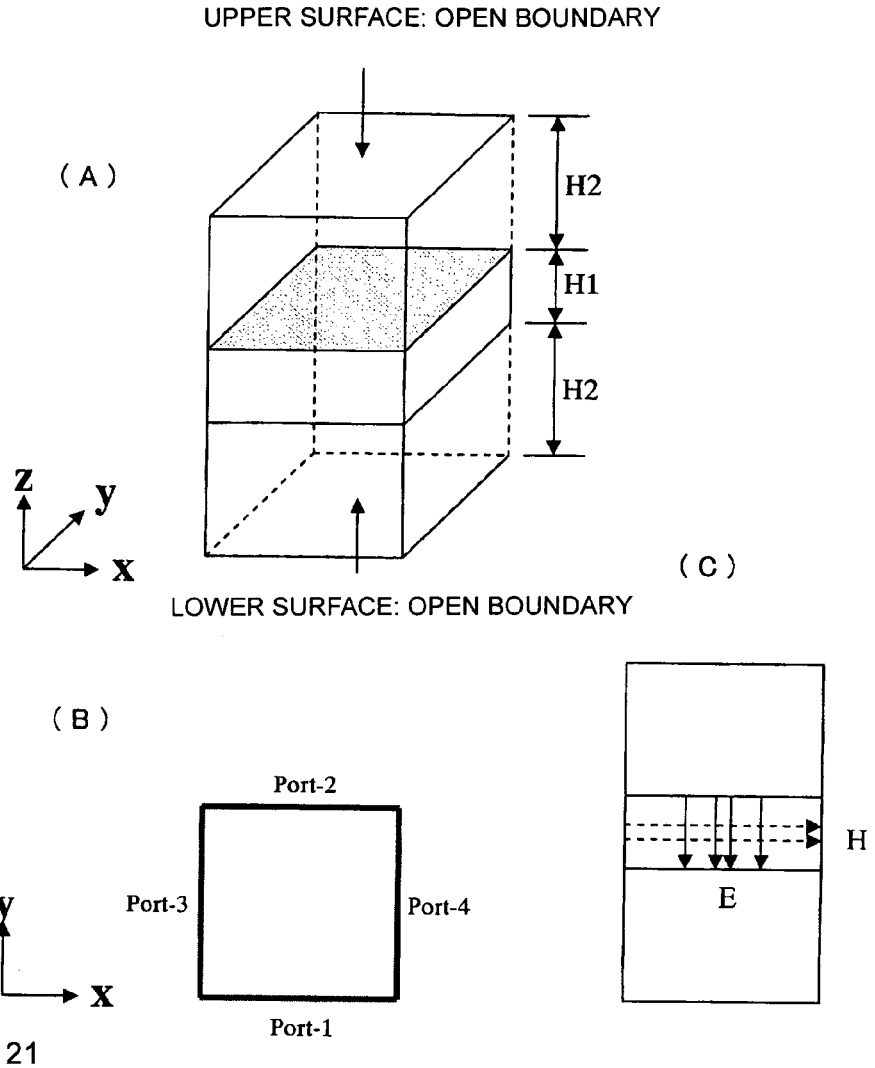
FIG. 20 illustrates an analysis model of a 4-port S parameter.

The analysis model is the same as that shown in FIG. 20.

Figure 54:
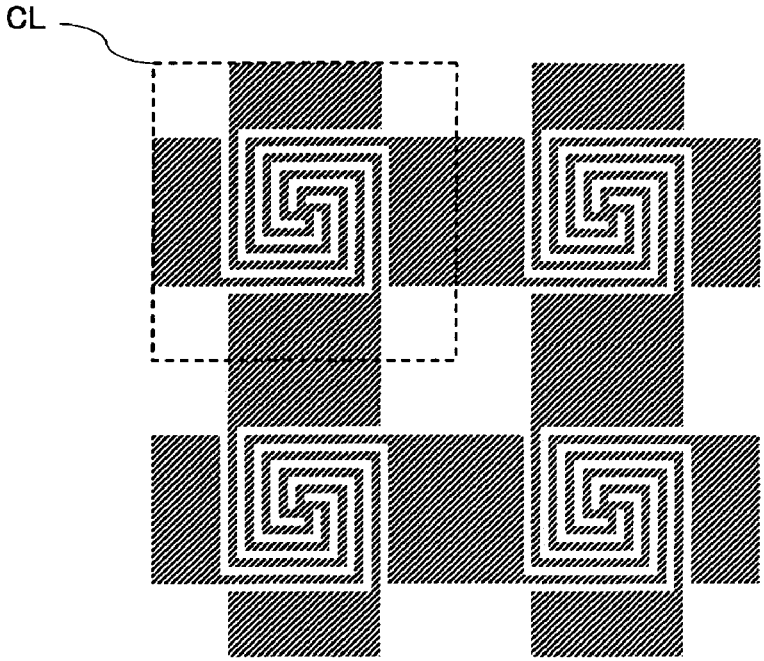
FIG. 54 illustrates an example of how an analysis area is defined.

FIG. 54 illustrates an example of how the analysis area is defined. In this example, an S parameter in which a unit cell CL serves as four ports is computed.

Figure 55:
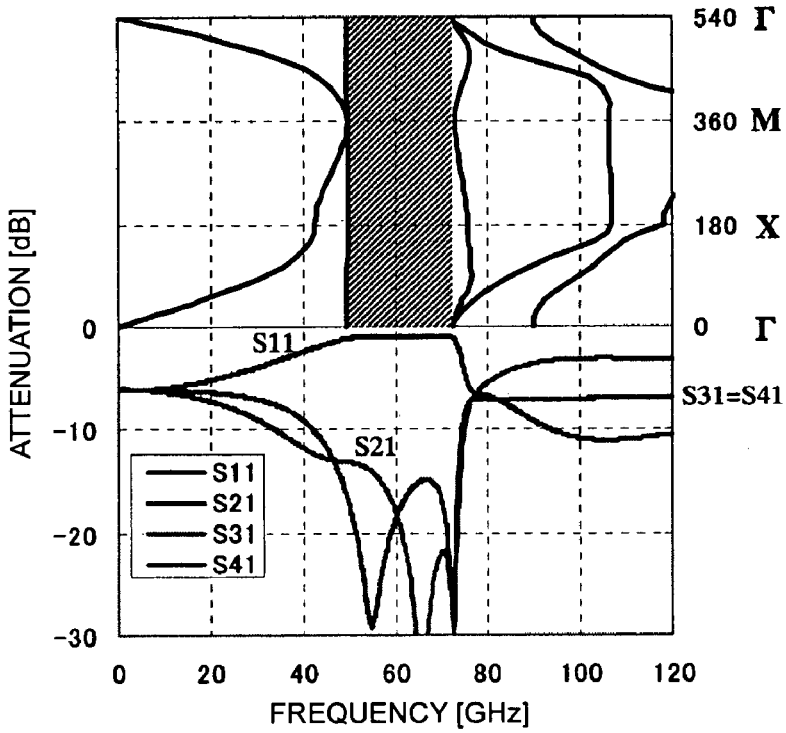
FIG. 55 illustrates examples of the S parameter and a band gap in the case where the number of lines n=6 and the linewidth/spacewidth=11 μm/11 μm in an inductive region.
Figure 56:
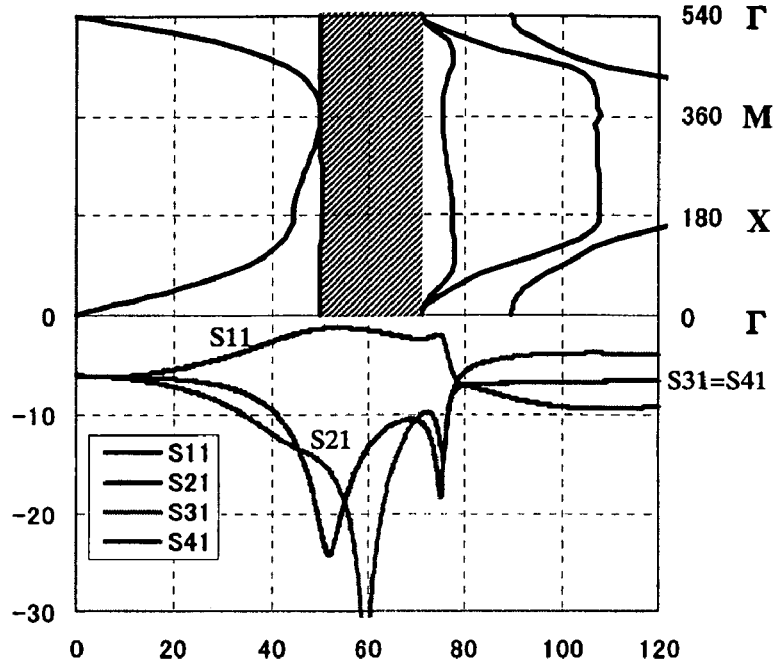
FIG. 56 illustrates examples of the S parameter and a band gap in the case where the number of lines n=8 and the linewidth/spacewidth=7 μm/7 μm in the inductive region.
Figure 57:
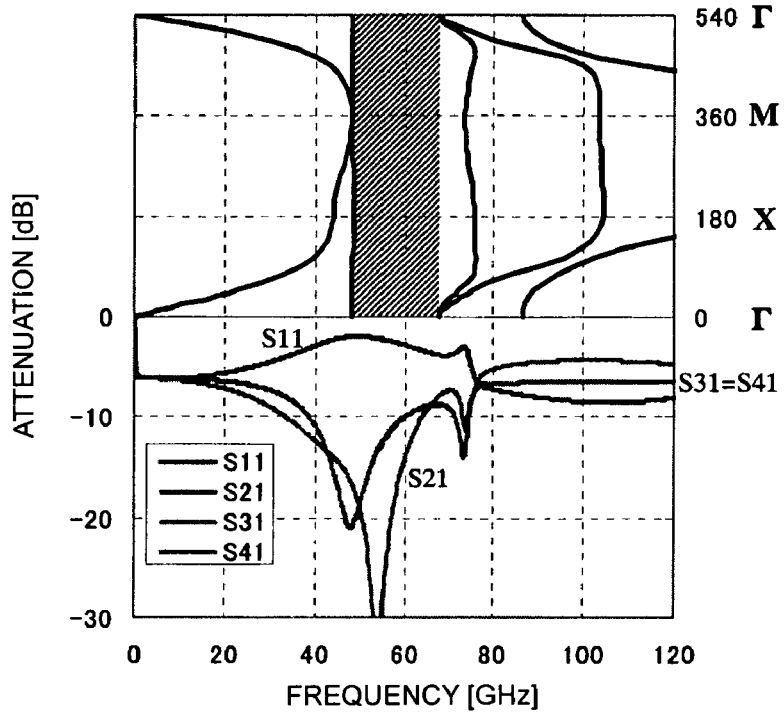
FIG. 57 illustrates examples of the S parameter and a band gap in the case where the number of lines n=10 and the linewidth/spacewidth=5 μm/5 μm in the inductive region.

FIGS. 55 to 57 illustrate examples of S parameters and the dispersion relation when the number of lines n of the inductive region is changed.

FIG. 55 illustrates an example in the case where the number of lines n=6 and the linewidth L/spacewidth S=11 μm/11 μm. The dimensions of parts of a unit cell are as follows:

cell size: A=286 μm
width of the capacitive region W: 143 μm
thickness of the substrate H1: 300 μm
vertical space H2: 300 μm.

FIG. 56 illustrates an example in the case where the number of lines n=8 and the linewidth L/spacewidth S=7 μm/7 μm. The dimensions of parts of a unit cell are as follows:

cell size: A=238 μm
width of the capacitive region W: 119 μm
thickness of the substrate H1: 300 μm
vertical space H2: 300 μm.

FIG. 57 illustrates an example in the case where the number of lines n=10 and the linewidth L/spacewidth S=5 μm/5 μm. The dimensions of parts of a unit cell are as follows:

cell size: A=210 μm
width of the capacitive region W: 105 μm
thickness of the substrate H1: 300 μm
vertical space H2: 300 μm.

By using patterned conductor films on either surface of the substrate under such conditions, a band gap was able to be generated at about 60 GHz even when the number of lines was changed. When analyzing the four-port S parameter for a square having sides that are the diagonal lines of the unit cells, S11 was high (the reflection was high) in a band gap, and S21 to S41 were attenuated. In addition, S31 overlapped S41 due to the symmetry property of the pattern.

Fifteenth Embodiment

A high-frequency circuit device according to a fifteenth embodiment is described next with reference to FIG. 58.

Figure 58:
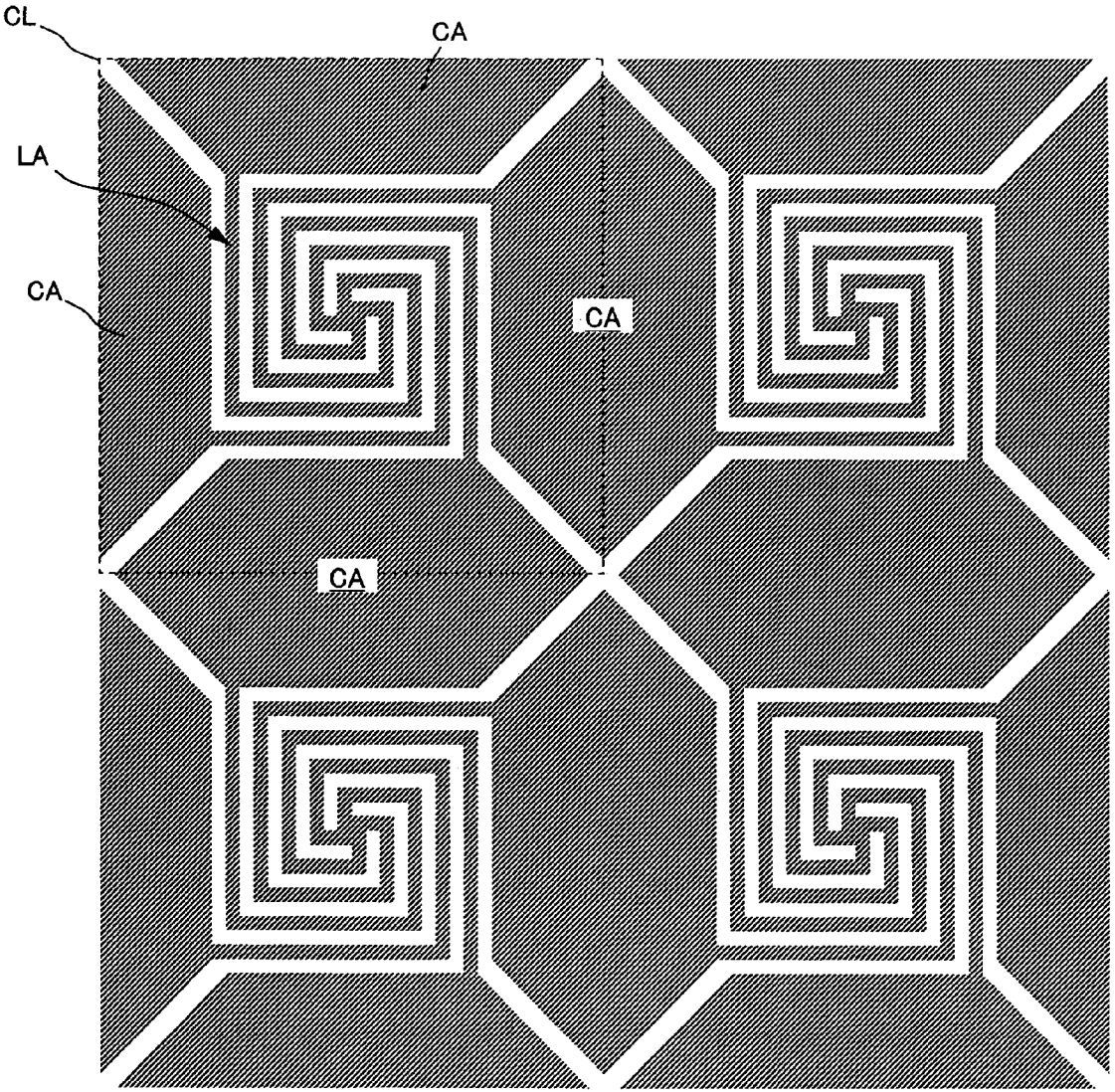
FIG. 58 illustrates a unit cell used in a planar circuit and a high-frequency circuit device according to a fifteenth embodiment.

FIG. 58 is a plan view of the unit cell. A unit cell CL has an inductive region LA at the center thereof and a capacitive region CA at each side in the periphery thereof. However, unlike the example shown in FIG. 41, the capacitive region CA extends towards spaces at the four corners of the unit cell. The inductive region LA is similar to that shown in FIG. 41. In this manner, the dimensions of the capacitive region may be increased.

Sixteenth Embodiment

A planar circuit according to a sixteenth embodiment is described next with reference to FIG. 59.

Figure 59:
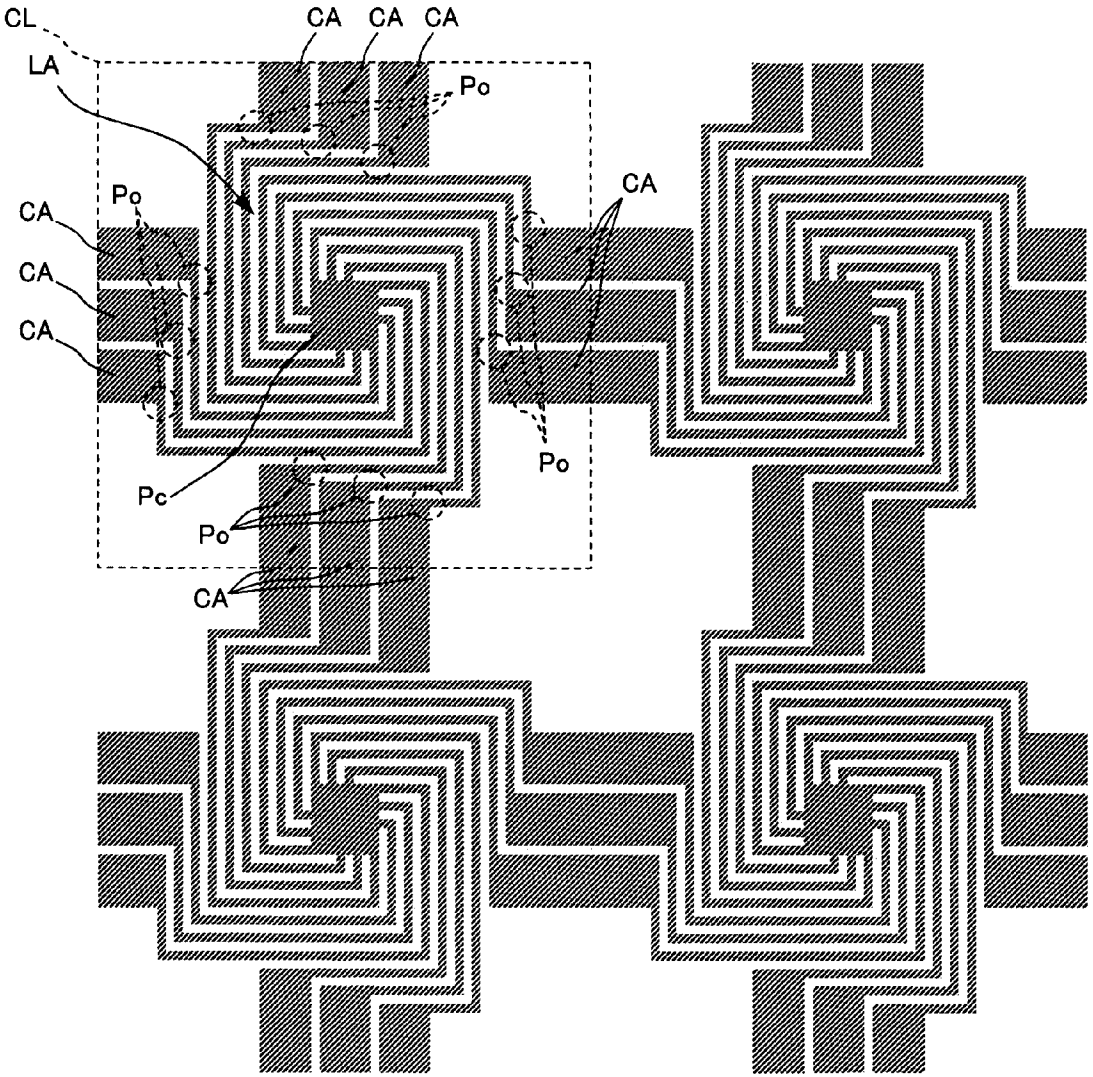
FIG. 59 illustrates a unit cell of a planar circuit and an example of two-dimensional arrangement of a plurality of the unit cells according to a sixteenth embodiment.

FIG. 59 illustrates a portion of the planar circuit in which a plurality of unit cells are two-dimensionally arranged. In this example, the inductive region LA has a conductor pattern having a duodecuple spiral shape. Outer peripheral ends Po of the lines of the inductive region LA are connected to capacitive regions CA. Inner ends of the lines of the inductive region LA are connected one another using the center ends Pc. In this way, even when the number of multiplex levels of the multiple spiral pattern is increased, the inductive region LA can be formed.

In the same manner, an octuple spiral conductor pattern or a hexadecuple spiral conductor pattern can be employed. If the line width of the spiral-shaped conductor pattern is smaller than the skin depth of the operating frequency, a skin effect may be reduced. Accordingly, a loss reduction effect may be obtained. Thus, by increasing the number of lines of the multiple spiral pattern in the inductive region, the inductive region functions as an inductive element having a higher Q value. However, as the number of lines of the multiple spiral pattern increases, the size of the unit cell increases. Furthermore, the balance between electrical currents flowing in the spiral-shaped conductors is not suitable, the Q value may decrease. Therefore, in the design, the number of lines and the line width need to be carefully considered.

While the example shown in FIG. 59 has been described with reference to the capacitive regions separated for each of the line conductors of the inductive region, the capacitive regions may be integrated into one capacitive region at an area in the middle of each of the sides along the periphery of the unit cell CL.

Seventeenth Embodiment

Figure 60:
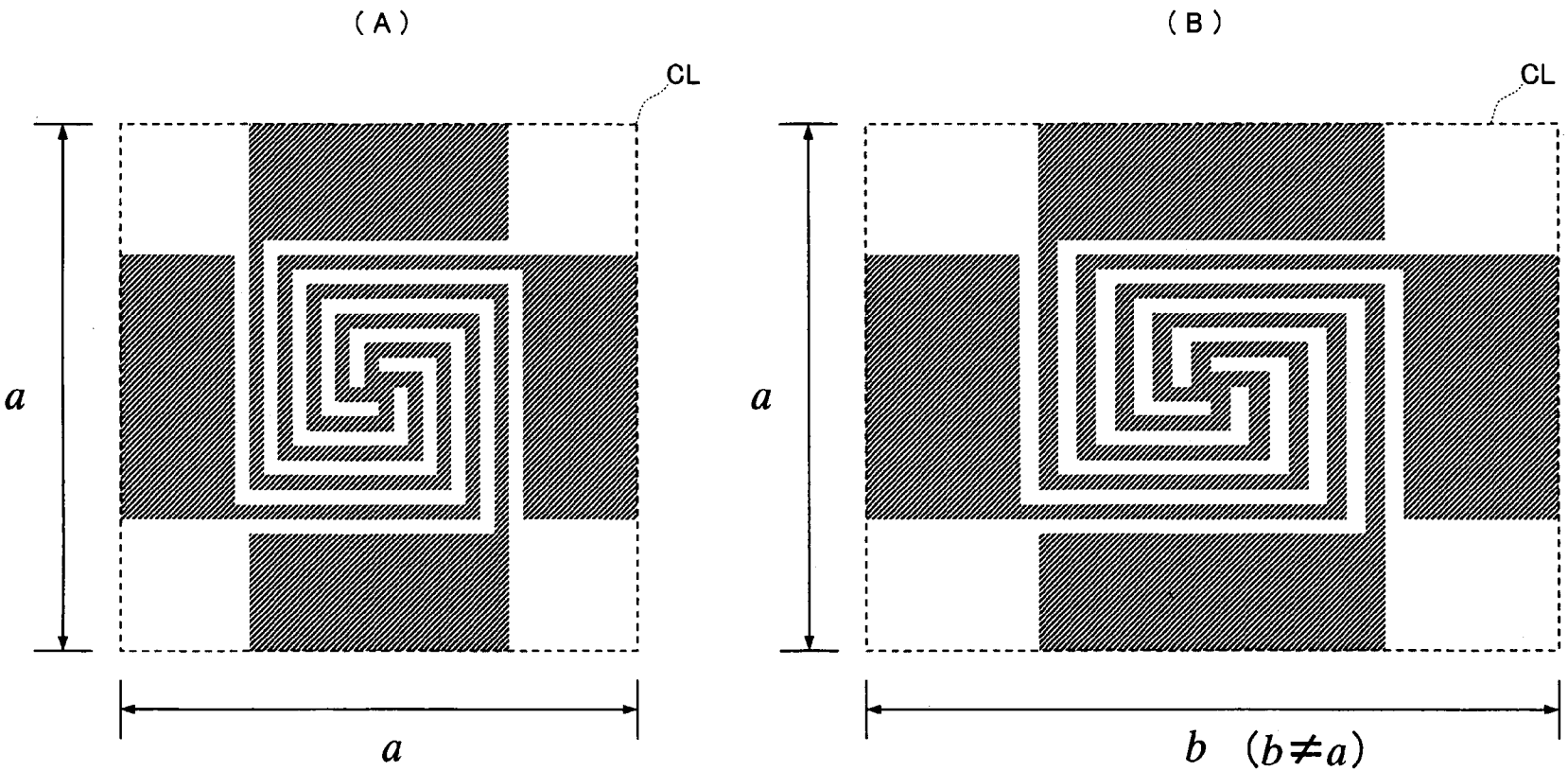
FIG. 60 illustrates an example structure of a unit cell of a planar circuit according to a seventeenth embodiment.

FIG. 60 illustrates the structure of a unit cell used in a planar circuit according to a seventeenth embodiment. FIG. 60(A) illustrates a basic shape that is the same as the shape shown in FIG. 41 and other drawings. FIG. 60(B) illustrates a modification of the basic shape. In this embodiment, the lengths of a side "a" and a side "b" of the unit cell that is perpendicular to the side "a" are made different so that the aspect ratio is changed from 1:1. It is advantageous that the unit cell has a rectangular shape with two-fold rotational symmetry in the above-described manner. In addition, by using the design flexibility of the aspect ratio effectively, the characteristics of the band gap can be anisotropic in the longitudinal and transverse directions.

Eighteenth Embodiment

Figure 61:
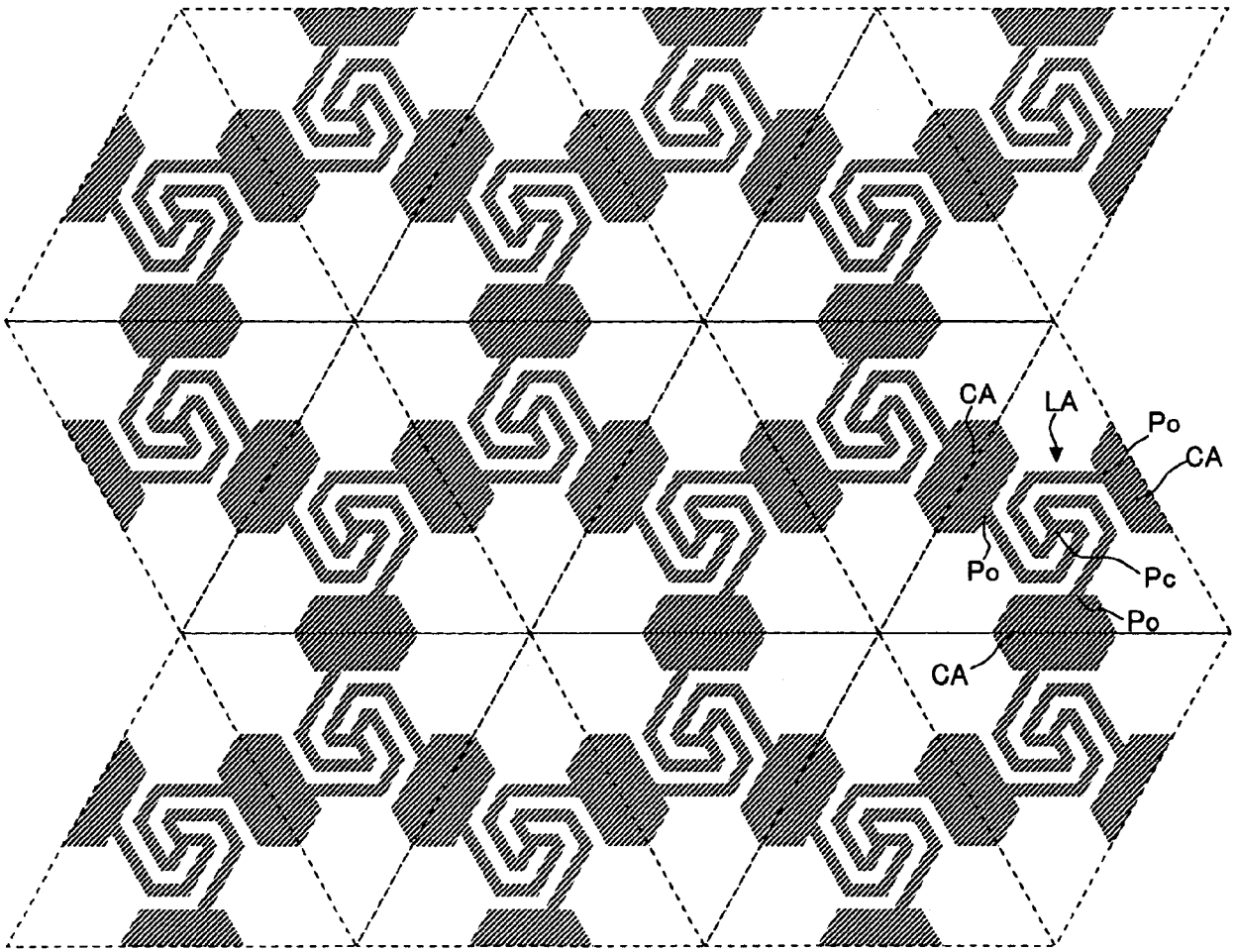
FIG. 61 illustrates a unit cell of a planar circuit and an example of two-dimensional arrangement of a plurality of the unit cells according to an eighteenth embodiment.

FIG. 61 illustrates the structure of a unit cell used in a planar circuit and two-dimensional arrangement of the unit cells according to an eighteenth embodiment. In the above-described embodiments, the shape of the unit cell is a square or a rectangle. However, in this embodiment, the shape of a unit cell CL is an equilateral triangle, which has three-fold rotational symmetry. The planar circuit is filled with the unit cells CL having such a shape. An inductive region LA is provided at the center of the unit cell CL. A capacitive region CA is provided in an area near the middle of each side in the periphery of the unit cell CL. In any two adjacent unit cells, the capacitive regions are connected to each other at a halfway portion between the two adjacent unit cells. Even such a conductor pattern in which the unit cells, each having three-fold rotational symmetry, are two-dimensionally arranged can provide similar advantages as in the above-described embodiments.

Nineteenth Embodiment

Figure 62:
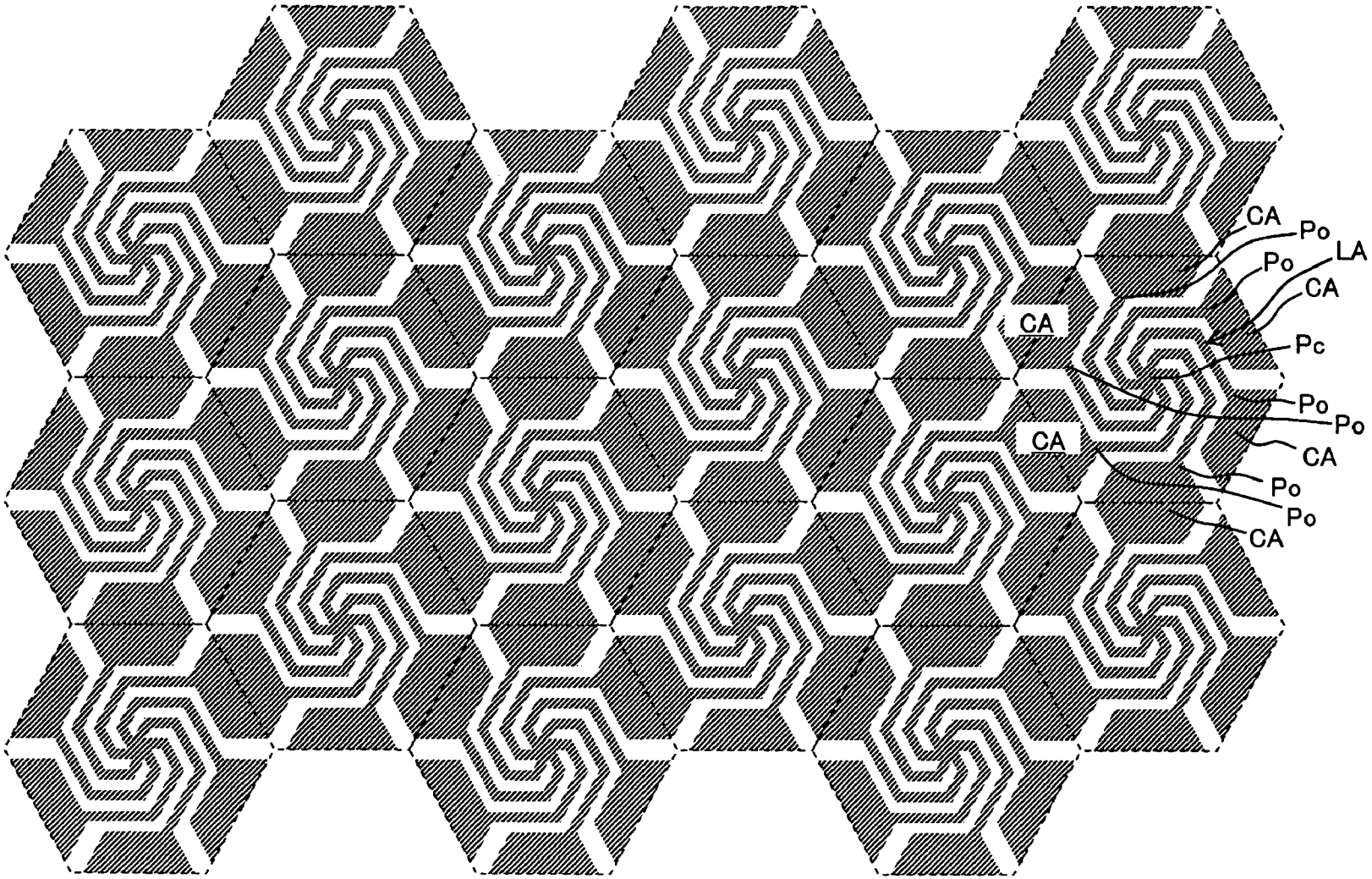
FIG. 62 illustrates a unit cell of a planar circuit and an example of two-dimensional arrangement of a plurality of the unit cells according to a nineteenth embodiment.

FIG. 62 illustrates the structure of a unit cell used in a planar circuit and two-dimensional arrangement of the unit cells according to a nineteenth embodiment. In this embodiment, the shape of a unit cell CL is regular hexagon, which has six-fold rotational symmetry. Such unit cells CL are two-dimensionally arranged so that the planar circuit is filled with the unit cells CL. An inductive region LA is provided at the center of each of the unit cells CL. A capacitive region CA is provided at an area near the middle of each side in the periphery of the unit cell CL. In any two adjacent unit cells, the capacitive regions are connected to each other at a halfway portion between the two adjacent unit cells. Even such a conductor pattern in which the unit cells, each having six-fold rotational symmetry, are two-dimensionally arranged can provide similar advantages as in the above-described embodiments.

Twentieth Embodiment

An example of the characteristics of a high-frequency circuit device including a planar circuit according to the present invention obtained through simulation is described as a twentieth embodiment.

Figure 63:
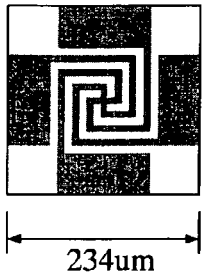
FIG. 63 illustrates a high-frequency circuit device and the structure of a unit cell applied to the high-frequency circuit device according to a twentieth embodiment.
Figure 63:
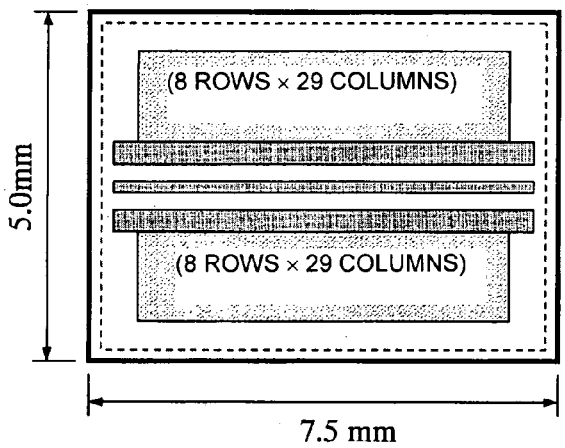

FIG. 63(A) illustrates the shape and dimensions of a unit cell of the planar circuit. FIG. 63(B) illustrates the structure of the high-frequency circuit device. The unit cell has a pattern illustrated in FIG. 63(A). The unit cell has a square shape having sides of 234 μm in which the linewidth L/spacewidth S=9 μm/9 μm, and the number of lines n=6. The high-frequency circuit device is formed by forming a conductor pattern on a substrate having a relative permittivity of 24, a thickness of 0.3 mm, and a size of 5.0 mm×7.5 mm. In this embodiment, the characteristics were obtained for each of the following:

(1) a normal coplanar transmission line CPW having no ground conductor film on the lower surface;

(2) a grounded coplanar transmission line CBCPW having a ground conductor film on the lower surface; and (3) a high-frequency circuit device including a grounded coplanar transmission line CBCPW in which the above-described unit cells are two-dimensionally arranged in ground conductor films disposed on either side of the coplanar transmission line.

More specifically, in the high-frequency circuit device, each of the ground conductor films on either side of the coplanar transmission line includes the unit cells in 8 rows× 29 columns.

Figure 64:
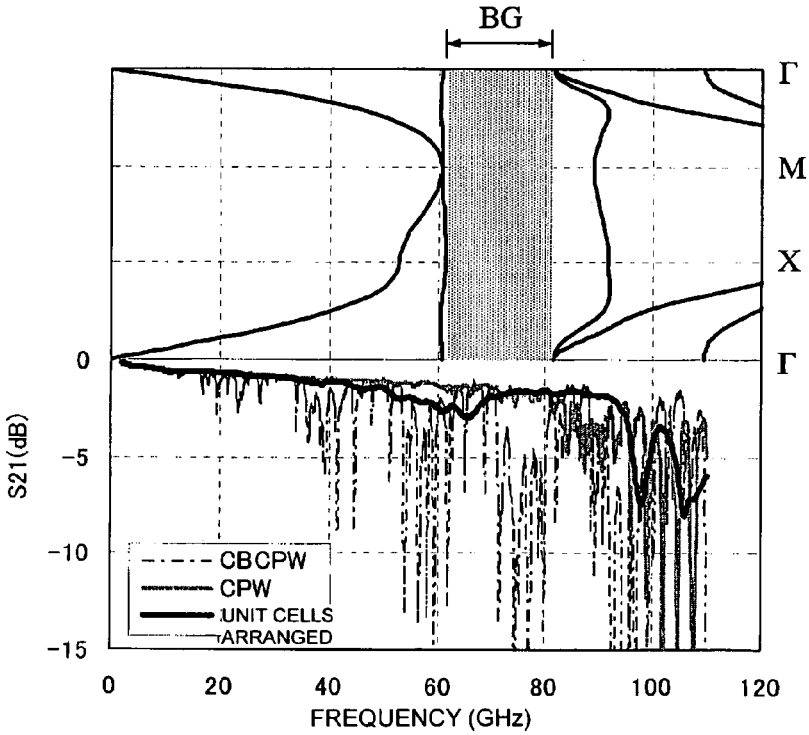
FIG. 64 illustrates the S parameter and the dispersion relation of the high-frequency circuit device.

FIG. 64 illustrates the S parameter and the dispersion relation. The lower section of the drawing represents the transmission characteristic S21, while the upper section of the drawing represents the five modes and a band gap BG. This result indicates the following:

(1) The CPW has a relatively flat insertion loss characteristic up to about 80 GHz.

However, the occurrence of a ripple due to a surface wave increases from about 80 GHz.

(2) The CBCPW has a large number of ripples that are caused by a parallel plate mode and that appear above about 20 GHz.

(3) The cell arrangement model can prevent the occurrence of ripples which is present in the CBCPW.

In particular, the insertion loss can be reduced in the range from about 70 GHz to about 90 GHz due to a wide band gap (BG).

As described above, in the planar circuit having the unit cells disposed two-dimensionally, the parallel plate mode can be prevented and few ripples caused by a plane wave occur. Accordingly, the transmission characteristic in which few ripples occur in a wide frequency range can be obtained.

The invention claimed is:

1. A planar circuit comprising:

a substrate having a first surface and a second surface;

a first conductor film disposed on the first surface of the substrate; and a second conductor film disposed on the second surface of the substrate, at least one of the first and second conductor films including a pattern formed region containing two-dimensionally and repeatedly arranged unit cells, each of the unit cells having rotational symmetry, wherein a center area in each of the unit cells is an inductive region, and an area located at least near a middle of each side of a peripheral portion in each unit cell is a capacitive region, and wherein the inductive region has a multiple spiral-shaped conductor pattern in which inner ends are connected to each other at a center thereof and outer peripheral ends thereof are connected to the capacitive regions, and wherein, in any two adjacent of said unit cells, the capacitive region of one unit cell is connected to the capacitive region of the other unit cell at a halfway portion between the two adjacent unit cells.

2. A high-frequency circuit device comprising:

the planar circuit according to claim 1, wherein a transmission line conductor pattern is formed by the first conductor film disposed on the first surface of the substrate, and the second conductor film disposed on the second surface is a ground conductor so as to form a grounded waveguide, and wherein an area of the first conductor film remote from an electromagnetic wave guiding area of the grounded waveguide by a predetermined distance is the pattern formed region.

3. The high-frequency circuit device according to claim 2, further comprising a transmission line conductor disposed on the first surface of the substrate.

4. The high-frequency circuit device according to claim 2, wherein the first conductor film is disposed on the first surface of the substrate to form a grounded slot line.

5. A high-frequency circuit device comprising:

the planar circuit according claim 1, wherein the first and second conductor films of the planar circuit form transmission line conductor patterns having plane symmetry with respect to each other with the substrate therebetween so as to form a waveguide, and wherein an area of the first and second conductor films remote from an electromagnetic wave guiding area of the waveguide by a predetermined distance is the pattern formed region.

6. The planar circuit according to claim 1, wherein the capacitive region extends toward corners of the unit cells.

7. A high-frequency circuit device comprising:

a planar circuit comprising:

a substrate having a first surface and a second surface;

a first conductor film disposed on the first surface of the substrate; and a second conductor film disposed on the second surface of the substrate, at least one of the first and second conductor films including a pattern formed region containing two-dimensionally and repeatedly arranged unit cells, each of the unit cells having rotational symmetry, wherein a center area of each of the unit cells is a capacitive region, and an area located near a middle of each side of a peripheral portion in each unit cell is an inductive region, wherein, in any two adjacent unit cells, the inductive regions have a multiple spiral-shaped conductor pattern having two-fold rotational symmetry in which center ends thereof are connected to each other at a halfway portion between the two adjacent unit cells, and outer peripheral ends thereof are connected to the capacitive regions, and wherein the first and second conductor films of the planar circuit form transmission line conductor patterns having plane symmetry with respect to each other with the substrate therebetween so as to form a waveguide, and wherein an area of the first and second conductor films remote from an electromagnetic wave guiding area of the waveguide by a predetermined distance is the pattern formed region.

8. A high-frequency circuit device according to claim 7, further comprising:

a high-frequency circuit disposed on the substrate.

9. A transmission and reception apparatus comprising:

a high-frequency signal processing unit including a high-frequency circuit device according to claim 7 disposed on the substrate.

10. The planar circuit according to claim 7, wherein the capacitive region extends toward corners of the unit cells.

11. The planar circuit according to claim 7, wherein the inductive region extends toward corners of the unit cells.

* * * * *